US011981495B2

(12) United States Patent
Lewandowski

(10) Patent No.: US 11,981,495 B2
(45) Date of Patent: May 14, 2024

(54) PACKAGING SUBASSEMBLY, A PACKAGING ASSEMBLY AND A METHODOLOGY FOR PREPARING A PACKAGING ASSEMBLY

(71) Applicant: Kellogg Company, Battle Creek, MI (US)

(72) Inventor: Eric Patrick Lewandowski, Grand Ledge, MI (US)

(73) Assignee: KELLOGG COMPANY, Battle Creek, MI (US)

( * ) Notice: Subject to any disclaimer, the term of this patent is extended or adjusted under 35 U.S.C. 154(b) by 309 days.

(21) Appl. No.: 17/284,004

(22) PCT Filed: Oct. 10, 2019

(86) PCT No.: PCT/US2019/055681

§ 371 (c)(1),
(2) Date: Apr. 9, 2021

(87) PCT Pub. No.: WO2020/077116

PCT Pub. Date: Apr. 16, 2020

(65) Prior Publication Data

US 2021/0394988 A1 Dec. 23, 2021

Related U.S. Application Data

(60) Provisional application No. 62/744,228, filed on Oct. 11, 2018.

(51) Int. Cl.
*B65D 81/32* (2006.01)
*B65D 51/24* (2006.01)
(Continued)

(52) U.S. Cl.
CPC ..... *B65D 81/3216* (2013.01); *B65D 51/247* (2013.01); *B65D 77/0486* (2013.01); *B65D 77/245* (2013.01); *B65D 77/2024* (2013.01)

(58) Field of Classification Search
CPC ..... B65D 81/3216; B65D 51/247; B65D 77/0486; B65D 77/245; B65D 77/2024
(Continued)

(56) References Cited

U.S. PATENT DOCUMENTS 1,514,379 A * 11/1924 Fleischer ..... 206/229
3,624,787 A * 11/1971 Newman ..... B65D 51/247 206/229
(Continued)

FOREIGN PATENT DOCUMENTS

CA 1155088 10/1983
CN 201840163 5/2011
(Continued)

OTHER PUBLICATIONS

PCT/US2019/055681 International Search Report dated Dec. 20, 2019.

*Primary Examiner* — Steven A. Reynolds
(74) *Attorney, Agent, or Firm* — Honigman LLP

(57) ABSTRACT

An assembly is disclosed. The assembly includes a container and a utensil. The container includes a bowl portion defined by a bottom wall and a side wall extending from the bottom wall. The side wall and the bottom wall are each defined by an inner surface that forms a cavity of the bowl portion. The utensil is disposed within the cavity and is removably-secured to the inner surface of the side wall that defines the bowl portion of the container. An assembly is also disclosed. A method is also disclosed.

21 Claims, 48 Drawing Sheets

(51) Int. Cl.
*B65D 77/04* (2006.01)
*B65D 77/24* (2006.01)
*B65D 77/20* (2006.01)

(58) Field of Classification Search
USPC ..... 206/541, 500; 220/735
See application file for complete search history.

(56) References Cited

U.S. PATENT DOCUMENTS

| | | | | |
|---|---|---|---|---|
| 3,819,080 | A * | 6/1974 | Bird | B65D 81/3216 426/118 |
| 3,955,742 | A * | 5/1976 | Marshall | B65D 51/247 229/401 |
| 5,090,572 | A * | 2/1992 | DeRoseau | B65D 81/3216 206/541 |
| 5,597,071 | A | 1/1997 | Sutherland | |
| 5,669,550 | A * | 9/1997 | Klemme | B65D 51/247 229/125.05 |
| 5,705,212 | A * | 1/1998 | Atkinson | B65D 51/247 426/115 |
| D406,058 | S | 2/1999 | Allmon | |
| 6,371,324 | B1 * | 4/2002 | Torniainen | B65D 51/246 220/780 |
| D469,320 | S | 1/2003 | Pettaweebuncha | |
| 6,604,645 | B1 * | 8/2003 | Vaupotic | B65D 51/247 220/780 |
| D514,389 | S | 2/2006 | Luna et al. | |
| 7,175,041 | B2 * | 2/2007 | Ekkert | B65D 51/246 206/541 |
| D547,179 | S | 7/2007 | Bouveret et al. | |
| 7,823,743 | B2 * | 11/2010 | McKahan | B65D 77/245 220/254.1 |
| D645,738 | S | 9/2011 | Shiffer et al. | |
| D666,875 | S | 9/2012 | Rusnak | |
| 8,313,001 | B1 * | 11/2012 | Reid | B65D 51/20 220/256.1 |
| D706,131 | S | 6/2014 | Brooks et al. | |
| D710,213 | S | 8/2014 | Birchmeier | |
| D714,639 | S | 10/2014 | Royer et al. | |
| D718,641 | S | 12/2014 | Ryan et al. | |
| D723,339 | S | 3/2015 | Maxwell et al. | |
| D742,759 | S | 11/2015 | Ryan et al. | |
| D748,471 | S | 2/2016 | Sanfilippo et al. | |
| D756,769 | S | 5/2016 | Tuchrelo et al. | |
| D764,277 | S | 8/2016 | Irimia et al. | |
| D769,732 | S | 10/2016 | Shoshan | |
| 9,541,441 | B2 * | 1/2017 | Prero | G01F 19/002 |
| D828,766 | S | 9/2018 | Latour et al. | |
| D867,900 | S | 11/2019 | Thompson et al. | |
| D901,295 | S | 11/2020 | Sytsma | |
| 2005/0051549 | A1 * | 3/2005 | Nelson | B65D 81/3216 220/23.83 |
| 2009/0142455 | A1 | 6/2009 | Parsons | |
| 2015/0024095 | A1 * | 1/2015 | Pippig | B65D 81/3869 426/106 |
| 2016/0176592 | A1 * | 6/2016 | Lorimier | B65D 51/185 220/23.89 |
| 2021/0139223 | A1 * | 5/2021 | Aceves | B65D 43/0202 |
| 2022/0097933 | A1 * | 3/2022 | Kim | B65D 51/247 |

FOREIGN PATENT DOCUMENTS

| | | |
|---|---|---|
| CN | 106805632 | 6/2017 |
| DE | 2741999 | 3/1979 |
| DE | 8908305 | 9/1989 |
| EP | 0677454 | 10/1995 |
| FR | 1499662 | 10/1967 |
| FR | 2892388 | 4/2007 |
| FR | 3044643 | 6/2017 |
| JP | H0930531 | 2/1997 |

* cited by examiner

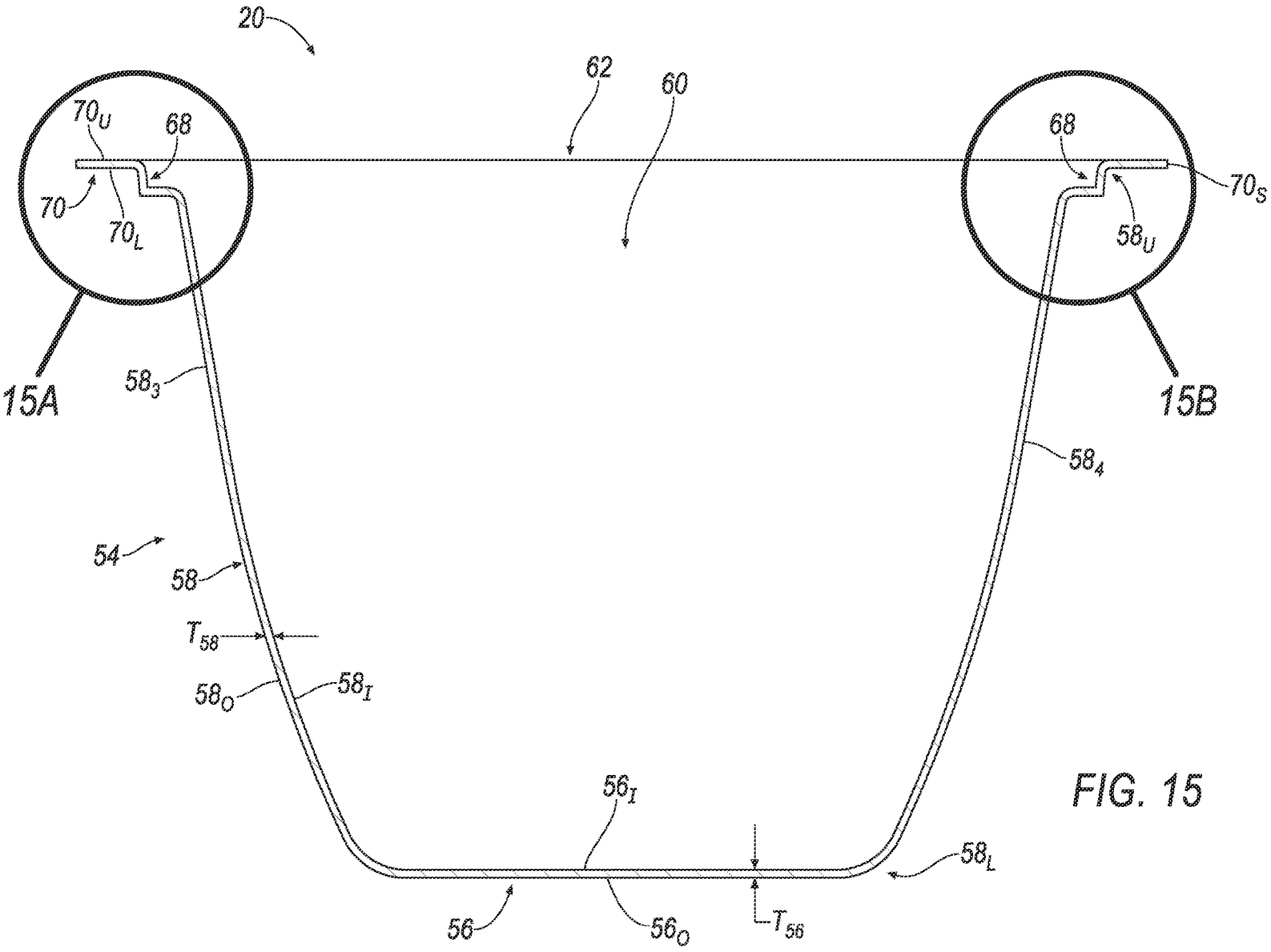
20
15A
15B
68
70
70U
70L
70S
58U
58
58O
58I
58L
58O
58I
58L
58O
58I
58L

PACKAGING SUBASSEMBLY, A PACKAGING ASSEMBLY AND A METHODOLOGY FOR PREPARING A PACKAGING ASSEMBLY

CROSS-REFERENCE TO RELATED APPLICATIONS

This application is a National Stage Application and claims priority under 35 U.S.C. § 371 to Patent Cooperation Treaty application PCT/US2019/055681, filed Oct. 10, 2019, which claims the benefit of and priority under 35 U.S.C. § 119(e) to U.S. Provisional Application No. 62/744,228, filed Oct. 11, 2018. Priority is claimed to both of these applications and the disclosures of these prior applications are considered part of the disclosure of this application, and to the extent allowed, the entire contents of the aforementioned applications are incorporated herein.

TECHNICAL FIELD

This disclosure relates to packaging subassembly, a packaging assembly formed by a plurality of packaging subassemblies and a methodology for preparing a packaging assembly.

BACKGROUND

Packaging assemblies are known. While existing packaging assemblies perform adequately for their intended purpose, improvements to packaging assemblies are continuously being sought in order to advance the arts.

SUMMARY

One aspect of the disclosure provides an assembly. The assembly includes a container and a utensil. The container includes a bowl portion defined by a bottom wall and a side wall extending from the bottom wall. The side wall and the bottom wall are each defined by an inner surface that forms a cavity of the bowl portion. The utensil is disposed within the cavity and is removably-secured to the inner surface of the side wall that defines the bowl portion of the container.

Implementations of the disclosure may include one or more of the following optional features. In some implementations, the assembly includes foodstuff disposed within the cavity and a seal secured over the cavity for sealing the utensil and the foodstuff within the cavity of the bowl portion from surrounding environment.

In some examples, the assembly includes a lip portion extending away from the upper end of the side wall. The seal is secured to an upper surface of the lip portion and extends across an opening formed by the upper end of the side wall for sealing the cavity of the bowl portion from surrounding environment.

In some instances, the side wall is defined by a lower end and an upper end. The lower end of the side wall extends from the bottom wall. The upper end of the side wall forms an opening providing access to the cavity. The container includes a lip portion extending away from the upper end of the side wall.

In some implementations, the assembly includes a seal secured to an upper surface of the lip portion. The seal extends across the opening for sealing the cavity of the bowl portion from surrounding environment.

In some examples, the assembly includes foodstuff disposed within the cavity.

In some instances, the inner surface of the side wall defines a first utensil-retaining portion and a second utensil-retaining portion arranged opposite the first utensil-retaining portion. The utensil is defined by a first end and a second end. The first end of the utensil is removably-secured to the first utensil-retaining portion. The second end of the utensil is removably-secured to the second utensil-retaining portion. The utensil is suspended over the inner surface of the bottom wall of the bowl portion at a distance.

In some implementations, the inner surface of the side wall defining each of the first utensil-retaining portion and the second utensil-retaining portion is defined by a snap-fit connection including an embossed portion and a debossed portion.

In some examples, the first utensil-retaining portion is sized for receiving a food-contacting portion defining the first end of the utensil. The second utensil-retaining portion is sized for receiving an intermediate folding hinge of the utensil.

In some instances, the first utensil-retaining portion is sized for receiving a food-contacting portion defining the first end of the utensil. The second utensil-retaining portion is sized for receiving a handle of the utensil.

Another aspect of the disclosure provides an assembly. The assembly includes a first container, a utensil and a second container. The first container forms a first bowl portion defined by a bottom wall and a side wall extending from the bottom wall. The side wall and the bottom wall are each defined by an inner surface that forms a cavity of the first bowl portion. The utensil is disposed within the cavity and is removably-secured to the inner surface of the side wall that defines the first bowl portion of the first container. The second container forms a second bowl portion defined by a bottom wall and a side wall extending from the bottom wall. The side wall and the bottom wall of the second bowl portion are each defined by an inner surface that forms a cavity of the second bowl portion. The first container is disposed within the cavity of the second bowl portion and partially closes out an opening formed by formed by an upper end of the side wall of the second bowl portion to define: a first opening formed by the upper end of the side wall of the second bowl portion and an outer surface of the first container; and a second opening formed by the upper end of the side wall of the second bowl portion and an outer surface of the first container.

Implementations of the disclosure may include one or more of the following optional features. In some implementations, the inner surface of the side wall of the second bowl portion defines opposing ledge surfaces that support opposing lip surface portions extending from the side wall of the first bowl portion of the first container.

In some examples, the assembly further includes a first foodstuff, a first seal, a second foodstuff and a second seal. The first foodstuff is disposed within the cavity of the first bowl portion of the first container. The first seal is secured over the cavity of the first bowl portion for sealing the utensil and the first foodstuff within the cavity of the first bowl portion from the cavity of the second bowl portion for defining a first sealed container assembly. The second foodstuff is disposed within the cavity of the second bowl portion of the second container. The second seal is secured over the cavity of the second bowl portion for sealing the second foodstuff and the first sealed container assembly for defining a second sealed container assembly that is sealed from surrounding environment.

In some instances, the assembly further includes a packaging jacket. The packaging jacket surrounds the second sealed container assembly for forming a packaged sealed container assembly. The packaging jacket defines: a first opening sized for receiving a first lip portion of the second container; and a second opening sized for receiving a second lip portion of the second container.

In some implementations, the packaging jacket further includes a pre-weakened portion. The pre-weakened portion is formed by a first row scores and a second row of scores spaced apart at a distance to define a tear strip. Each of the first row of scores and the second row of scores are defined by a V-shaped segment pointing in opposite directions for defining a portion of the distance to expand to a maximum distance.

In some examples, the pre-weakened portion is further defined by one or more scores arranged perpendicularly with respect to the first row of scores and the second row of scores and being aligned with each V-shaped segment for bifurcating the tear strip into a first tear strip portion and a second tear strip portion.

In some instances, the inner surface of the side wall defines a first utensil-retaining portion and a second utensil-retaining portion that is arranged opposite the first utensil-retaining portion. The utensil is defined by a first end and a second end. The first end of the utensil is removably-secured to the first utensil-retaining portion. The second end of the utensil is removably-secured to the second utensil-retaining portion. The utensil is suspended over the inner surface of the bottom wall of the bowl portion at a distance.

In some implementations, the inner surface of the side wall defining each of the first utensil-retaining portion and the second utensil-retaining portion is defined by a snap-fit connection including an embossed portion and a debossed portion.

In some examples, the first utensil-retaining portion is sized for receiving a food-contacting portion defining the first end of the utensil. The second utensil-retaining portion is sized for receiving an intermediate folding hinge of the utensil.

In some instances, the first utensil-retaining portion is sized for receiving a food-contacting portion defining the first end of the utensil. The second utensil-retaining portion is sized for receiving a handle of the utensil.

Yet another aspect of the disclosure provides a method. The method includes: preparing a first sealed container assembly and preparing a second sealed container assembly. The first sealed container assembly is prepared by: arranging a first foodstuff within the cavity of a first bowl portion of a first container; removably-securing a utensil to an inner surface of a side wall that forms the cavity of the first bowl portion of the first container; and sealing the first foodstuff and the utensil within the cavity of the first bowl portion of the first container. The second sealed container assembly is prepared by: arranging a second foodstuff within a cavity of a second bowl portion of a second container; removably-securing the first sealed container assembly within the cavity of the second bowl portion of the second container; and sealing the second foodstuff and the first sealed container assembly within the cavity of the second bowl portion of the second container.

Implementations of the disclosure may include one or more of the following optional features. In some implementations, the removably-securing the utensil to the inner surface of the side wall that forms the cavity of the first bowl portion of the first container step includes: snap-fitting the utensil to the inner surface of the side wall that forms the cavity of the first bowl portion of the first container.

In some examples, the sealing the first foodstuff and the utensil within the cavity of the first bowl portion of the first container step includes: securing a first seal secured over the cavity of the first bowl portion of the first container.

In some instances, the removably-securing the first sealed container assembly within the cavity of the second bowl portion of the second container includes: arranging opposing lip surface portions extending from the side wall of the first bowl portion of the first container upon opposing ledge surfaces formed by the inner surface of the side wall of the second bowl portion of the second container.

In some implementations, the sealing the second foodstuff and the first sealed container assembly within the cavity of the second bowl portion of the second container step includes: securing a second seal over the cavity of the second bowl portion of the second container.

In some examples, the method further including the step of preparing a packaged sealed container assembly by: surrounding the second sealed container assembly with a packaging jacket; securing a first lip portion of the second container within a first opening formed by the packaging jacket; and securing a second lip portion of the second container within a second opening formed by the packaging jacket.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 15 is a cross-section view of the second container according to line 15-15 of FIG. 12 or FIG. 13.

Like reference symbols in the various drawings indicate like elements.

DETAILED DESCRIPTION

Figure 1:
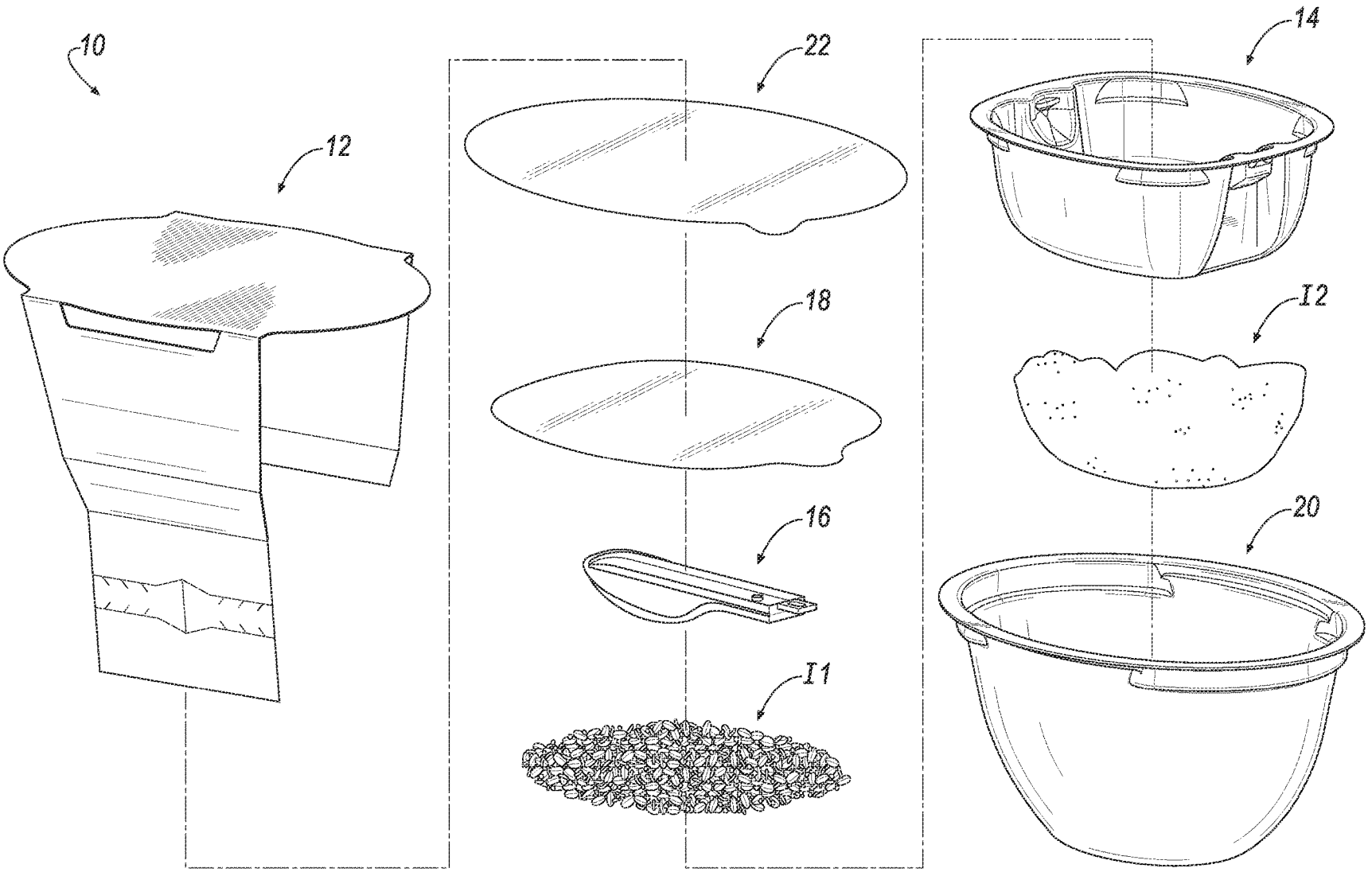
FIG. 1 is an exploded view of a plurality of components defining an exemplary packaging assembly.

Referring to FIG. 1, a plurality of components are shown generally at 12-22. The plurality of components 12-22 may include, for example: an optional packaging jacket 12 (see, e.g., FIGS. 22-23); a first container 14 (see, e.g., FIGS. 2-5); a utensil 16 (see, e.g., FIGS. 6-8); a first seal 18 (see, e.g., FIGS. 9-11); a second container 20 (see, e.g., FIGS. 12-15); and a second seal 22 (see, e.g., FIGS. 16-21). As will be described in greater detail in the following disclosure, the plurality of components 12-22 are sized for arrangement in a plurality of configurations for performing several functions including, but not limited to: segregating ingredients and packaging a meal preparation kit (see, e.g., FIG. 21 or 31M); preparing a meal (see, e.g., FIGS. 31S-31U); and consuming a meal (see, e.g., FIG. 31V).

With reference to FIGS. 24-30, in a first optional configuration, the plurality of components 12-22 are arranged in an assembly 10. The assembly 10 may be referred to as a packaging assembly 10. The packaging assembly 10 is sized for arrangement or display on a merchandising shelf. In addition to the plurality of components 12-22, the packaging assembly 10 may optionally include a consumable. The consumable may include at least one ingredient (see, e.g., I1, I2 in FIG. 1). The at least one ingredient I1, I2 may be a component of a meal (see, e.g., M in FIGS. 31S-31U). Because the packaging assembly 20 includes or contains foodstuff (i.e., at least one ingredient I1, I2), the plurality of components 14-22 that may come into contact with the included or contained foodstuff is made from a food-grade material or food-grade plastic. Accordingly, food grade plastics may be molded, shaped or configured in a molding machine, 3D printer or the like.

Figure 19:
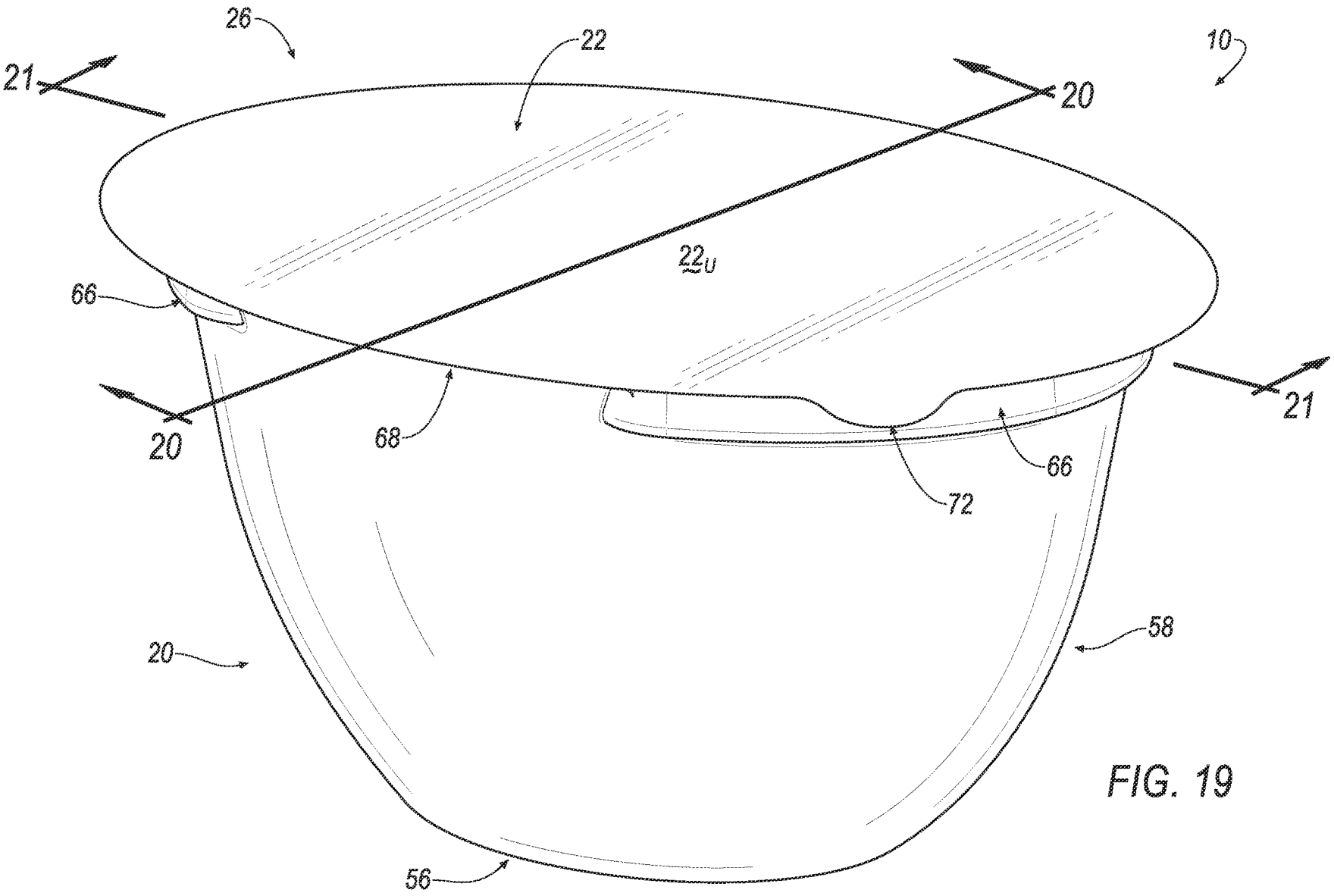
FIG. 19 is an assembled perspective view of the subassembly of 16.
Figure 20:
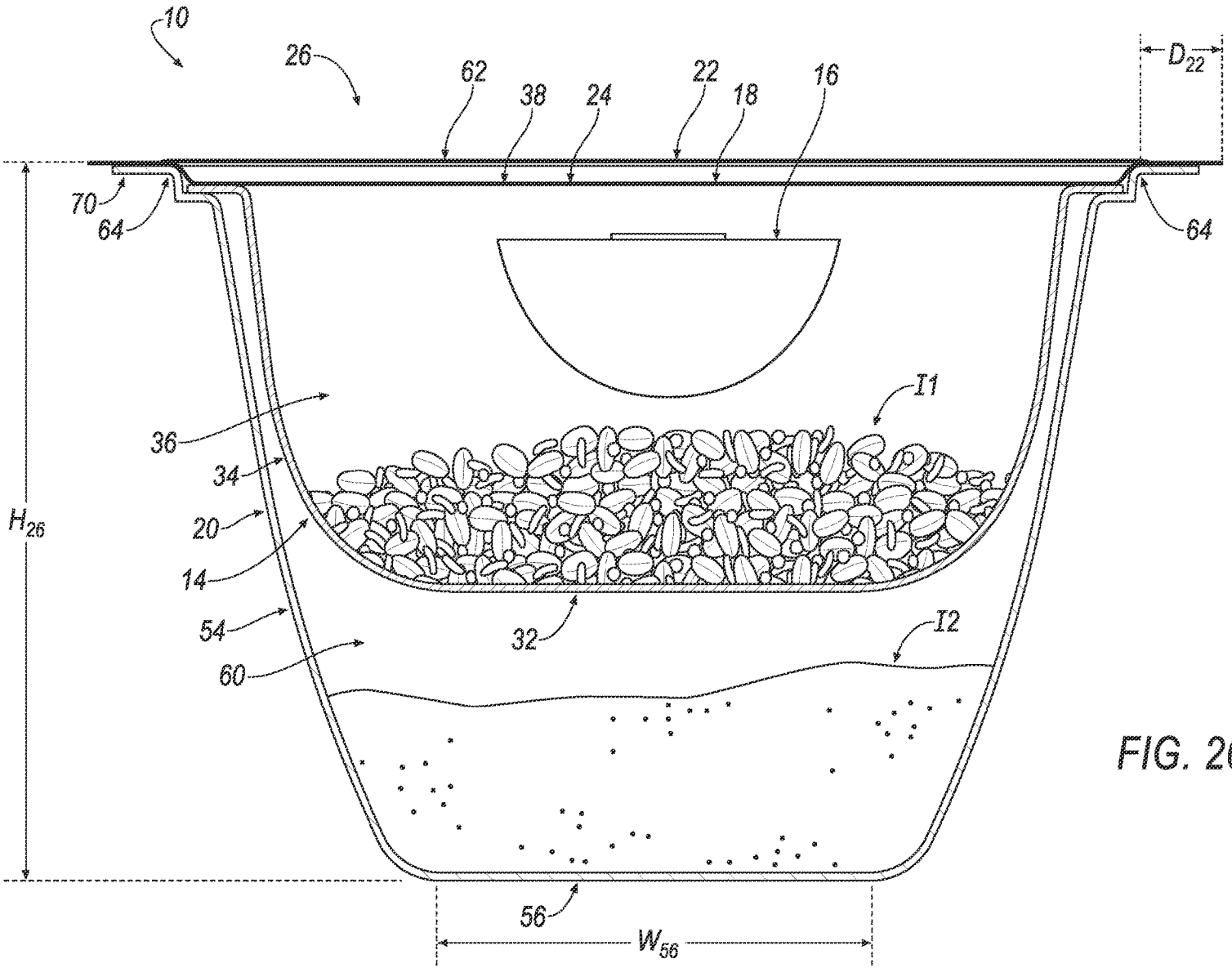
FIG. 20 is a cross-sectional view of the subassembly according to line 20-20 of FIG. 19.
Figure 21:
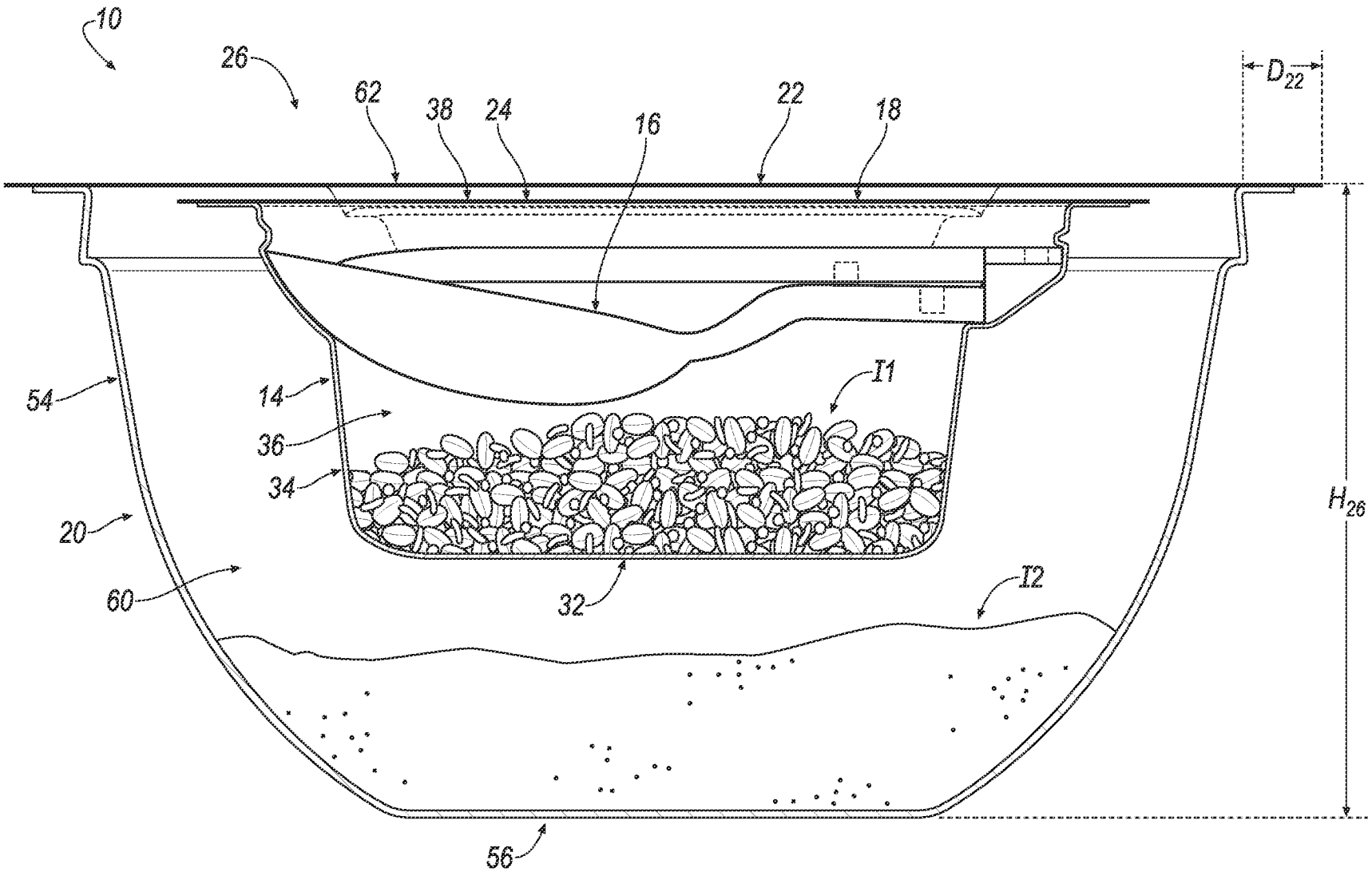
FIG. 21 is a cross-sectional view of the subassembly according to line 21-21 of FIG. 19.

With reference to FIGS. 19-21, in a second optional configuration, some components 14-22 of the plurality of components 14-22 may function not only as a packaging assembly 10 but also as a meal preparation kit. The packaging assembly 10 or the meal preparation kit may also optionally include at least one consumable. The at least one consumable includes at least one ingredient (see, e.g., I1, I2 in FIG. 1). The at least one ingredient I1, I2 may be a component of a meal (see, e.g., M in FIGS. 31S-31U). Furthermore, as seen in FIG. 31V, after the meal M has been prepared, some components (see, e.g., the utensil 16 and the second container 20) of the packaging assembly 10 or meal preparation kit may also be utilized as eating utensils for consuming the meal M.

Referring to FIG. 1, the plurality of components 12-22 may define a plurality of subassemblies 22-26. The plurality of subassemblies 22-26 may include, for example: a first subassembly 24 (see, e.g., FIGS. 9-11); a second subassembly 26 (see, e.g., FIGS. 19-21) and an optional third subassembly 28 (see, e.g., FIGS. 24-30).

Figure 9:
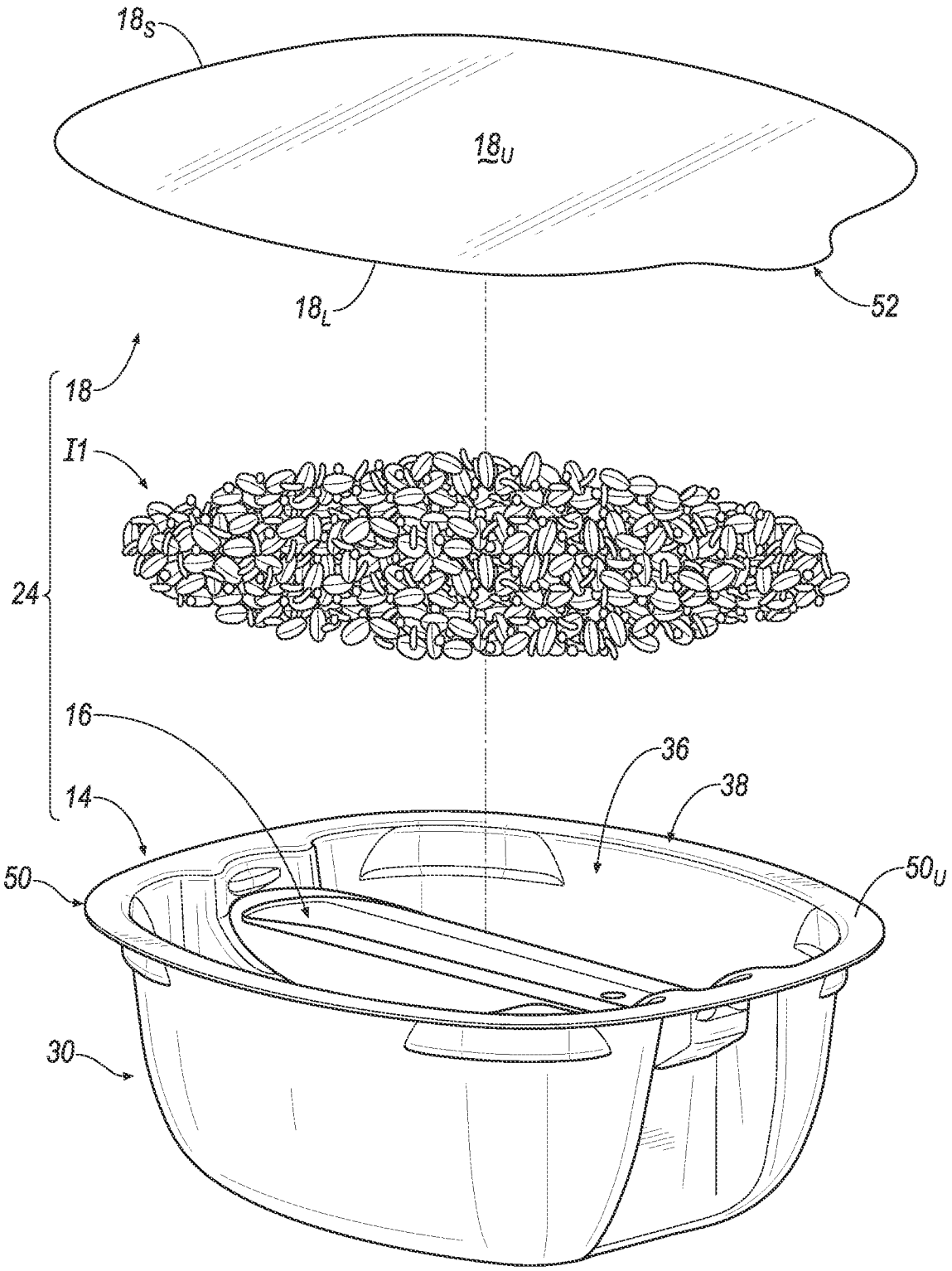
FIG. 9 is an exploded perspective view of a subassembly of the packaging assembly of FIG. 1 including the subassembly of FIG. 6, a first ingredient and a first seal.
Figure 10:
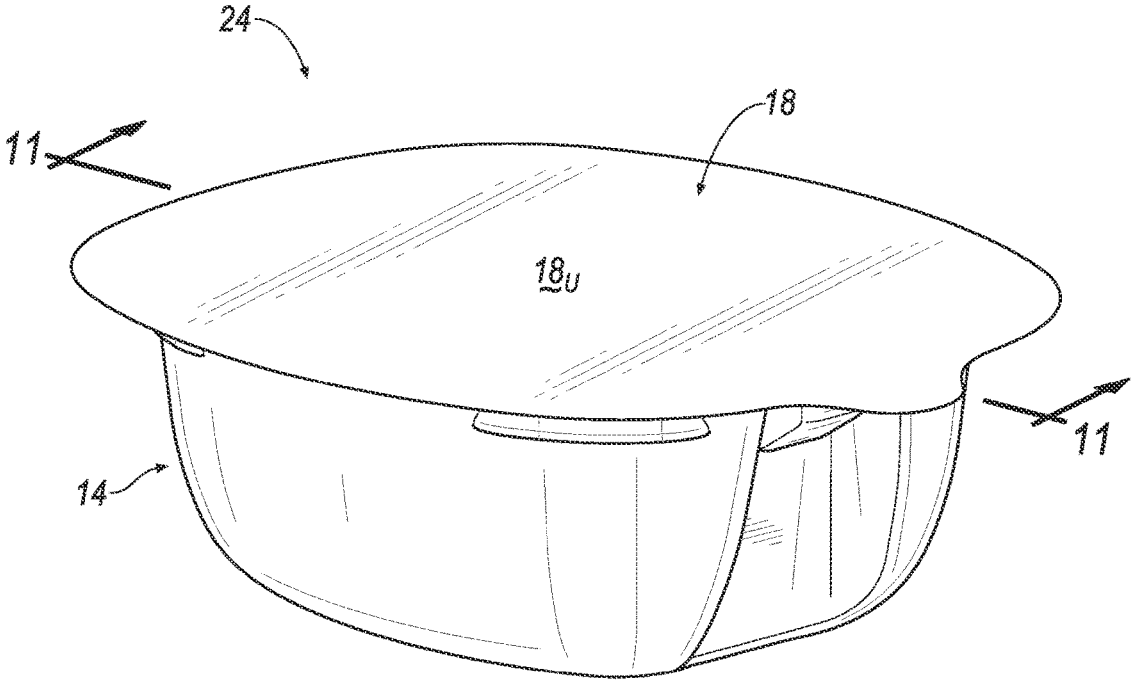
FIG. 10 is an assembled perspective view of the subassembly of FIG. 9.
Figure 11:
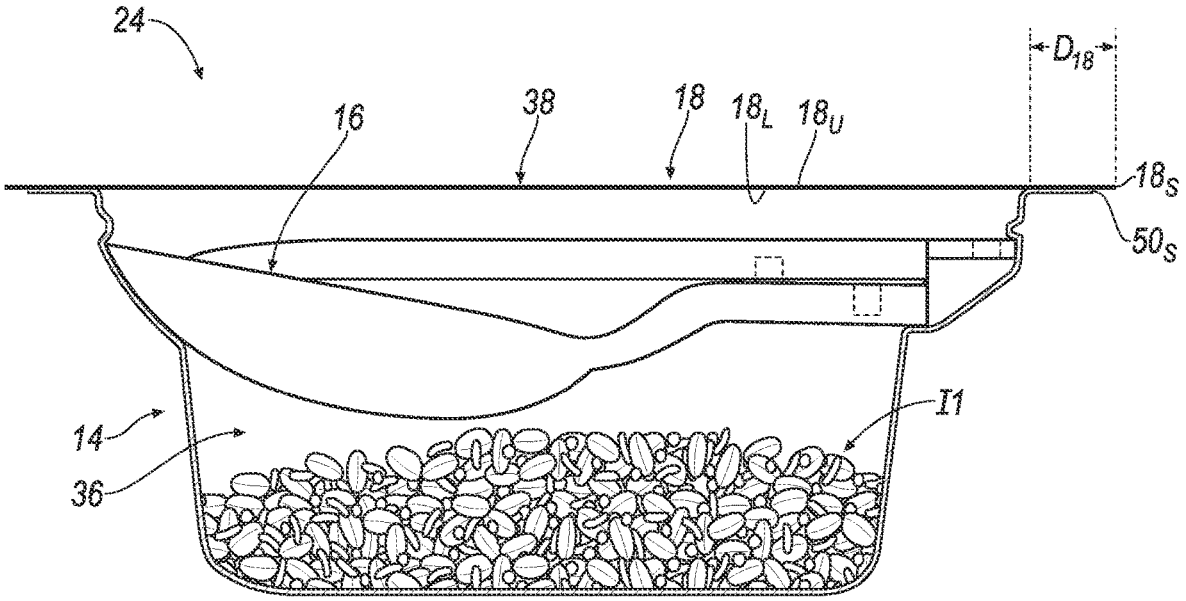
FIG. 11 is a cross-sectional view of the subassembly according to line 11-11 of FIG. 10.

Referring to FIGS. 9-11, the first subassembly 24 may be defined by the first container 14, the utensil 16 and the first seal 18. Optionally, the first subassembly 24 may also include the first ingredient I1.

Referring to FIGS. 19-21, the second subassembly 26 may be defined by the second container 20, the second seal 22 and the first subassembly 24. Optionally, the second subassembly 26 may also include the second ingredient I2.

Referring to FIGS. 24-30, the optional third subassembly 28 may be defined by the packaging jacket 12, the first subassembly 24 and the second subassembly 26.

Figure 2:
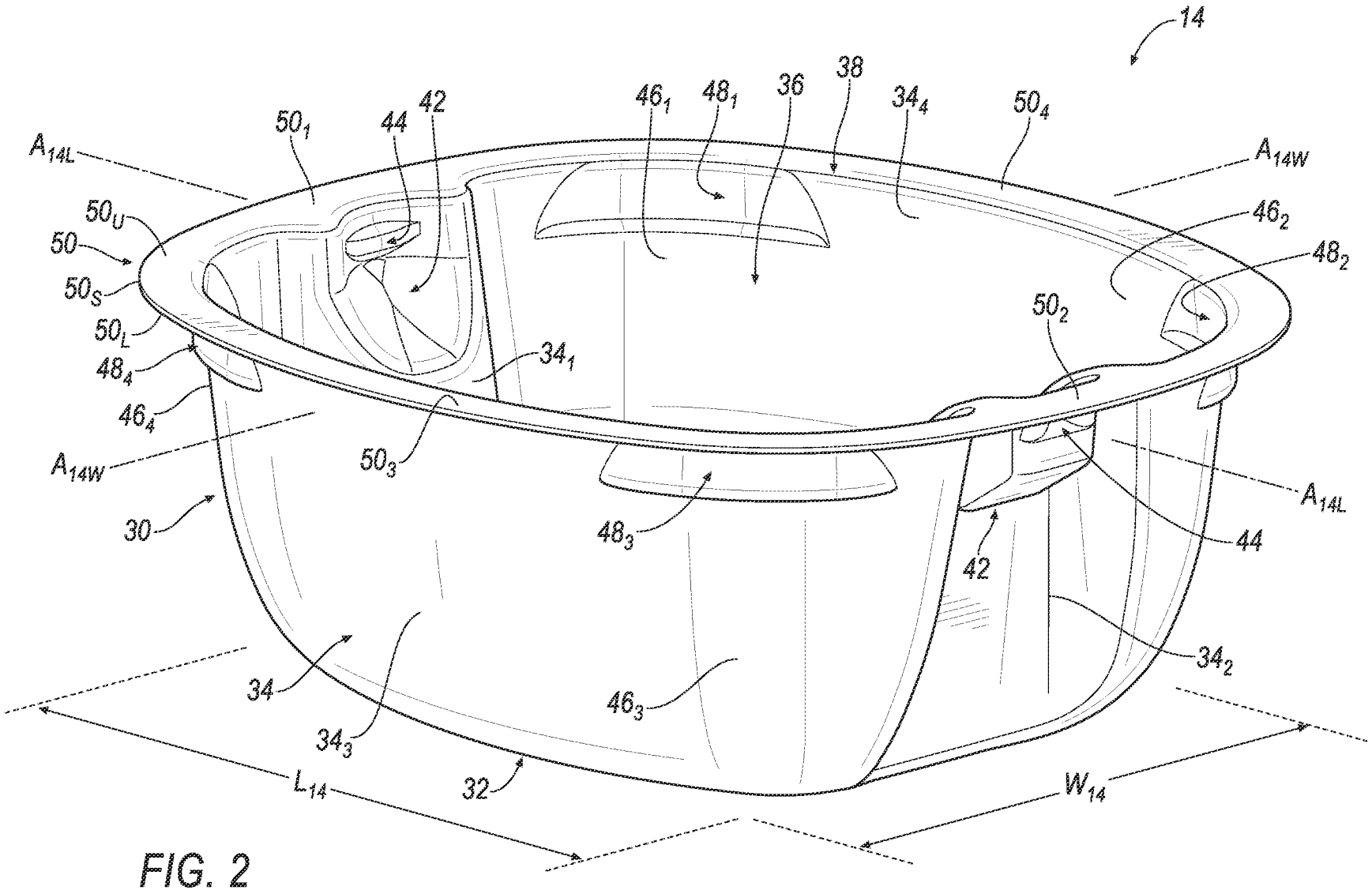
FIG. 2 is a perspective view of a first container of the packaging assembly of FIG. 1.
Figure 3:
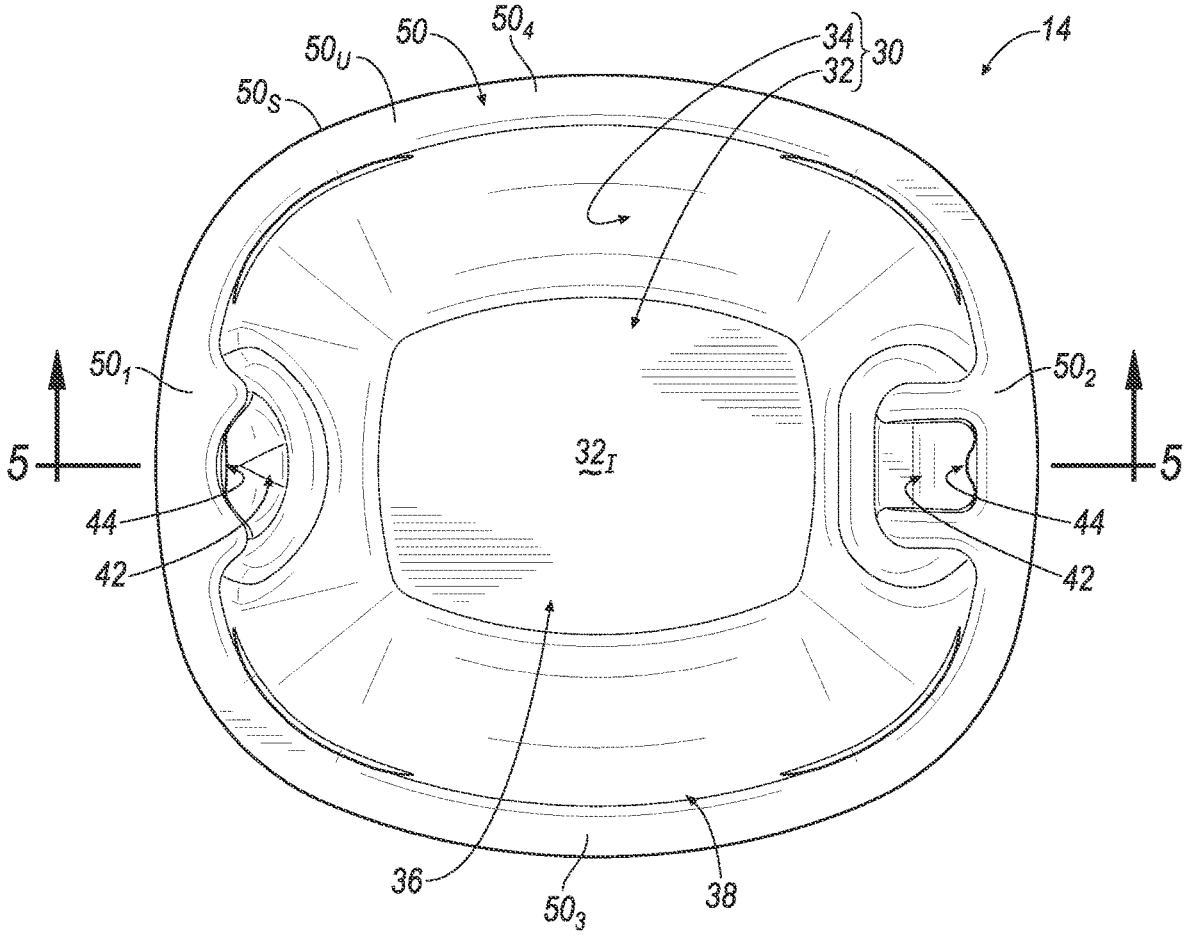
FIG. 3 is a top view of the first container of FIG. 2.

Turning to more of the specifics, the first or inner container of the packaging assembly 10 is shown generally at 14 in FIGS. 2-5B. Referring to FIG. 2, a first axis $A_{14L}$-$A_{14L}$ is shown extending across a length $L_{14}$ of the first container 14 and a second axis $A_{14W}$-$A_{14W}$ is shown extending across a width $W_{14}$ of the first container 14. The length $L_{14}$ of the first container 14 is greater than the width $W_{14}$ of the first container 14; accordingly, from a top view as seen in FIG. 3, the first container 14 may be defined by a substantially rectangular shape.

Figure 4:
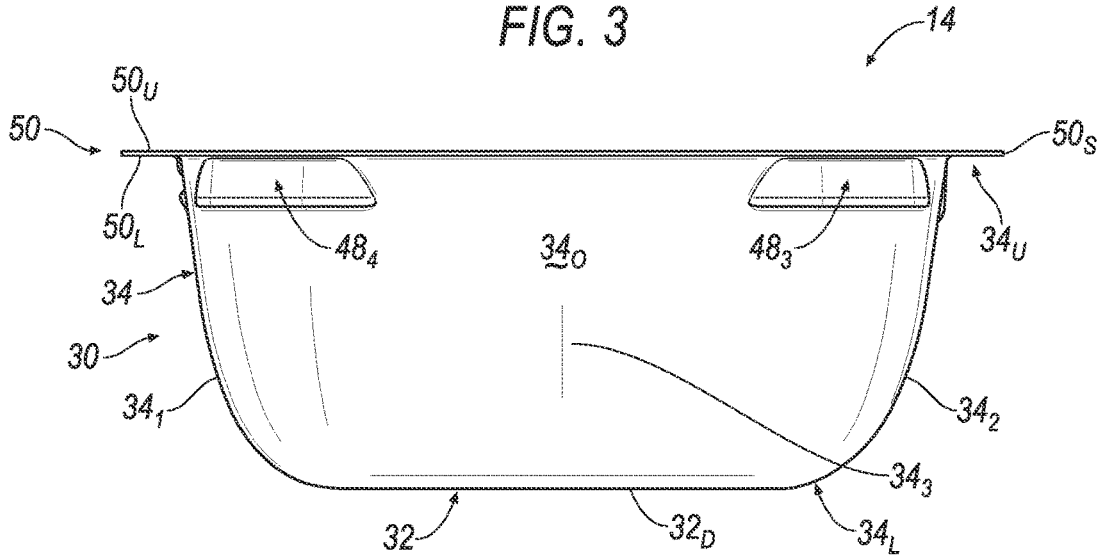
FIG. 4 is a side view of the first container of FIG. 2.
Figure 5:
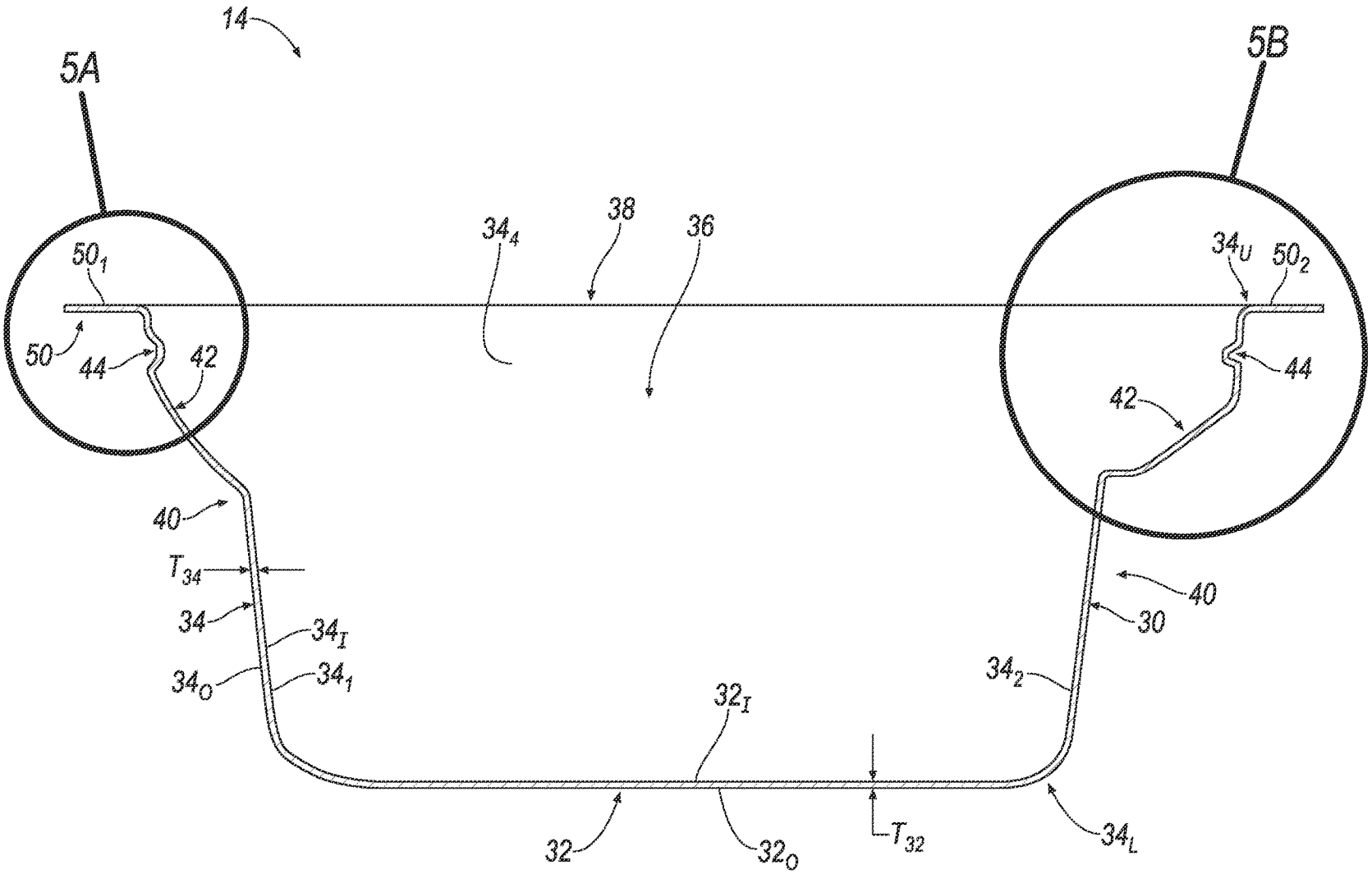
FIG. 5 is a cross-section view of the first container according to line 5-5 of FIG. 2 or FIG. 3.

With continued reference to FIGS. 2 and 4-5, the first container 14 includes a bowl portion 30 having a bottom wall 32 (see, e.g., FIG. 3) and a side wall 34 extending from the bottom wall 32. Referring to FIG. 4, the side wall 34 is defined by a lower end $\mathbf{34}_L$ and an upper end $\mathbf{34}_U$. The lower end $\mathbf{34}_L$ of the side wall 34 extends from the bottom wall 32.

Referring to FIG. 5, the bottom wall 32 is defined by an inner surface $\mathbf{32}_I$ and an outer surface $\mathbf{32}_O$. The bottom wall 32 is further defined by a thickness $T_{32}$ extending between the inner surface $\mathbf{32}_I$ of the bottom wall 32 and the outer surface $\mathbf{32}_O$ of the bottom wall 32. The side wall 34 is defined by an inner surface $\mathbf{34}_I$ and an outer surface $\mathbf{34}_O$. The side wall 34 is further defined by a thickness $T_{34}$ extending between the inner surface $\mathbf{34}_I$ of the side wall 34 and the outer surface $\mathbf{34}_O$ of the side wall 34.

The inner surface $\mathbf{32}_I$, $\mathbf{34}_I$ of the bottom wall 32 and the side wall 34 define a cavity 36 of the bowl portion 30. The upper end $\mathbf{34}_U$ of the side wall 34 defines an opening 38 of the bowl portion 30 that permits access to the cavity 36 of the bowl portion 30.

As seen in FIG. 2, the first axis $A_{14L}$-$A_{14L}$ traverses a first side wall portion $\mathbf{34}_1$ of the side wall 34 and a second side wall portion $\mathbf{34}_2$ of the side wall 34. The first side wall portion $\mathbf{34}_1$ is opposite the second side wall portion $\mathbf{34}_2$. Furthermore as seen in FIG. 2 the second axis $A_{14W}$-$A_{14W}$ traverses a third side wall portion $\mathbf{34}_3$ of the side wall 34 and a fourth side wall portion $\mathbf{34}_4$ of the side wall 34. The third side wall portion $\mathbf{34}_3$ is opposite the fourth side wall portion $\mathbf{34}_4$.

The thickness $T_{34}$ of the side wall 34 may be defined one or more embossed portions and one or more debossed portions. An emboss or embossed portion is generally defined by a portion of the thickness $T_{34}$ of the side wall 34 projecting away from a center of the first container 14 whereas a deboss or debossed portion is generally defined by a portion of the thickness $T_{34}$ of the side wall 34 projecting toward a center of the first container 14.

Figure 5A:
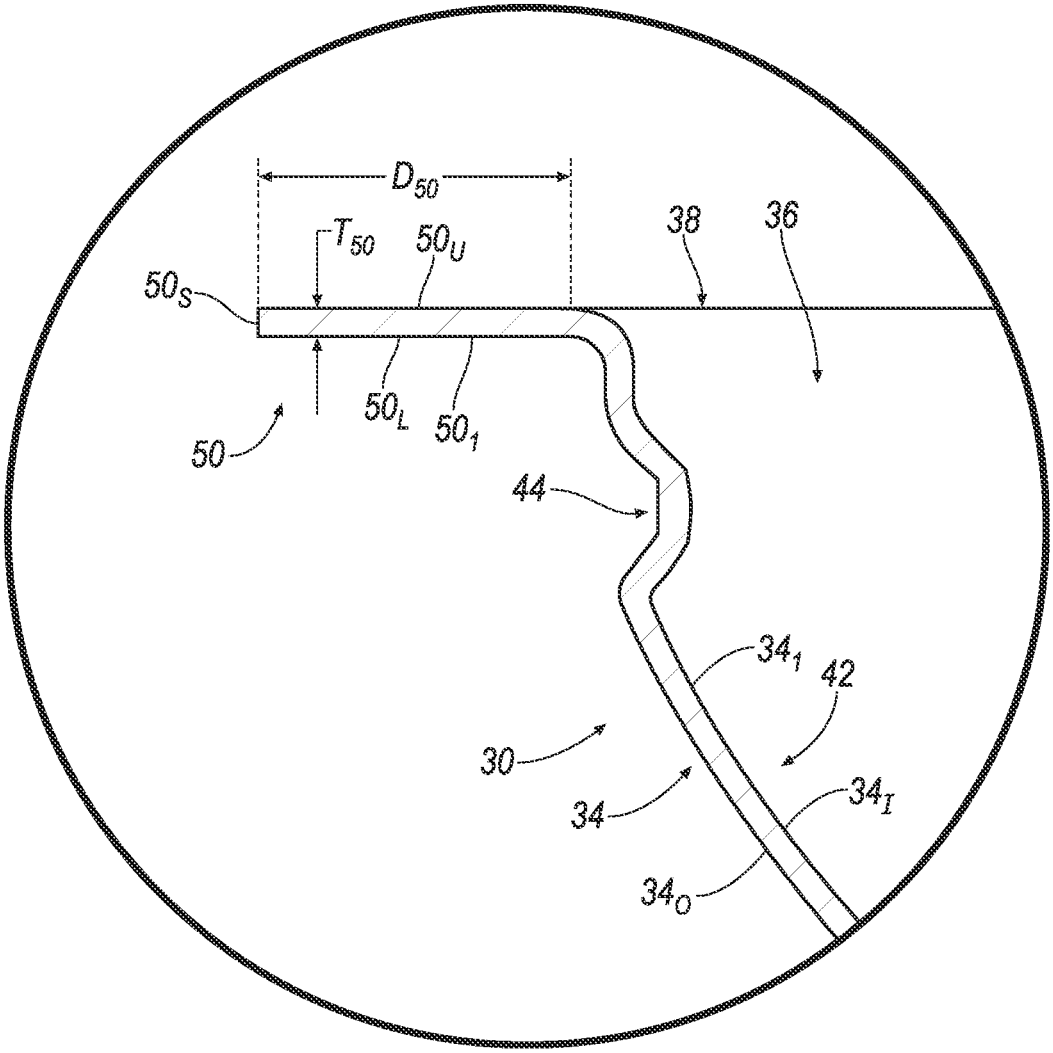
FIG. 5A is an enlarged view of the first container according to line 5A of FIG. 5.
Figure 5B:
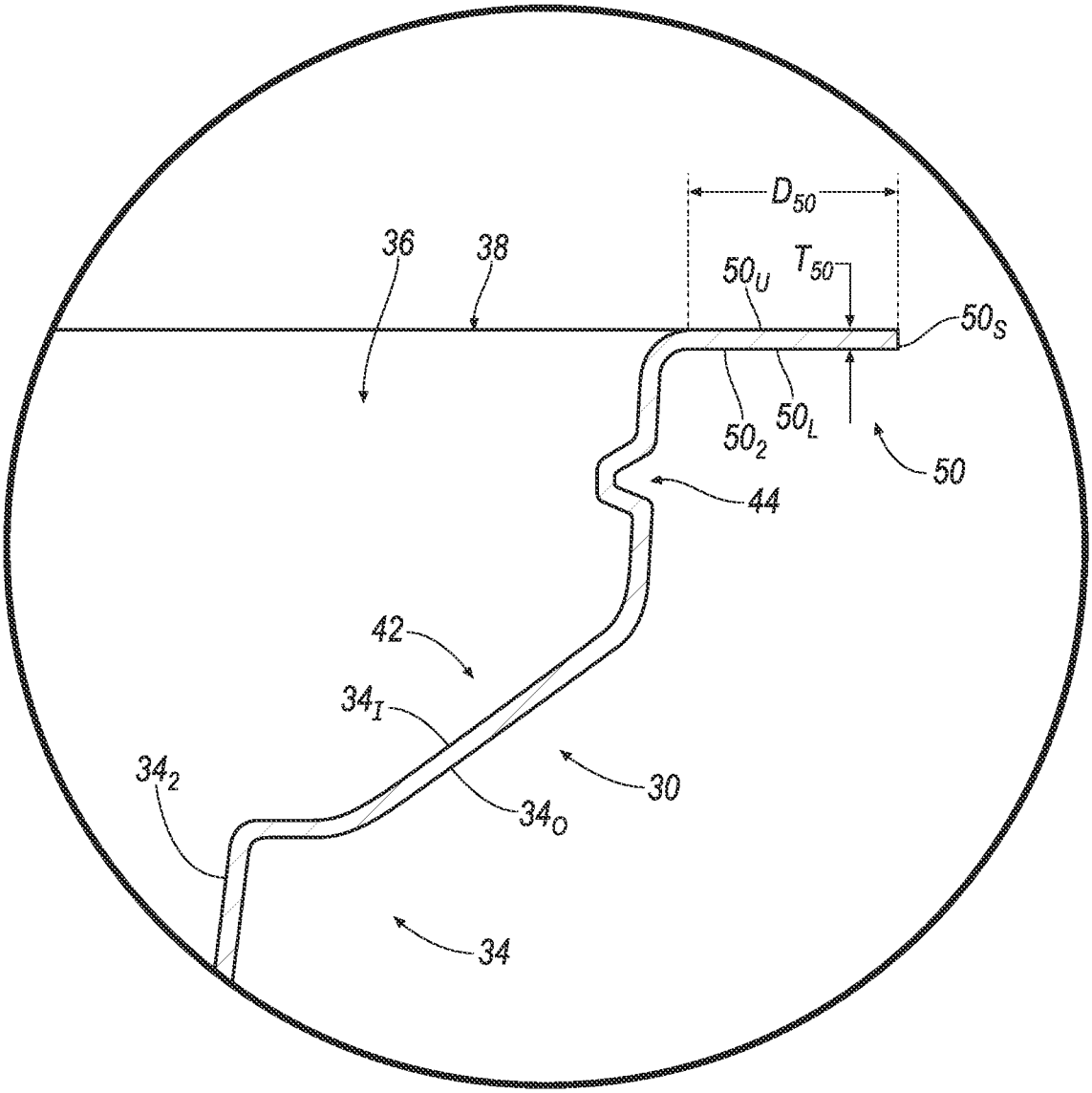
FIG. 5B is an enlarged view of the first container according to line 5B of FIG. 5.

With reference to FIGS. 5 and 5A-5B, the first side wall portion $\mathbf{34}_1$ and the second side wall portion $\mathbf{34}_2$ are each defined by a deboss 40 extending between the lower end $\mathbf{34}_L$ of the side wall 34 and the upper end $\mathbf{34}_U$ of the side wall 34. Each deboss 40 may be further defined by an embossed portion 42 and a debossed portion 44. As will be described in the following disclosure at FIGS. 6-8B, the embossed portion 42 of each of the first side wall portion $\mathbf{34}_1$ and the second side wall portion $\mathbf{34}_2$ forms a ledge surface for supporting an end of the utensil 16 whereas the debossed portion 44 of each of the first side wall portion $\mathbf{34}_1$ and the second side wall portion $\mathbf{34}_2$ forms a snap-fit retainer for snap-fit retaining the end of the utensil 16. The term "snap-fit" may mean that the side wall 34 is formed from a flexible material that permits the side wall 34 to flex outwardly and then flexing inwardly when a portion (e.g., the debossed portion 44) interferes with movement of an object (e.g., the utensil 16) thereby creating a "snap" sound when the object moves past or clears the interfering portion.

With reference to FIG. 2, the side wall portions $\mathbf{34}_1$-$\mathbf{34}_4$ of the side wall 34 are connected by curved corner portions $\mathbf{46}_1$-$\mathbf{46}_4$. In an example, each curved corner portion $\mathbf{46}_1$, $\mathbf{46}_2$, $\mathbf{46}_3$, $\mathbf{46}_4$ of the curved corner portions $\mathbf{46}_1$-$\mathbf{46}_4$ may define an embossed portion $\mathbf{48}_1$, $\mathbf{48}_2$, $\mathbf{48}_3$, $\mathbf{48}_4$. The embossed portions $\mathbf{48}_1$-$\mathbf{48}_4$ of the curved corner portions $\mathbf{46}_1$-$\mathbf{46}_4$ may be co-planar and may be located near the upper end $\mathbf{34}_U$ of the side wall 34. Functionally, each embossed portions $\mathbf{48}_1$, $\mathbf{48}_2$, $\mathbf{48}_3$, $\mathbf{48}_4$ of each curved corner portion $\mathbf{46}_1$, $\mathbf{46}_2$, $\mathbf{46}_3$, $\mathbf{46}_4$ provide a stiffening rib for the side wall 34 at each curved corner portion $\mathbf{46}_1$, $\mathbf{46}_2$, $\mathbf{46}_3$, $\mathbf{46}_4$.

Referring to FIGS. 2-5B, the first container 14 also includes a lip portion 50 having an upper surface $\mathbf{50}_U$, a lower surface $\mathbf{50}_L$ and a side surface $\mathbf{50}_S$ connecting the upper surface $\mathbf{50}_U$ to the lower surface $\mathbf{50}_L$. The lip portion 50 is further defined by a thickness $T_{50}$ (see, e.g., FIGS. 5A-5B) extending between the upper surface $\mathbf{50}_U$ of the lower surface $\mathbf{50}_L$. Referring to FIGS. 5A-5B, the lip portion 50 extends away from the outer surface $\mathbf{34}_O$ of the side wall 34. The lip portion 50 extends at a distance $D_{50}$ between the outer surface $\mathbf{34}_O$ of the side wall 34 and the side surface $\mathbf{50}_S$ of the lip portion 50.

As seen in FIG. 3, the first axis $A_{14L}$-$A_{14L}$ traverses a first lip segment $\mathbf{50}_1$ of the lip portion 50 and a second lip segment $\mathbf{50}_2$ of the lip portion 50. The first lip segment $\mathbf{50}_1$ is opposite the second lip segment $\mathbf{50}_2$. Furthermore as seen in FIG. 3, the second axis $A_{14W}$-$A_{14W}$ traverses a third lip segment $\mathbf{50}_3$ of the lip portion 50 and a fourth lip segment $\mathbf{50}_4$ of the lip portion 50. The third lip segment $\mathbf{50}_3$ is opposite the fourth lip segment $\mathbf{50}_4$.

Figure 6:
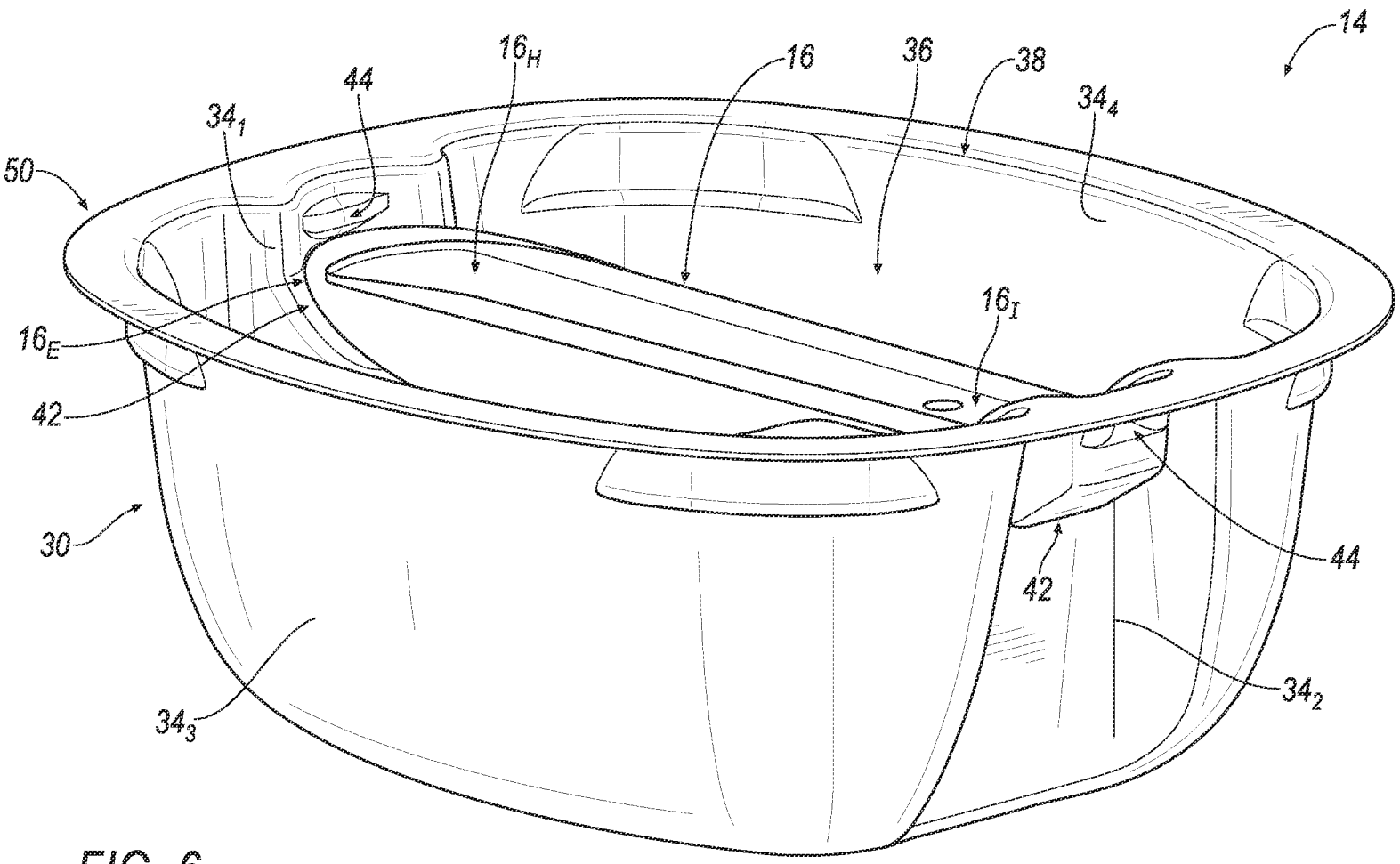
FIG. 6 is a perspective view of a subassembly of the packaging assembly of FIG. 1 including the first container of FIG. 2 and a utensil removably-attached thereto in a stowed orientation.
Figure 7:
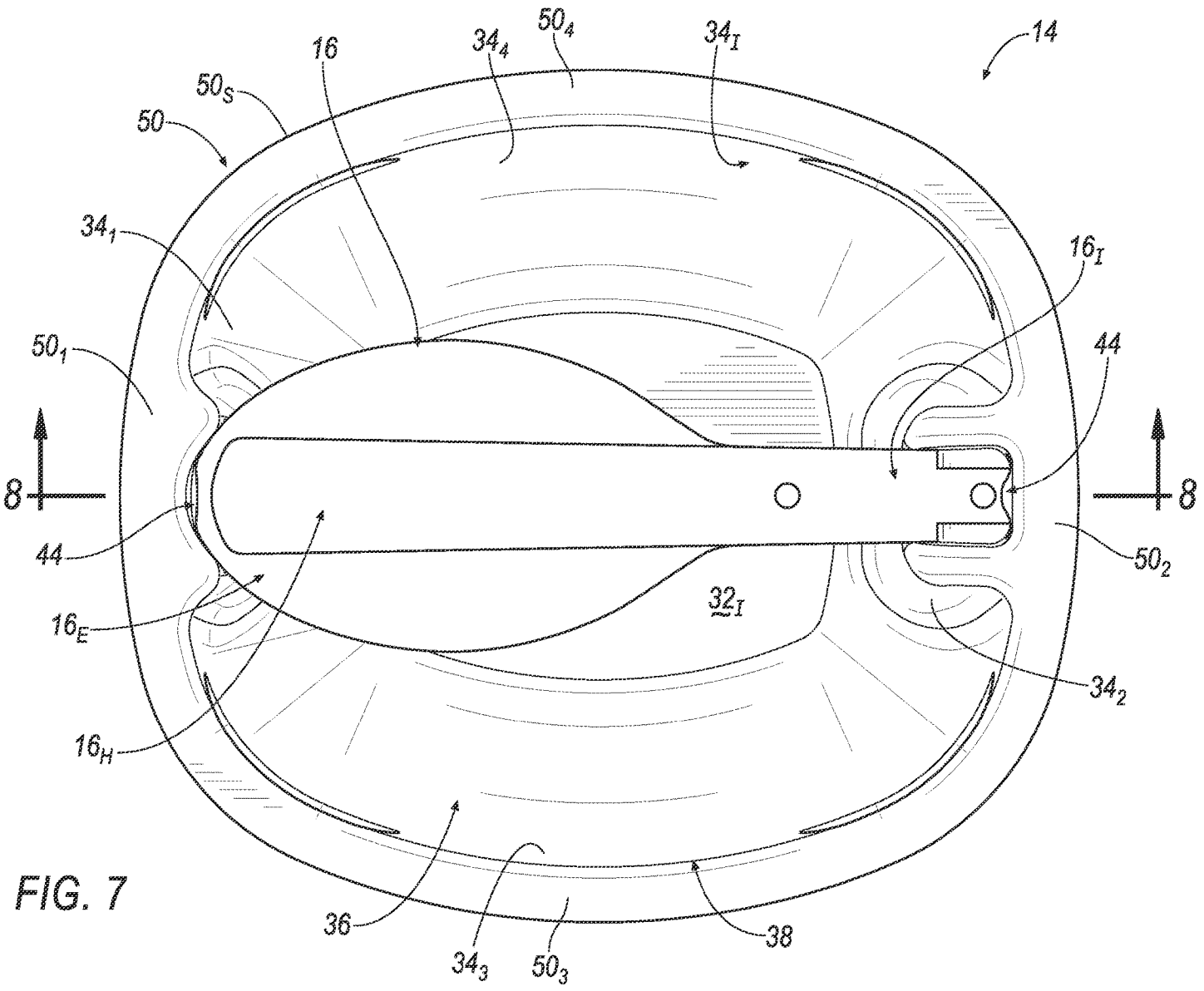
FIG. 7 is a top view of the subassembly of FIG. 6.
Figure 8:
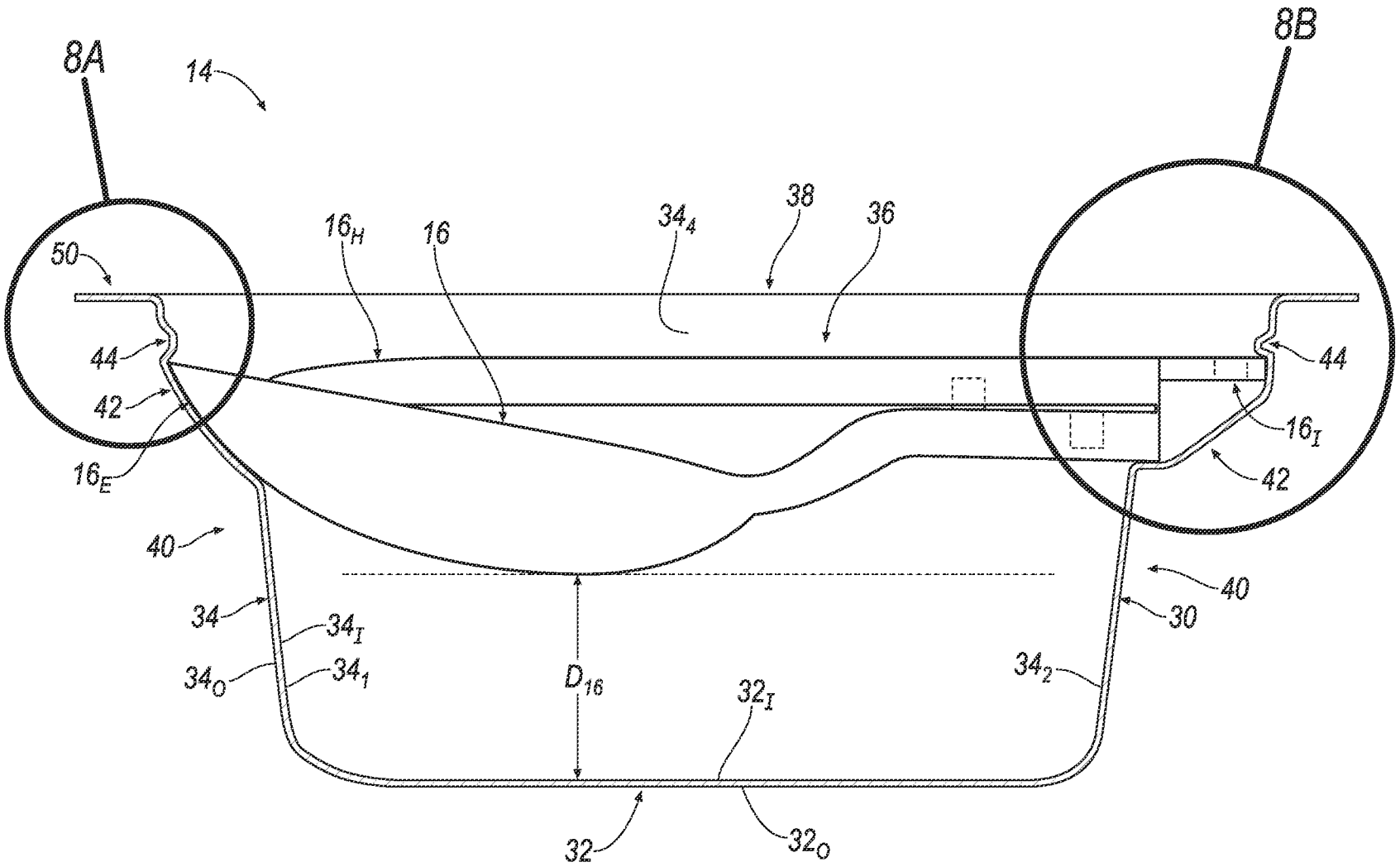
FIG. 8 is a cross-sectional view of the subassembly according to line 8-8 of FIG. 7.

Referring to FIGS. 6-8, the utensil 16 is shown in a stowed or folded configuration. In an example, the utensil 16 is defined by an end portion $\mathbf{16}_E$, a handle portion $\mathbf{16}_H$, and an intermediate hinge portion $\mathbf{16}_I$. When arranged in the stowed or folded configuration, the handle portion $\mathbf{16}_H$ is disposed over the end portion $\mathbf{16}_E$ such that the intermediate hinge portion $\mathbf{16}_I$ is arranged opposite both of the handle portion $\mathbf{16}_H$ and the end portion $\mathbf{16}_E$. Although the utensil 16 is shown arranged in a stowed or folded orientation, the utensil 16 may be formed in a non-folded or non-deployed manner.

The utensil 16 may be, for example, a spoon, fork, spork, knife or the like. Accordingly, the end portion $\mathbf{16}_E$ may a food-contacting portion and the handle portion $\mathbf{16}_H$ may be grasped by a user.

Figure 8A:
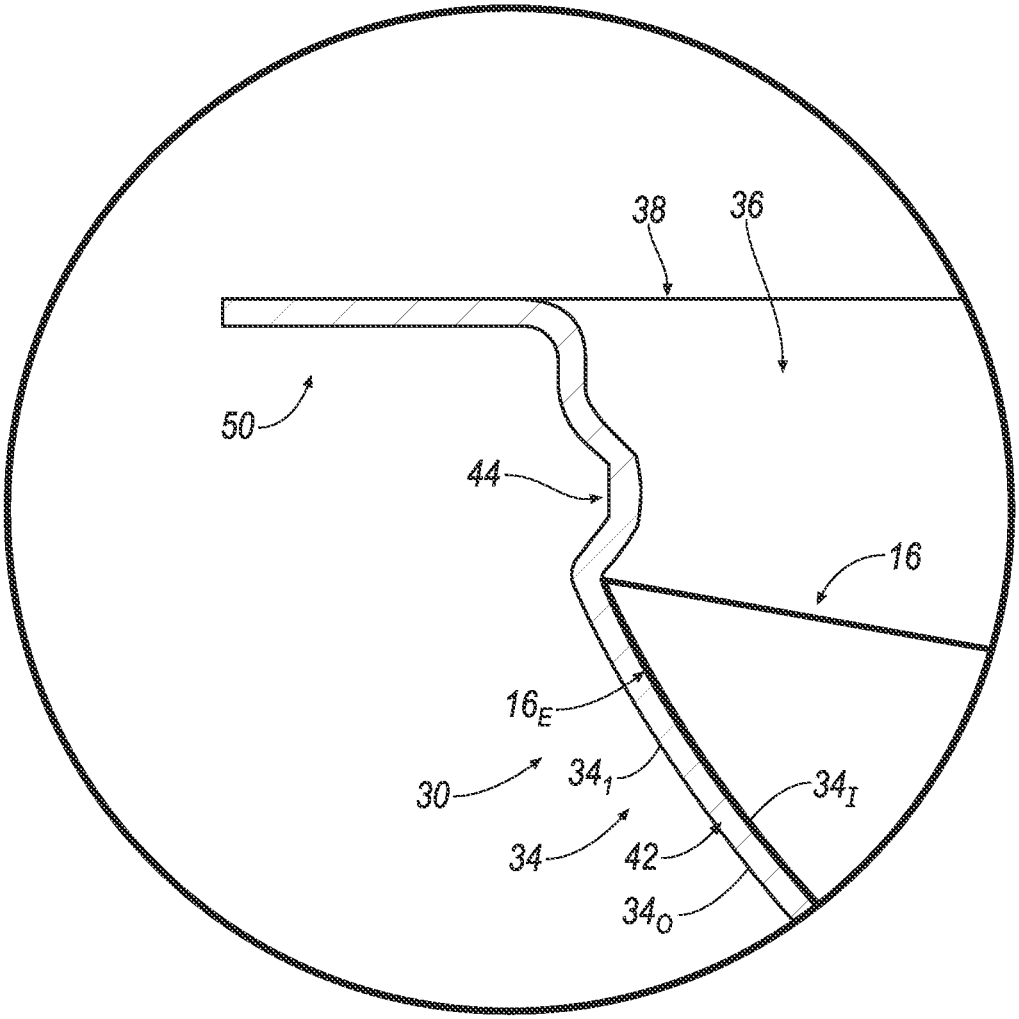
FIG. 8A is an enlarged view of the subassembly according to line 8A of FIG. 8.
Figure 8B:
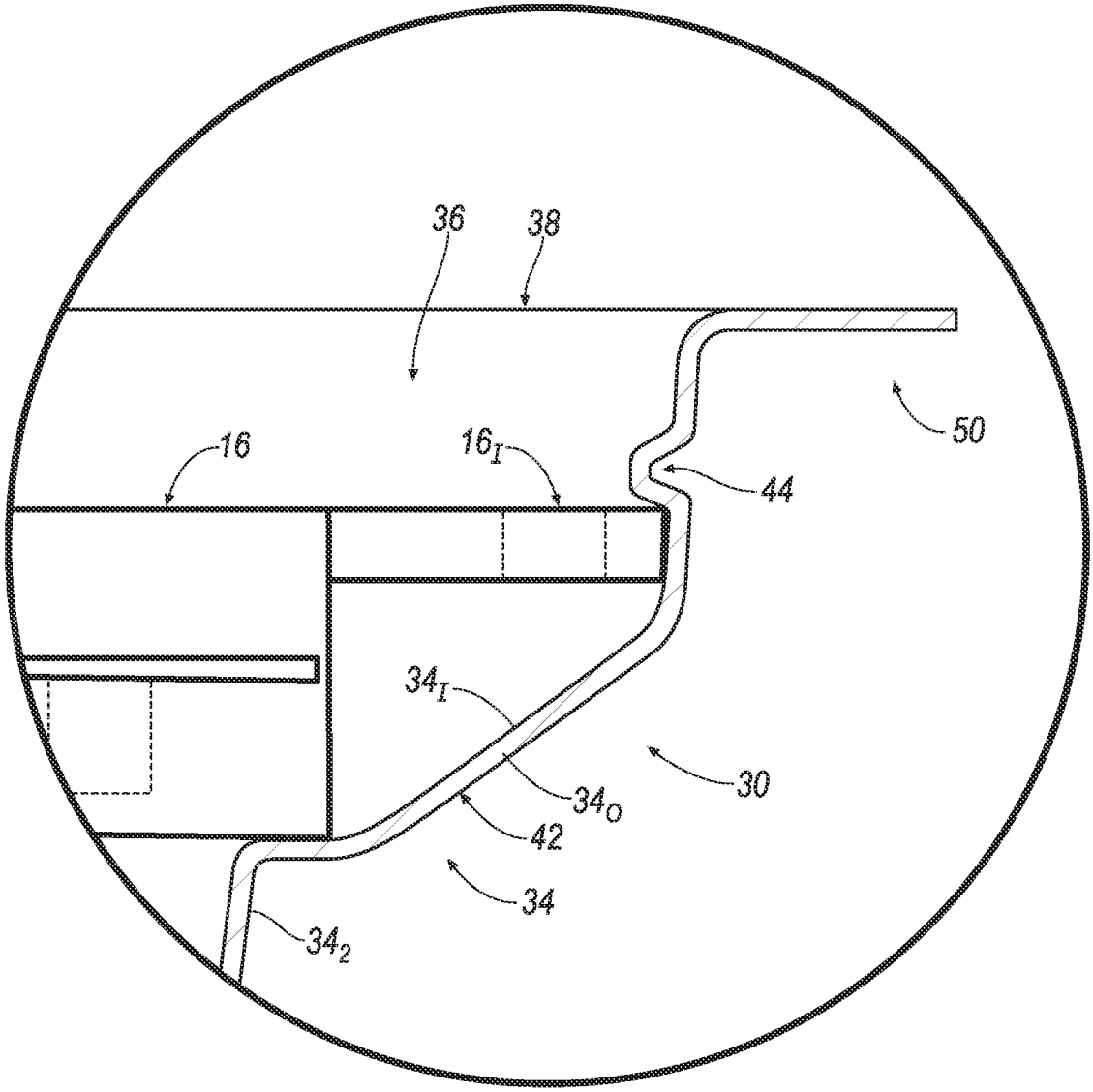
FIG. 8B is an enlarged view of the subassembly according to line 8B of FIG. 8.

As seen in FIG. 8A, the embossed portion 42 of the first side wall portion $\mathbf{34}_1$ forms a ledge surface that is sized for supporting the end portion $\mathbf{16}_E$ of the utensil 16 whereas the debossed portion 44 of the first side wall portion $\mathbf{34}_1$ forms a snap-fit retainer that is sized for snap-fit retaining the end portion $\mathbf{16}_E$ of the utensil 16. Furthermore, as seen in FIG. 8B, the embossed portion 42 of the second side wall portion $\mathbf{34}_2$ forms a ledge surface that is sized for supporting the intermediate hinge portion $\mathbf{16}_1$ of the utensil 16 whereas the debossed portion 44 of the second side wall portion $\mathbf{34}_2$ forms a snap-fit retainer that is sized for snap-fit retaining the intermediate hinge portion $\mathbf{16}_1$ of the utensil 16. Although the embossed portion 42 and the debossed portion 44 of the second side wall portion $\mathbf{34}_2$ are sized for supporting and snap-fit-retaining the intermediate hinge portion $\mathbf{16}_1$ of the utensil 16, the embossed portion 42 and the debossed portion 44 of the second side wall portion $\mathbf{34}_2$ may be sized for supporting and snap-fit-retaining the handle portion $\mathbf{16}_H$ of the utensil 16 if, for example, the utensil 16 is not designed to fold about an intermediate hinge portion $\mathbf{16}_1$.

When the utensil 16 is supported by and/or snap-fit retained to the bowl portion 30 of the first container 14 by way of the embossed portion 42 and debossed portion 44 of each of the first side wall portion $\mathbf{34}_1$ of the side wall 34 and the second side wall portion $\mathbf{34}_2$ of the side wall 34, the utensil 16 is removably-secured to the inner surface $\mathbf{34}_I$ of the side wall 34 of the bowl portion 30 of the first container 14. Accordingly, the utensil 16 is not supported by, contacts or engages the upper surface $\mathbf{50}_U$ of the lip portion 50. Furthermore, when the utensil 16 is supported by and/or snap-fit retained to the bowl portion 30 of the first container 14 by way of the embossed portion 42 and debossed portion 44 of each of the first side wall portion $\mathbf{34}_1$ of the side wall 34 and the second side wall portion $\mathbf{34}_2$ of the side wall 34 as described above, the utensil 16 is arranged within the cavity 36 of the bowl portion 30 of the first container 14. Yet even further, when the utensil 16 is supported by and/or snap-fit retained to the bowl portion 30 of the first container 14 by way of the embossed portion 42 and debossed portion 44 of each of the first side wall portion $\mathbf{34}_1$ of the side wall 34 and the second side wall portion $\mathbf{34}_2$ of the side wall 34 as described above, the utensil 16 is arranged within the cavity 36 of the bowl portion 30 of the first container 14 and positioned near the opening 38 of the bowl portion 30. Further, when the utensil 16 is supported by and/or snap-fit retained to the bowl portion 30 of the first container 14 by way of the embossed portion 42 and debossed portion 44 of each of the first side wall portion $\mathbf{34}_1$ of the side wall 34 and the second side wall portion $\mathbf{34}_2$ of the side wall 34 as described above, the utensil 16 is arranged within the cavity 36 of the bowl portion 30 of the first container 14 and positioned at a spaced-apart distance $D_{16}$ (see, e.g., FIG. 8) away from the inner surface $\mathbf{32}_I$ of the bottom wall 32 of the bowl portion 30.

Optionally, as seen in FIGS. 9-11, a first ingredient I1 may be disposed within the cavity 36 of the bowl portion 30 of the first container 14. When the utensil 16 is supported by and/or snap-fit retained to the bowl portion 30 of the first container 14 such that the utensil 16 is arranged within the cavity 36 of the bowl portion 30 the first container 14, the first ingredient I1 may partially fill or entirely fill a remainder volume of the cavity 36 that is not occupied by the utensil 16.

As seen in FIG. 11, the first seal 18 is defined by an upper surface $\mathbf{18}_U$, a lower surface $\mathbf{18}_L$ and a side surface $\mathbf{18}_S$ connecting the upper surface $\mathbf{18}_U$ to the lower surface $\mathbf{18}_L$. The first seal 18 corresponds to the shape of and extends across both of the opening 38 of the bowl portion 30 of the first container 14 and the upper surface $\mathbf{50}_U$ of the lip portion 50 of the first container 14. Furthermore, as seen in FIG. 9, the first seal 18 may also define a pull tab 52 that extends beyond the side surface $\mathbf{50}_S$ of the lip portion 50 of the first container 14 in order to permit a user to pinch and grasp both of the upper surface $\mathbf{18}_U$ to the lower surface $\mathbf{18}_L$ of the first seal 18 for removing the first seal 18 from the first container 14.

The lower surface $\mathbf{18}_L$ of the first seal 18 defines a perimeter portion, an opening sealing portion and a pull tab portion. The perimeter portion of the lower surface $\mathbf{18}_L$ of the first seal 18 extends from the side surface $\mathbf{18}_S$ of the first seal 18 at a distance $D_{18}$ (see, e.g., FIG. 11). The distance $D_{18}$ of the perimeter portion of the lower surface $\mathbf{18}_L$ of the first seal 18 is approximately equal to the distance $D_{50}$ of the lip potion 50 extending between outer surface $\mathbf{34}_O$ of the side wall 34 of the bowl portion 30 of the first container 14 and the side surface $\mathbf{50}_S$ of the lip portion 50 of the first container 14. In some instances, the side surface $\mathbf{18}_S$ of the first seal 18 may extend beyond the side surface $\mathbf{50}_S$ of the lip portion 50.

The perimeter portion of the lower surface $\mathbf{18}_L$ of the first seal 18 is removably-secured to the upper surface $\mathbf{50}_U$ of the lip portion 50 of the first container 14. Upon removably-securing the first seal 18 to the first container 14 with the utensil 16 removably-secured thereto and the first ingredient I1 optionally disposed within the first container 14, the first subassembly 24 may be said to be arranged in an assembled state.

The opening sealing portion of the lower surface $\mathbf{18}_L$ of the first seal 18 that is not removably-secured to the upper surface $\mathbf{50}_U$ of the lip portion 50 of the first container 14 and extends across the opening 38 of the bowl portion 30 of the first container 14 such that the opening sealing portion of the lower surface $\mathbf{18}_L$ of the first seal 18 seals the cavity 36 of the bowl portion 30 of the first container 14 from surrounding environment. The pull tab portion of the lower surface $\mathbf{18}_L$ of the first seal 18 that is not removably-secured to the upper surface $\mathbf{50}_U$ of the lip portion 50 of the first container 14 defines a lower surface of the pull tab 52, which extends beyond the side surface $\mathbf{50}_S$ of the lip portion 50 of the first container 14 and is exposed to surrounding environment.

In an example, the perimeter portion of the lower surface $\mathbf{18}_L$ of the first seal 18 is removably-secured to the upper surface $\mathbf{50}_U$ of the lip portion 50 of the first container 14 by way of an induction seal, an ultrasonic seal, an adhesive, a weld-seal, and the like. In one approach, the seal is an adhesive. In another example, the perimeter portion of the lower surface $\mathbf{18}_L$ of the first seal 18 is removably-secured to the upper surface $\mathbf{50}_U$ of the lip portion 50 of the first container 14 by an ultrasonic weld joint as a result of an ultrasonic horn ultrasonically-welding the perimeter portion of the lower surface $\mathbf{18}_L$ of the first seal 18 to the upper surface $\mathbf{50}_U$ of the lip portion 50 of the first container 14.

Figure 12:
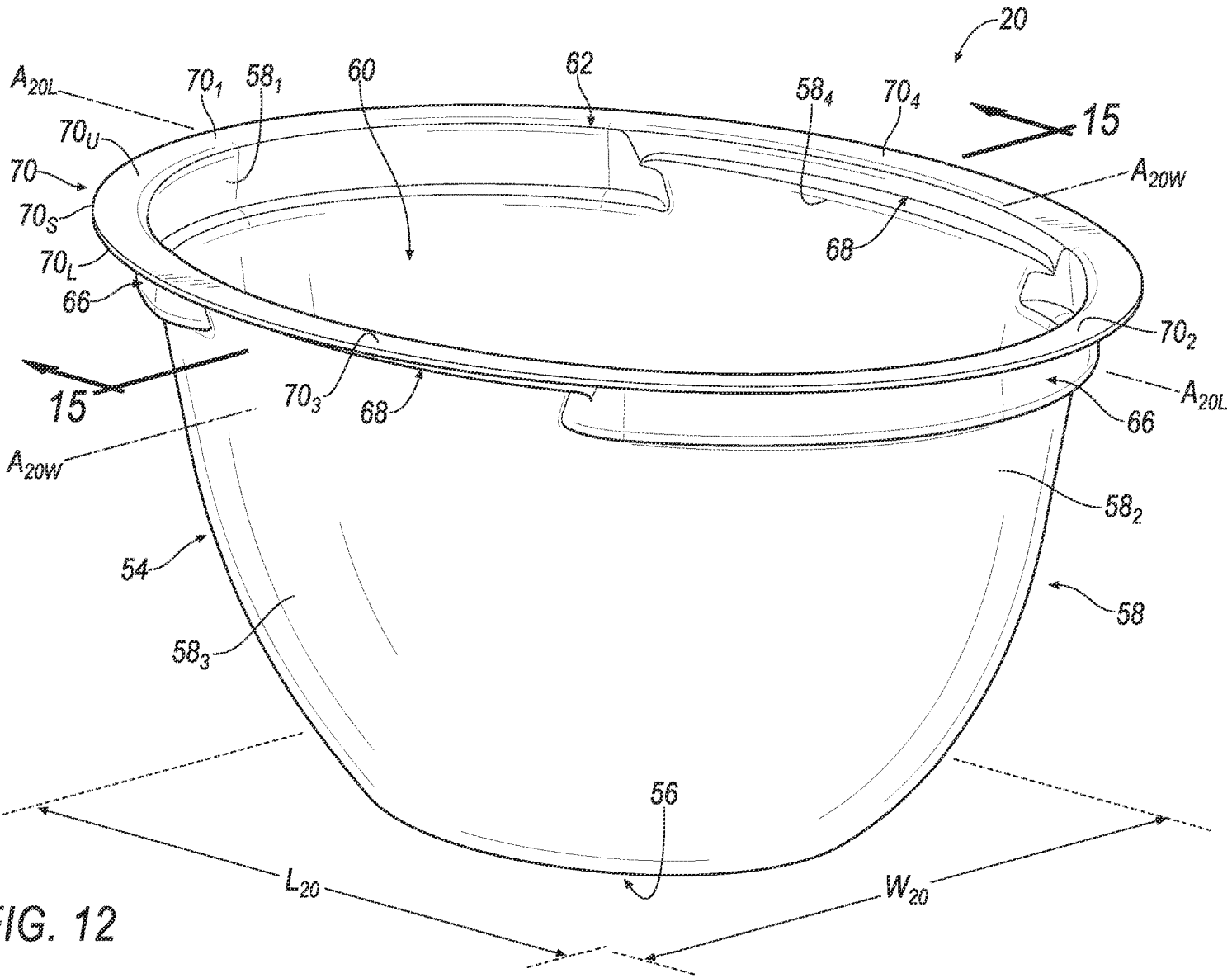
FIG. 12 is a perspective view of a second container of the packaging assembly of FIG. 1.
Figure 13:
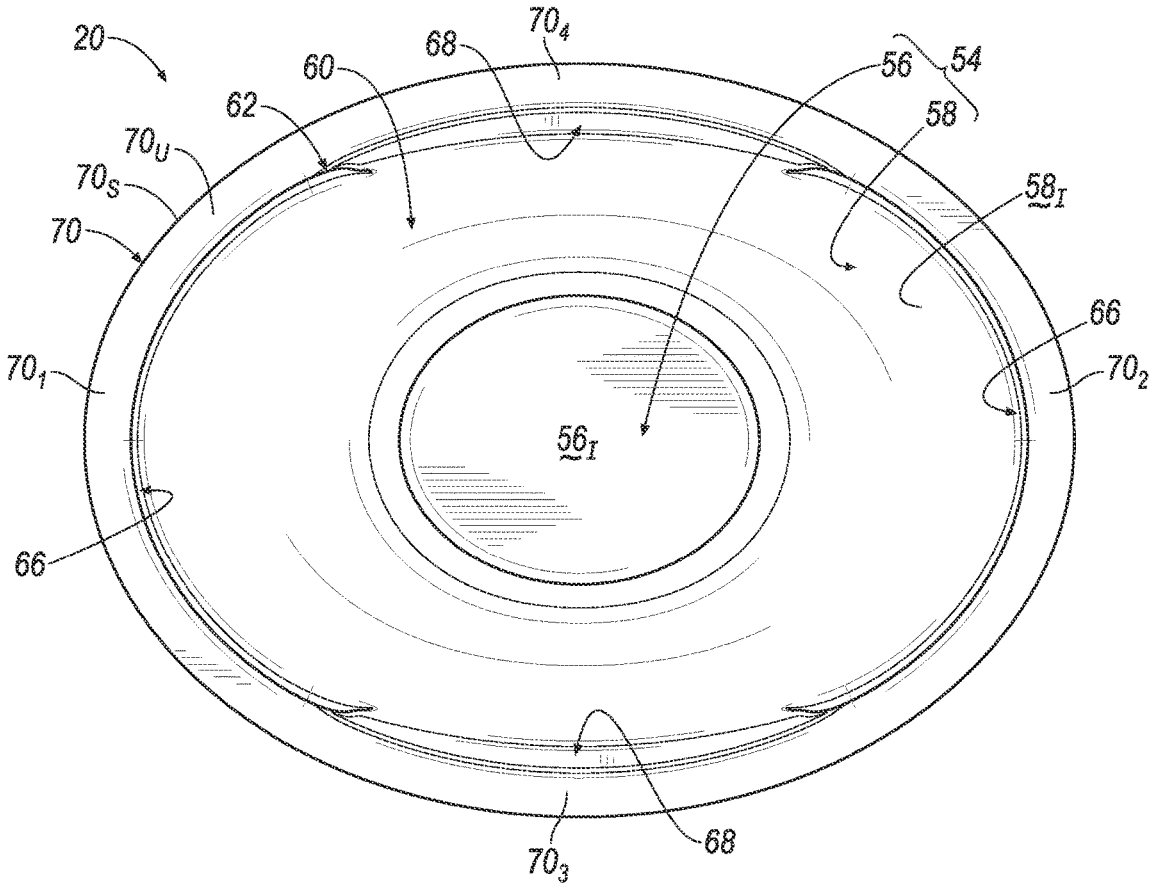
FIG. 13 is a top view of the second container of FIG. 12.

The second or outer container of the packaging assembly is shown generally at 20 in FIGS. 12-15B. Referring to FIG. 13, a first axis $A_{20L}$-$A_{20L}$ is shown extending across a length $L_{20}$ of the second container 20 and a second axis $A_{20W}$-$A_{20W}$ is shown extending across a width $W_{20}$ of the second container 20. The length $L_{20}$ of the second container 20 is greater than the width $W_{20}$ of the second container 20; accordingly, from a top view as seen in FIG. 13, the second container 20 may be defined by a substantially oval shape.

Figure 14:
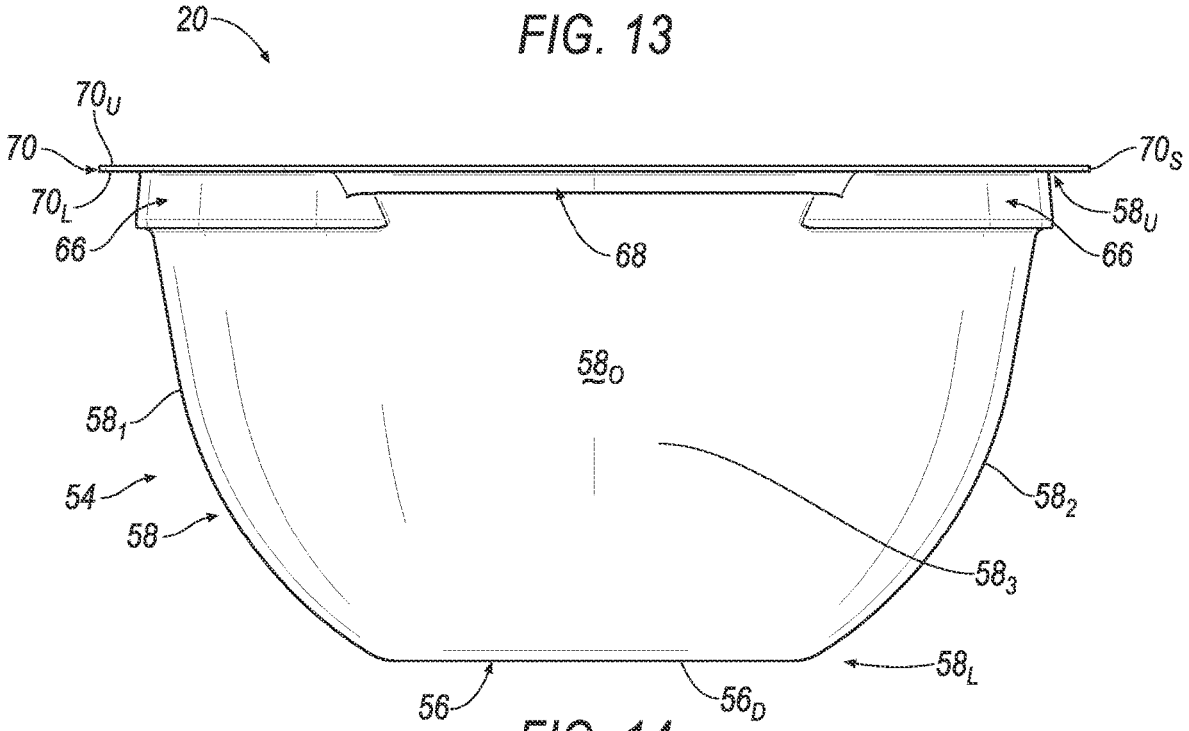
FIG. 14 is a side view of the second container of FIG. 12.
Figure 15A:
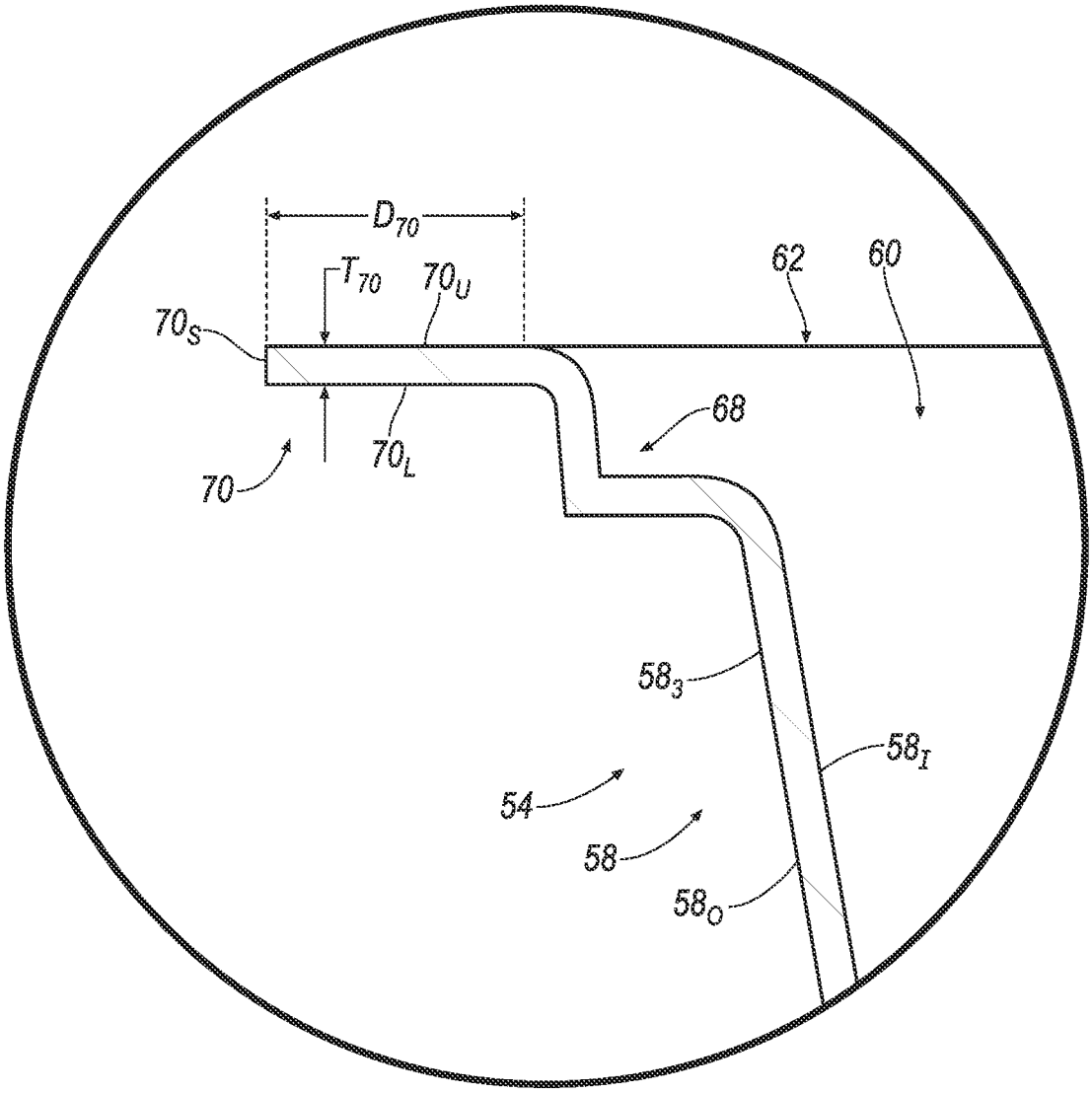
FIG. 15A is an enlarged view of the second container according to line 15A of FIG. 15.
Figure 15B:
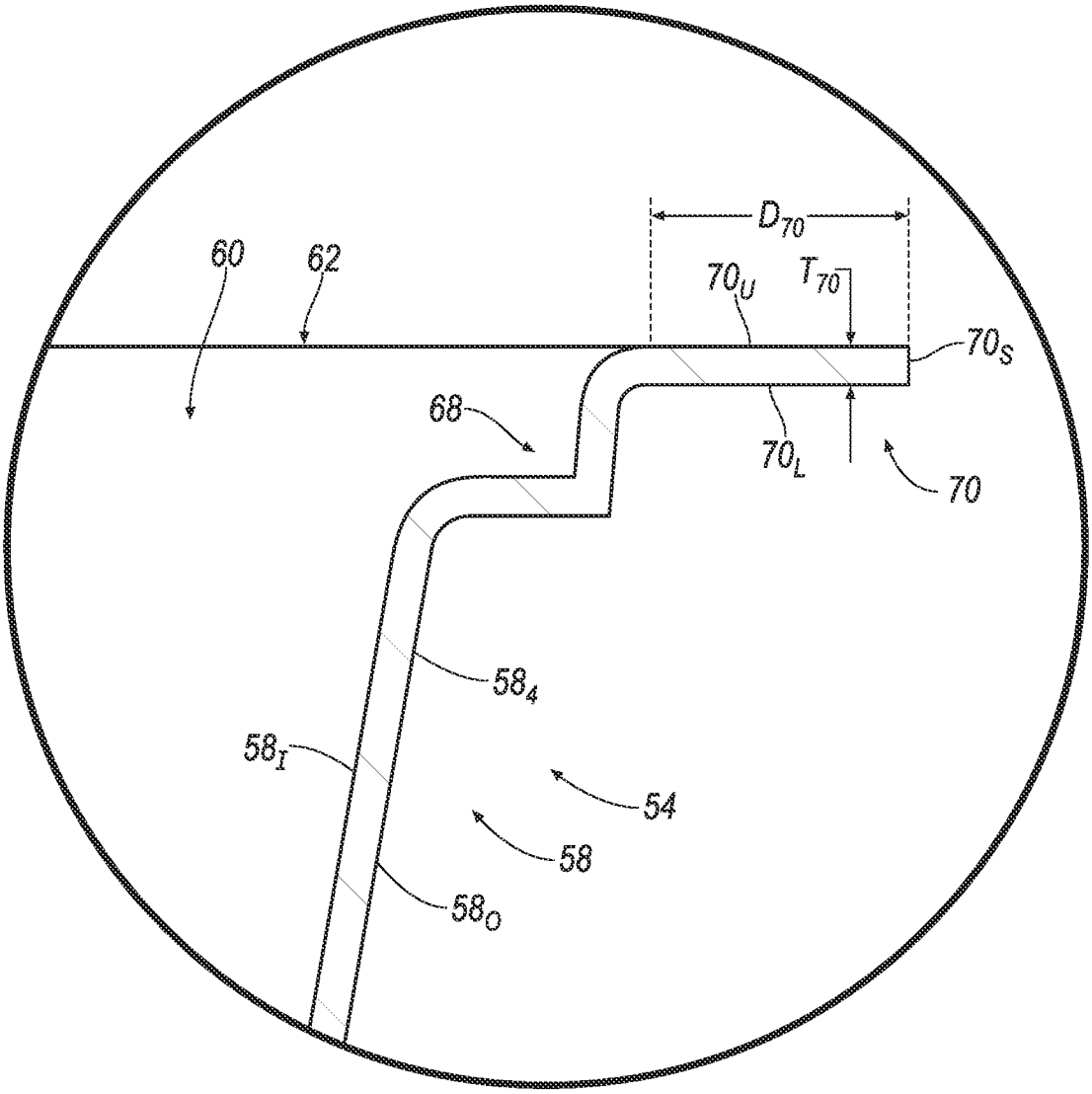
FIG. 15B is an enlarged view of the second container according to line 15B of FIG. 15.
Figure 16:
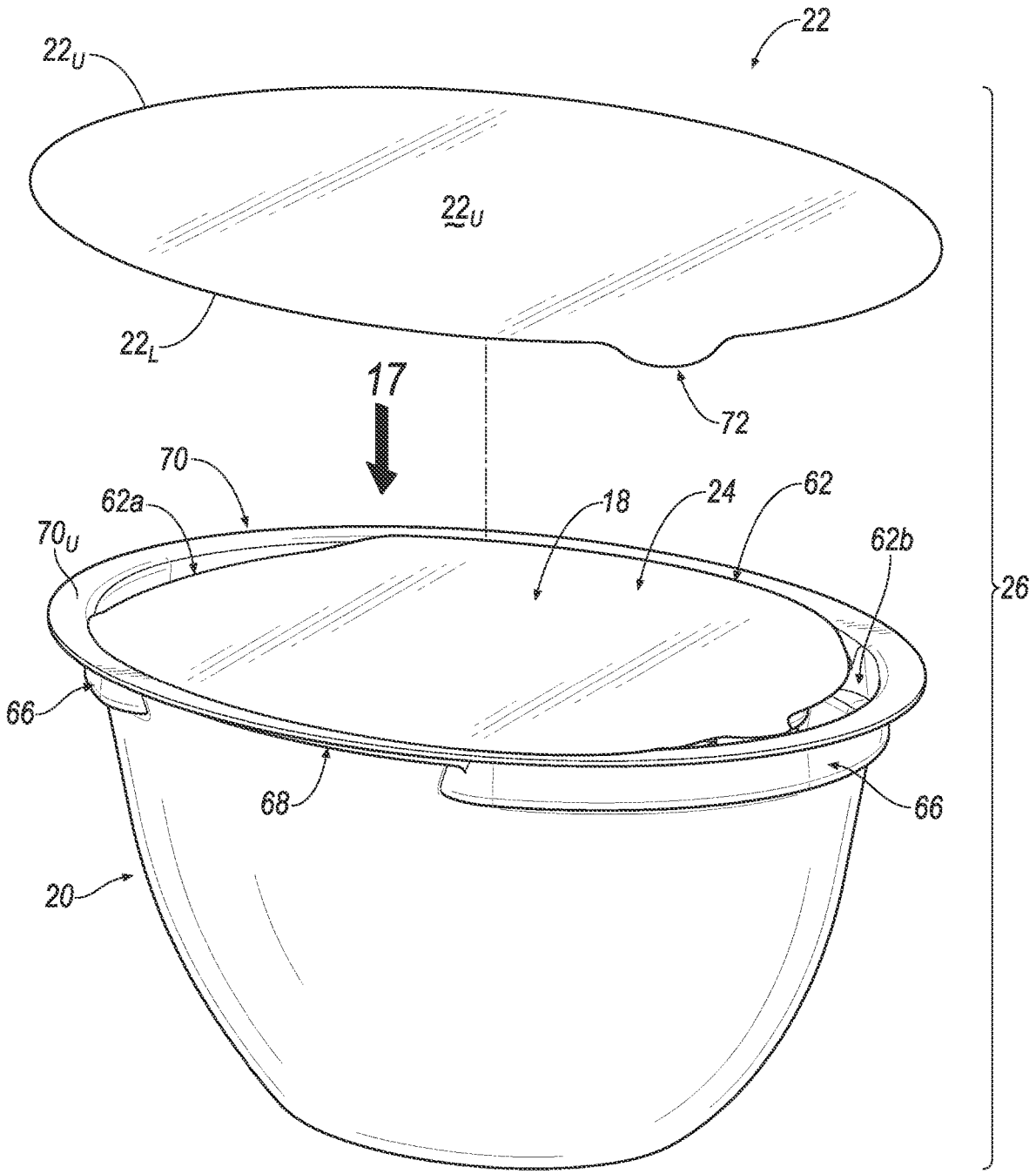
FIG. 16 is an exploded perspective view of a subassembly of the packaging assembly of FIG. 1 including a second seal that seals a cavity of the second container including a second ingredient and the subassembly of FIG. 10.

With continued reference to FIGS. 12 and 14-15, the second container 20 includes a bowl portion 54 having a bottom wall 56 and a side wall 58 extending from the bottom wall 56. Referring to FIG. 14, the side wall 58 is defined by a lower end $\mathbf{58}_L$ and an upper end $\mathbf{58}_U$. The lower end $\mathbf{58}_L$ of the side wall 58 extends from the bottom wall 56.

Referring to FIG. 15, the bottom wall 56 is defined by an inner surface $\mathbf{56}_I$ and an outer surface $\mathbf{56}_O$. The bottom wall 56 is further defined by a thickness $T_{56}$ extending between the inner surface $\mathbf{56}_I$ of the bottom wall 56 and the outer surface $\mathbf{56}_O$ of the bottom wall 56. The side wall 58 is defined by an inner surface $\mathbf{58}_I$ and an outer surface $\mathbf{58}_O$. The side wall 58 is further defined by a thickness $T_{58}$ extending between the inner surface $\mathbf{58}_I$ of the side wall 58 and the outer surface $\mathbf{58}_O$ of the side wall 58.

The inner surface $\mathbf{56}_I$, $\mathbf{58}_I$ of the bottom wall 56 and the side wall 58 define a cavity 60 of the bowl portion 54. The upper end $\mathbf{58}_U$ of the side wall 58 defines an opening 62 of the bowl portion 54 that permits access to the cavity 60 of the bowl portion 54.

As seen in FIG. 12, the first axis $A_{20L}$-$A_{20L}$ traverses a first side wall portion $\mathbf{58}_1$ of the side wall 58 and a second side wall portion $58_2$ of the side wall 58. The first side wall portion $58_1$ is opposite the second side wall portion $58_2$. Furthermore as seen in FIG. 13, the second axis $A_{20W}$-$A_{20W}$ traverses a third side wall portion $58_3$ of the side wall 58 and a fourth side wall portion $58_4$ of the side wall 58. The third side wall portion $58_3$ is opposite the fourth side wall portion $58_4$.

The thickness $T_{58}$ of the side wall 58 may be defined one or more embossed portions and one or more debossed portions. An emboss or embossed portion is generally defined by a portion of the thickness $T_{58}$ of the side wall 58 projecting away from a center of the second container 20 whereas a deboss or debossed portion is generally defined by a portion of the thickness $T_{58}$ of the side wall 58 projecting toward a center of the second container 20.

With reference to FIG. 12, the first side wall portion $58_1$ and the second side wall portion $58_2$ are each defined by an embossed portion 66. Each embossed portion 66 provides a stiffening rib for each of the first side wall portion $58_1$ and the second side wall portion $58_2$ of the side wall 58.

With reference to FIG. 15, the third side wall portion $58_3$ and the fourth side wall portion $58_4$ are each defined by an embossed portion 68. The embossed portion 68 of each of the third side wall portion $58_3$ and the fourth side wall portion $58_4$ forms a ledge surface for supporting the lower surface $50_L$ of the lip portion 50 defined by the third lip segment $50_3$ of the lip portion 50 and the fourth lip segment $50_4$ of the lip portion 50.

Referring to FIGS. 12-15B, the second container 20 also includes a lip portion 70 having an upper surface $70_U$, a lower surface $70_L$ and a side surface $70_S$ connecting the upper surface $70_U$ to the lower surface $70_L$. The lip portion 70 is further defined by a thickness $T_{70}$ (see, e.g., FIGS. 15A-15B) extending between the upper surface $70_U$ of the lower surface $70_L$. The lip portion 70 extends away from the outer surface $58_O$ of the side wall 58. The lip portion 70 extends at a distance $D_{70}$ (see, e.g., FIGS. 15A-15B) between the outer surface $58_O$ of the side wall 58 and the side surface $70_S$ of the lip portion 70.

As seen in FIG. 12, the first axis $A_{20L}$-$A_{20L}$ traverses a first lip segment $70_1$ of the lip portion 70 and a second lip segment $70_2$ of the lip portion 70. The first lip segment $70_1$ is opposite the second lip segment $70_2$. Furthermore as seen in FIG. 13, the second axis $A_{20W}$-$A_{20W}$ traverses a third lip segment $70_3$ of the lip portion 70 and a fourth lip segment $70_4$ of the lip portion 70. The third lip segment $70_3$ is opposite the fourth lip segment $70_4$.

Figure 17:
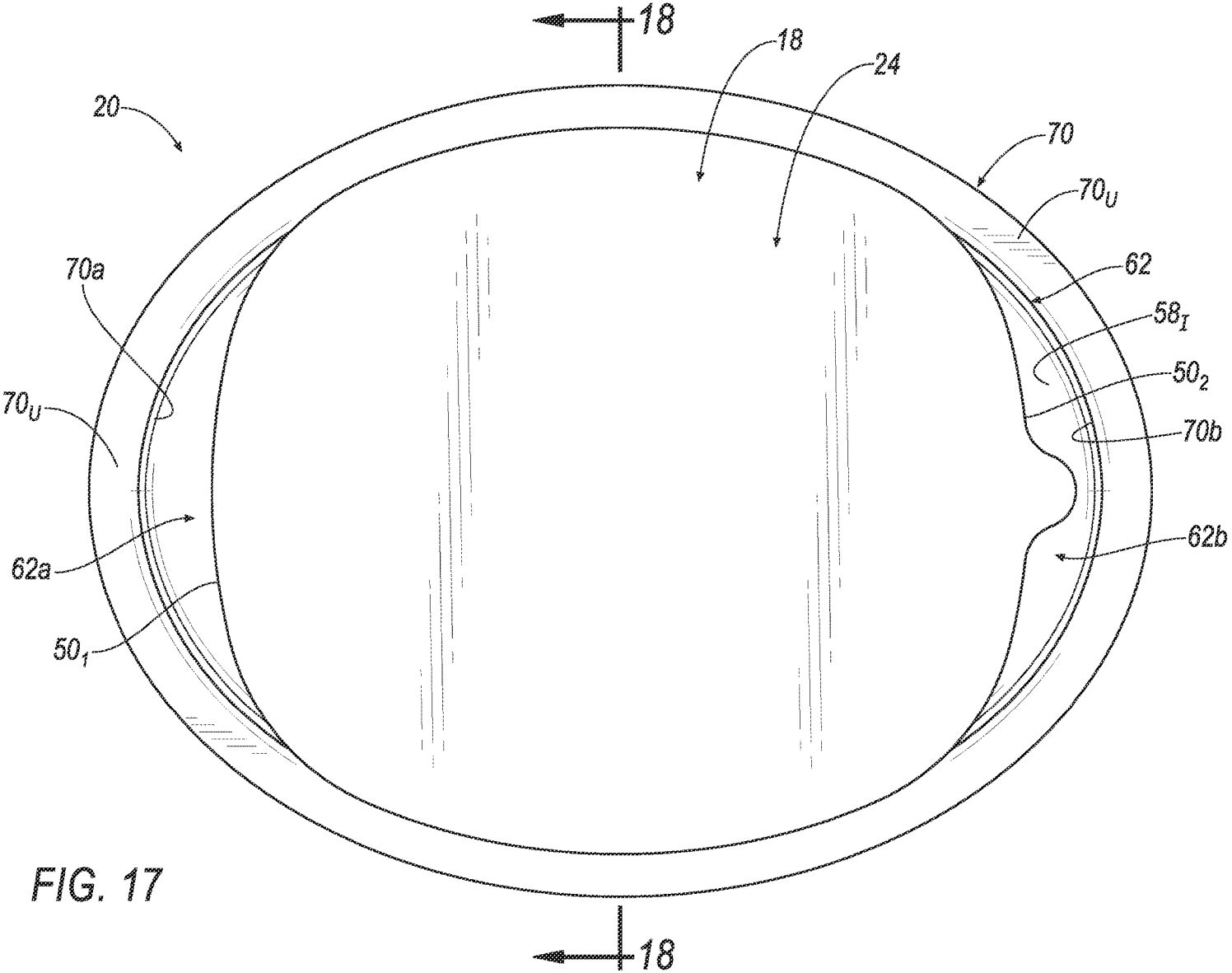
FIG. 17 is a top view of a portion of the subassembly of FIG. 16 according to arrow 17 of FIG. 16.
Figure 18:
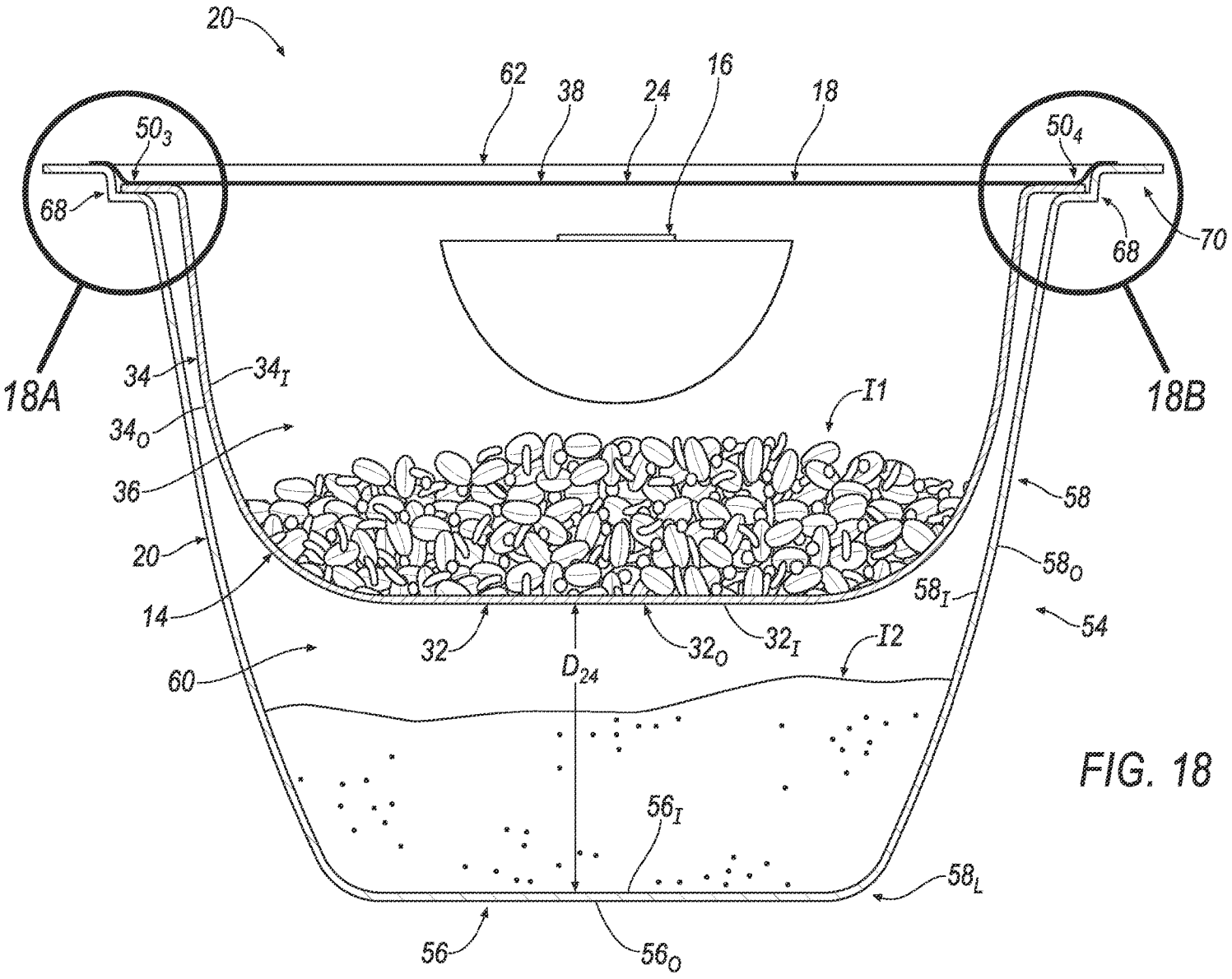
FIG. 18 is a cross-sectional view of the subassembly according to line 18-18 of FIG. 16.
Figure 18A:
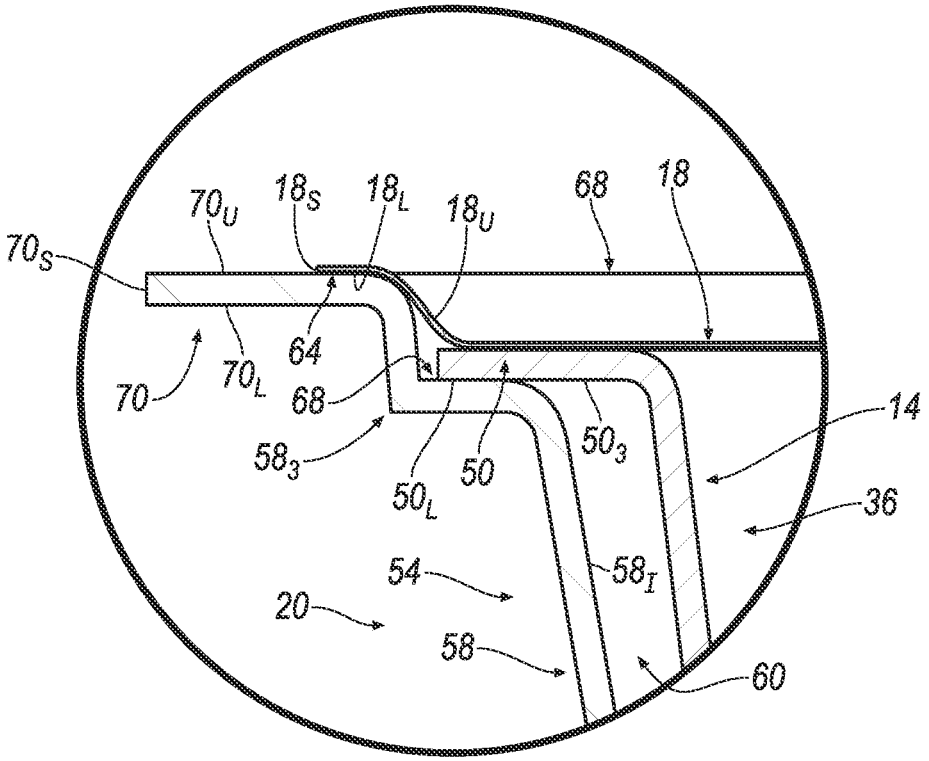
FIG. 18A is an enlarged view of the subassembly according to line 18A of FIG. 18.
Figure 18B:
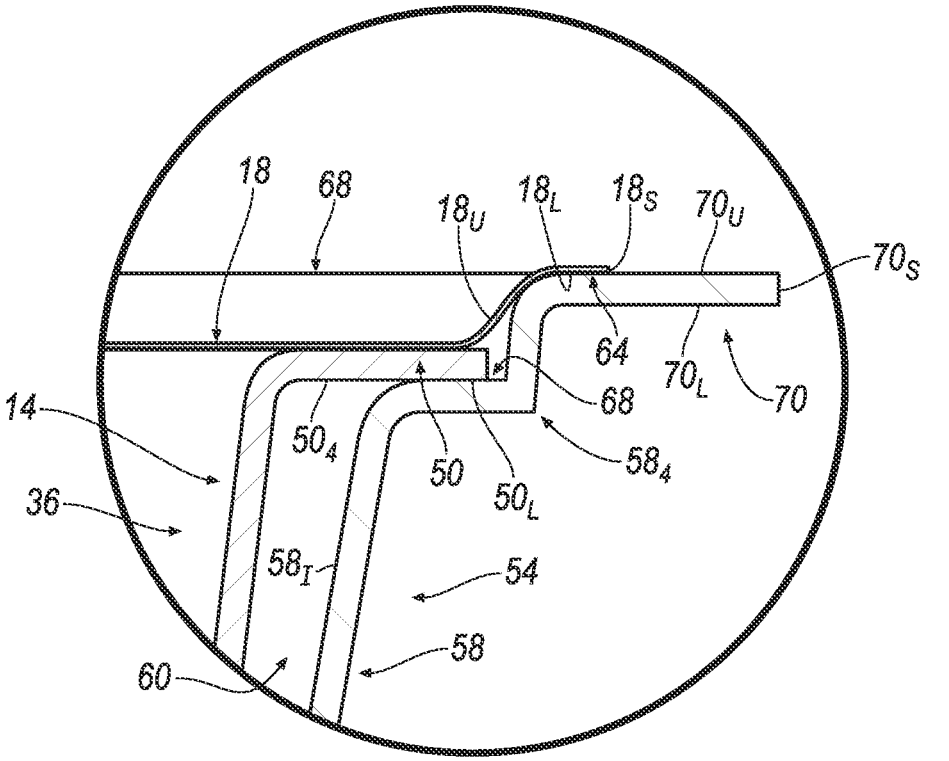
FIG. 18B is an enlarged view of the subassembly according to line 18B of FIG. 18.

Referring to FIGS. 16-18B, the first or inner container 14 that forms part of the first subassembly 24 is nested or interfaced with the second or outer container 20. Referring to FIGS. 18A-18B, when the lower surface $50_L$ of the lip portion 50 defined by each of the third lip segment $50_3$ and the fourth lip segment $50_4$ of the first container 14 are respectively disposed adjacent and supported by embossed portion 68 of each of the third side wall portion $58_3$ and the fourth side wall portion $58_4$ of the bowl portion 54 of the second container 20, the first subassembly 24 is removably-secured to the inner surface $58_I$ of the side wall 58 of the bowl portion 54 of the second container 20. Furthermore, when the lower surface $50_L$ of the lip portion 50 defined by each of the third lip segment $50_3$ and the fourth lip segment $50_4$ of the first container 14 are respectively disposed adjacent and supported by embossed portion 68 of each of the third side wall portion $58_3$ and the fourth side wall portion $58_4$ of the bowl portion 54 of the second container 20 as described above, the first subassembly 24 is arranged within the cavity 60 of the bowl portion 54 of the second container 20. Yet even further, when the lower surface $50_L$ of the lip portion 50 defined by each of the third lip segment $50_3$ and the fourth lip segment $50_4$ of the first container 14 are respectively disposed adjacent and supported by embossed portion 68 of each of the third side wall portion $58_3$ and the fourth side wall portion $58_4$ of the bowl portion 54 of the second container 20 as described above, the first subassembly 24 is arranged within the cavity 60 of the bowl portion 54 of the second container 20 and positioned near the opening 62 of the bowl portion 54. Further, when the lower surface $50_L$ of the lip portion 50 defined by each of the third lip segment $50_3$ and the fourth lip segment $50_4$ of the first container 14 are respectively disposed adjacent and supported by embossed portion 68 of each of the third side wall portion $58_3$ and the fourth side wall portion $58_4$ of the bowl portion 54 of the second container 20 as described above, the first subassembly 24 is arranged within the cavity 60 of the bowl portion 54 of the second container 20 whereby the lower surface $32_L$ of the bottom wall 32 of the bowl portion 30 of the first container 14 is positioned at a spaced-apart distance $D_{24}$ (see, e.g., FIG. 18) away from the upper surface $56_I$ of the bottom wall 56 of the bowl portion 54 of the second container 20. Yet even further, when the lower surface $50_L$ of the lip portion 50 defined by each of the third lip segment $50_3$ and the fourth lip segment $50_4$ of the first container 14 are respectively disposed adjacent and supported by embossed portion 68 of each of the third side wall portion $58_3$ and the fourth side wall portion $58_4$ of the bowl portion 54 of the second container 20 as described above, the side surface $18_S$ of the first seal 18 secured to the lip portion 50 of the first container 14 extends over a portion of the upper surface $70_S$ of the lip portion 70 of the second container 20 such that a portion 64 of the lower surface $18_L$ of the first seal 18 is disposed over the upper surface $70_U$ of the lip portion 70 of the second container 20.

With reference to FIGS. 3, 7 and 17, the side surface $50_S$ of the lip portion 50 of the first container 14 defines the first container 14 to have a substantially rectangular shape with curved corners when viewed from a top view perspective. Furthermore, with reference to FIGS. 13 and 17, a region where the upper surface $70_U$ of the lip portion 70 meets the inner surface $58_I$ of the side wall 58 of the bowl portion 54 of the second container 20 defines the opening 62 of the bowl portion 54 of the second container 20 to have a substantially oval shape when viewed from a top view perspective. Comparatively, as seen in FIG. 17, the first container 14 is defined by a length dimension and a width dimension that is less than a length dimension and a width dimension of the second container 20 such that the first container 14 is permitted to nest within and be contained by the cavity 60 of the bowl portion 54 of the second container 20. As discussed below, the differing shapes of the first and second containers 14, 20 forms openings 62*a*, 62*b*.

With reference to FIG. 17, as a result of the combination of the substantially rectangular shape of the first container 14, the oval shape of the second container 20 and the sizing of the first container 14 with respect to the second container 20, when the first container 14 is inserted through the opening 62 of the bowl portion 54 of the second container 20 and into the cavity 60 of the bowl portion 54 of the second container 20 such that the lower surface $50_L$ of the lip portion 50 defined by each of the third lip segment $50_3$ and the fourth lip segment $50_4$ of the first container 14 are respectively disposed adjacent and supported by the embossed portion 68 of each of the third side wall portion $58_3$ and the fourth side wall portion $58_4$ of the bowl portion 54 of the second container 20, the first container 14 partially closes out the oval-shaped opening 62 of the bowl portion 54 of the second container 20. More specifically, the partial closing-out of the oval-shaped opening 62 of the bowl portion 54 of the second container 20 by the first container 14 results in a remainder of the oval-shaped opening 62 of the bowl portion 54 of the second container 20 defining a first C-shaped or crescent-shaped opening 62*a* and a second C-shaped or crescent-shaped opening 62*b*.

In an example, the first crescent-shaped opening 62*a* is at least partially defined by: (1) the side surface $\mathbf{50}_S$ of the lip portion 50 of the first container 14 defined by of the first lip segment $\mathbf{50}_1$; and (2) a first portion 70*a* of a region where the upper surface $\mathbf{70}_U$ of the lip portion 70 meets the inner surface $\mathbf{58}_I$ of the side wall 58 of the bowl portion 54 of the second container 20. In another example, the second crescent-shaped opening 62*b* is defined by: (1) the side surface $\mathbf{50}_S$ of the lip portion 50 of the first container 14 defined by of the second lip segment $\mathbf{50}_2$; and (2) a second portion 70*b* of a region where the upper surface $\mathbf{70}_U$ of the lip portion 70 meets the inner surface $\mathbf{58}_I$ of the side wall 58 of the bowl portion 54 of the second container 20. As will be described in the following disclosure at FIGS. 31O-31P, each of the first crescent-shaped opening 62*a* and the second crescent-shaped opening 62*b* permits a user to touch, pinch or lift a portion of one or both of the first lip segment $\mathbf{50}_1$ of the lip portion 50 of the first container 14 and the second lip segment $\mathbf{50}_2$ of the lip portion 50 of the first container 14 for removing the first container 14 from the cavity 60 of the bowl portion 54 of the second container 20.

Optionally, as seen in FIGS. 1 and 18, a second ingredient I2 may be disposed within the cavity 60 of the bowl portion 54 of the second container 20. When the lower surface $\mathbf{50}_L$ of the lip portion 50 defined by each of the third lip segment $\mathbf{50}_3$ and the fourth lip segment $\mathbf{50}_4$ are respectively disposed adjacent and supported by embossed portion 68 of each of the third side wall portion $\mathbf{58}_3$ and the fourth side wall portion $\mathbf{58}_4$ of the bowl portion 54 of the second container 20 such that the first subassembly 24 is arranged within the cavity 60 of the bowl portion 54 the second container 20, the second ingredient I2 may partially fill or entirely fill a remainder volume of the cavity 60 that is not occupied by the first subassembly 24.

As seen in FIGS. 16 and 19-21, the second seal 22 is defined by an upper surface $\mathbf{22}_U$, a lower surface $\mathbf{22}_L$ and a side surface $\mathbf{22}_S$ connecting the upper surface $\mathbf{22}_U$ to the lower surface $\mathbf{22}_L$. The second seal 22 corresponds to the shape of and extends across both of the opening 62 of the bowl portion 54 of the second container 20 and the upper surface $\mathbf{70}_U$ of the lip portion 70 of the second container 20. The second seal 22 may also define a pull tab 72 that extends beyond the side surface $\mathbf{70}_S$ of the lip portion 70 of the second container 20 in order to permit a user to pinch and grasp both of the upper surface $\mathbf{22}_U$ to the lower surface $\mathbf{22}_L$ of the second seal 22 for removing the second seal 22 from the second container 20.

The lower surface $\mathbf{22}_L$ of the second seal 22 defines a perimeter portion, an opening sealing portion and a pull tab portion. The perimeter portion of the lower surface $\mathbf{22}_L$ of the second seal 22 extends from the side surface $\mathbf{22}_S$ of the second seal 22 at a distance $D_{22}$ (see, e.g., FIGS. 20-21). The distance $D_{22}$ of the perimeter portion of the lower surface $\mathbf{22}_L$ of the second seal 22 is approximately equal to the distance $D_{70}$ of the lip potion 70 extending between outer surface $\mathbf{58}_O$ of the side wall 58 of the bowl portion 54 of the second container 20 and the side surface $\mathbf{70}_S$ of the lip portion 70 of the second container 20. Furthermore, as seen in FIG. 20, a portion of the distance $D_{22}$ of the perimeter portion of the lower surface $\mathbf{22}_L$ of the second seal 22 may extend over a portion of the first seal 18 defined by the portion 64 of the lower surface $\mathbf{18}_L$ of the first seal 18 that is disposed over the upper surface $\mathbf{70}_U$ of the lip portion 70 of the second container 20; therefore, upon securing (e.g., ultrasonically) the second seal 22 to the upper surface $\mathbf{70}_U$ of the lip portion 70, a portion of the upper surface $\mathbf{18}_U$ of the first seal 18 opposite the portion 64 of the lower surface $\mathbf{18}_L$ of the first seal 18 may be secured to a portion of the lower surface $\mathbf{22}_L$ of the second seal 22.

With reference to FIGS. 20-21, the perimeter portion of the lower surface $\mathbf{22}_L$ of the second seal 22 is removably-secured to the upper surface $\mathbf{70}_U$ of the lip portion 70 of the second container 20. Upon removably-securing the second seal 22 to the second container 20 with: (1) the first subassembly 24 removably-secured thereto; (2) the first ingredient I1 optionally disposed within the first container 14; and (3) the second ingredient I2 optionally disposed within the second container 20, the second subassembly 26 may be said to be arranged in an assembled state.

The opening sealing portion of the lower surface $\mathbf{22}_L$ of the second seal 22 that is not removably-secured to the upper surface $\mathbf{70}_U$ of the lip portion 70 of the second container 20 and extends across the opening 62 of the bowl portion 54 of the second container 20 such that the opening sealing portion of the lower surface $\mathbf{22}_L$ of the second seal 22 seals the cavity 60 of the bowl portion 54 of the second container 20 from surrounding environment. The pull tab portion defining the pull tab 72 of the lower surface $\mathbf{22}_L$ of the second seal 22 that is not removably-secured to the upper surface $\mathbf{70}_U$ of the lip portion 70 of the second container 20 extends beyond the side surface $\mathbf{70}_S$ of the lip portion 70 of the second container 20 and is exposed to surrounding environment.

In an example, the perimeter portion of the lower surface $\mathbf{22}_L$ of the second seal 22 is removably-secured to the upper surface $\mathbf{70}_U$ of the lip portion 70 of the second container 20 by way of an induction seal, an ultrasonic seal, an adhesive, a weld-seal, and the like. In one approach, the seal is an adhesive. In another example, the perimeter portion of the lower surface $\mathbf{22}_L$ of the second seal 22 is removably-secured to the upper surface $\mathbf{70}_U$ of the lip portion 70 of the second container 20 by an ultrasonic weld joint as a result of an ultrasonic horn ultrasonically-welding the perimeter portion of the lower surface $\mathbf{22}_L$ of the second seal 22 to the upper surface $\mathbf{70}_U$ of the lip portion 70 of the second container 20.

Referring to FIGS. 24-30, the optional packaging jacket 12 is derived from a blank of material 74 (see, e.g., FIGS. 22-23) having a front surface $\mathbf{74}_F$ (see, e.g., FIG. 22) a rear surface $\mathbf{74}_R$ (see, e.g., FIG. 23) and a side surface $\mathbf{74}_S$ connecting the front surface $\mathbf{74}_F$ to the rear surface $\mathbf{74}_R$. The blank of material 74 may be defined by a thickness extending between the front surface $\mathbf{74}_F$ and the rear surface $\mathbf{74}_R$. With reference to FIGS. 24-30, when the optional packaging jacket 12 is arranged about the second subassembly 26, the front surface $\mathbf{74}_F$ may include markings, indicia symbols or the like such as, for example: branding, pictures, symbols, dietary information and like. The blank of material may be formed from any desirable material such as, for example, paper, cardboard, plastic or the like.

The blank of material 74 may be further defined by a plurality of panel portions 76-84. The plurality of panel portions 76-84 may include: a top panel portion 76 (see also, e.g., FIG. 25), a front panel portion 78 (see also, e.g., FIG. 27), a rear panel portion 80 (see also, e.g., FIG. 28), a bottom panel portion 82 (see also, e.g., FIG. 26); and a bottom lip panel portion 84. Each panel portion 76, 78, 80, 82, 84 of the plurality of panel portions 76-84 may be separated by a fold lines $\mathbf{86}_1$-$\mathbf{86}_6$.

The blank of material 74 may be further defined by a plurality of openings 88-90. The plurality of openings 88-90 may be formed by punching or by die-cutting the thickness of the blank of material 74. The plurality of openings 88-90 include a first or front opening 88 and a second or rear opening 90. The first or front opening 88 is defined by the front panel portion 78 and the top panel portion 76. The second or rear opening 90 is defined by the rear panel portion 80 and the top panel portion 76.

Figure 22:
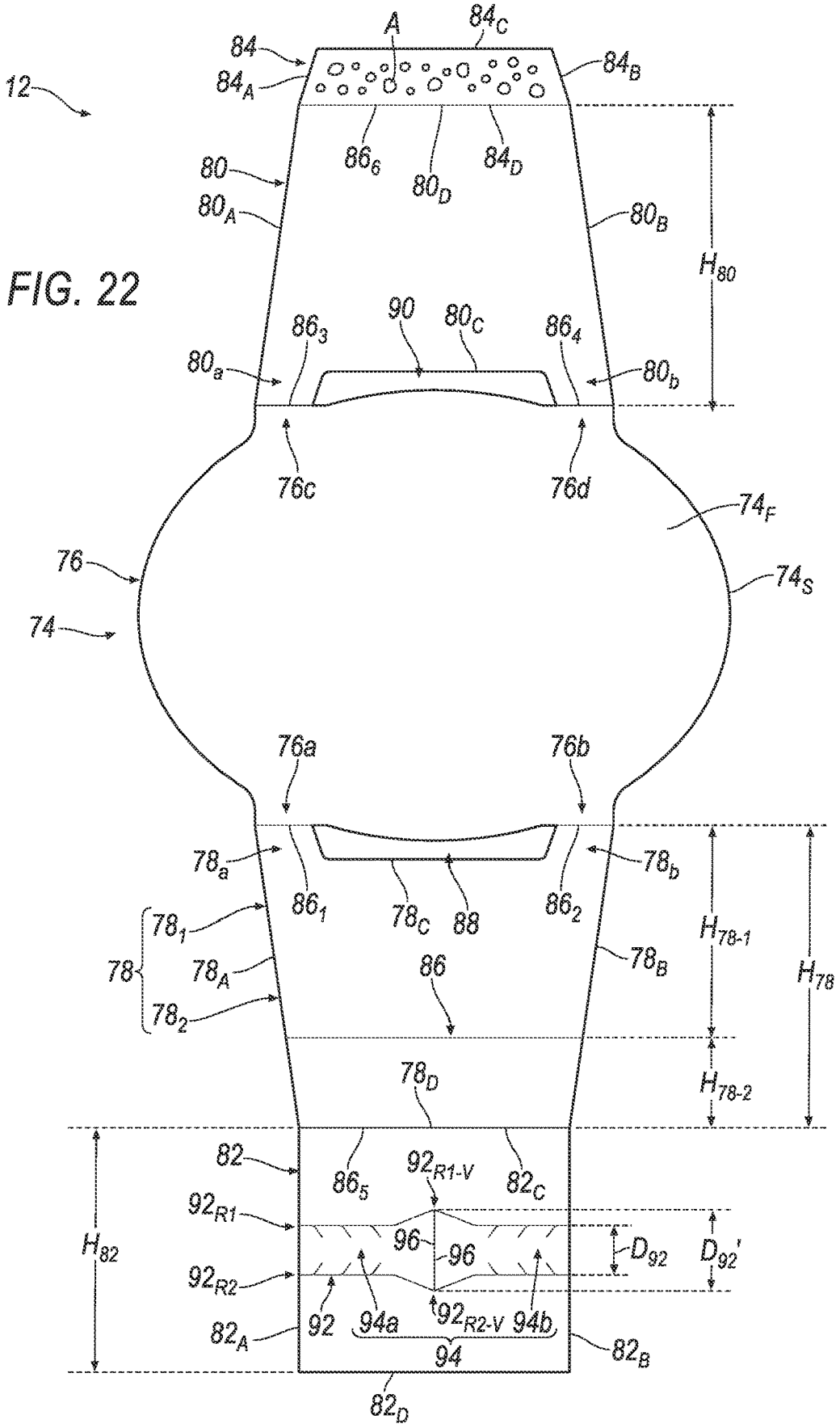
FIG. 22 is a front view of a blank of material forming an optional packaging jacket of the packaging assembly of FIG. 1.
Figure 23:
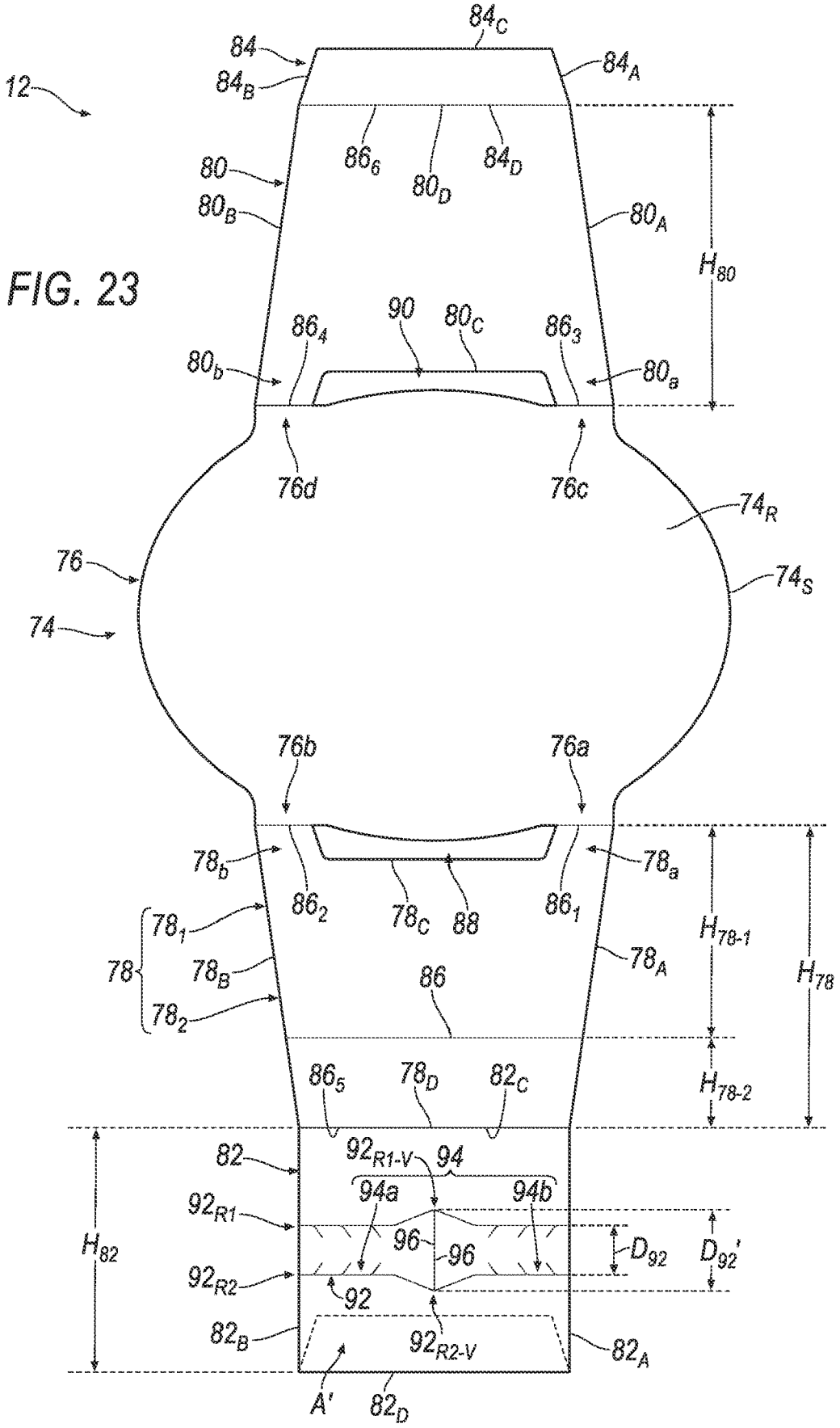
FIG. 23 is a rear view of the blank of material of FIG. 22.
Figure 24:
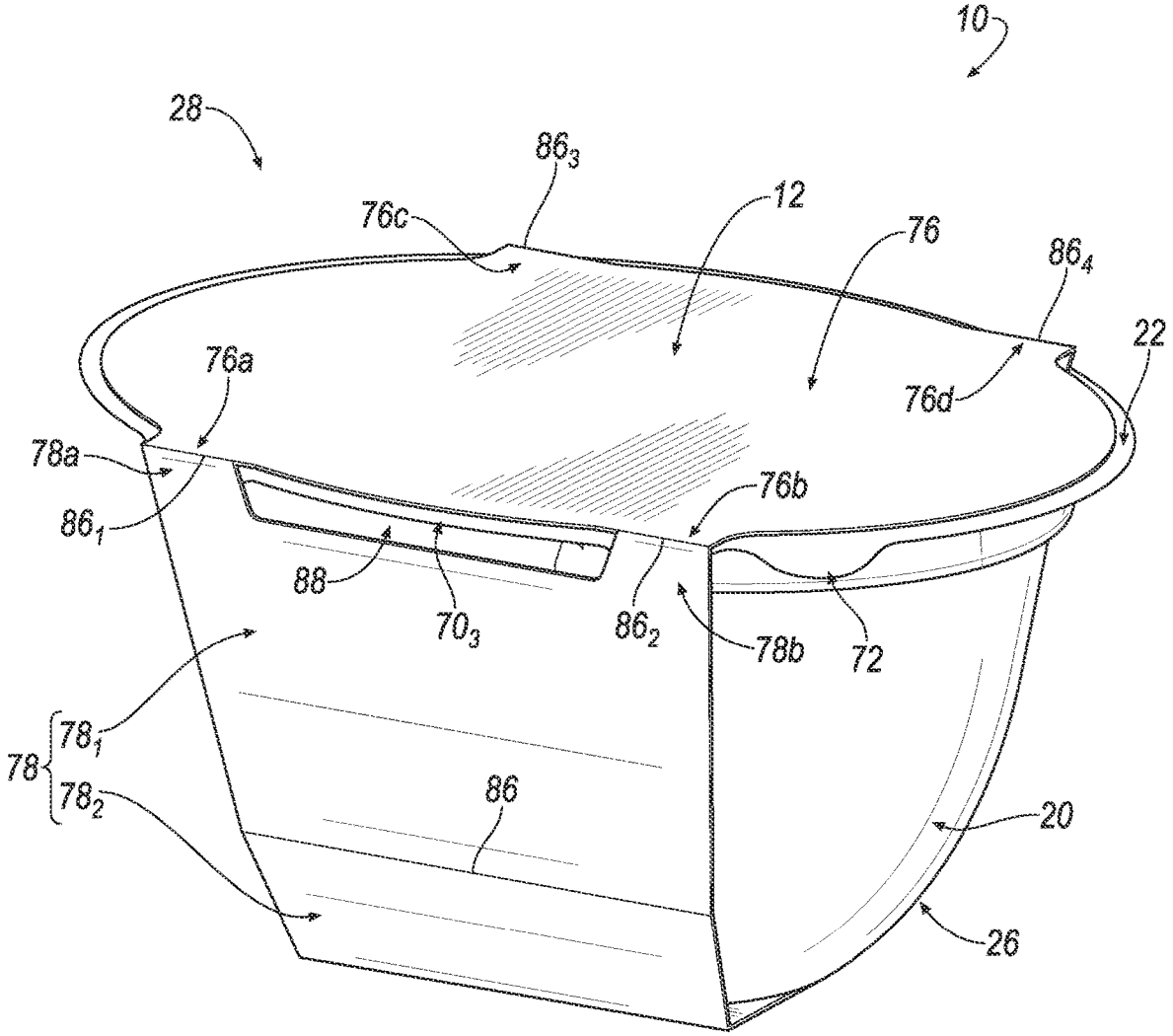
FIG. 24 is a perspective view of a subassembly of the packaging assembly of FIG. 1 including the blank of material of FIGS. 22-23 wrapped around the subassembly of FIG. 19.
Figure 25:
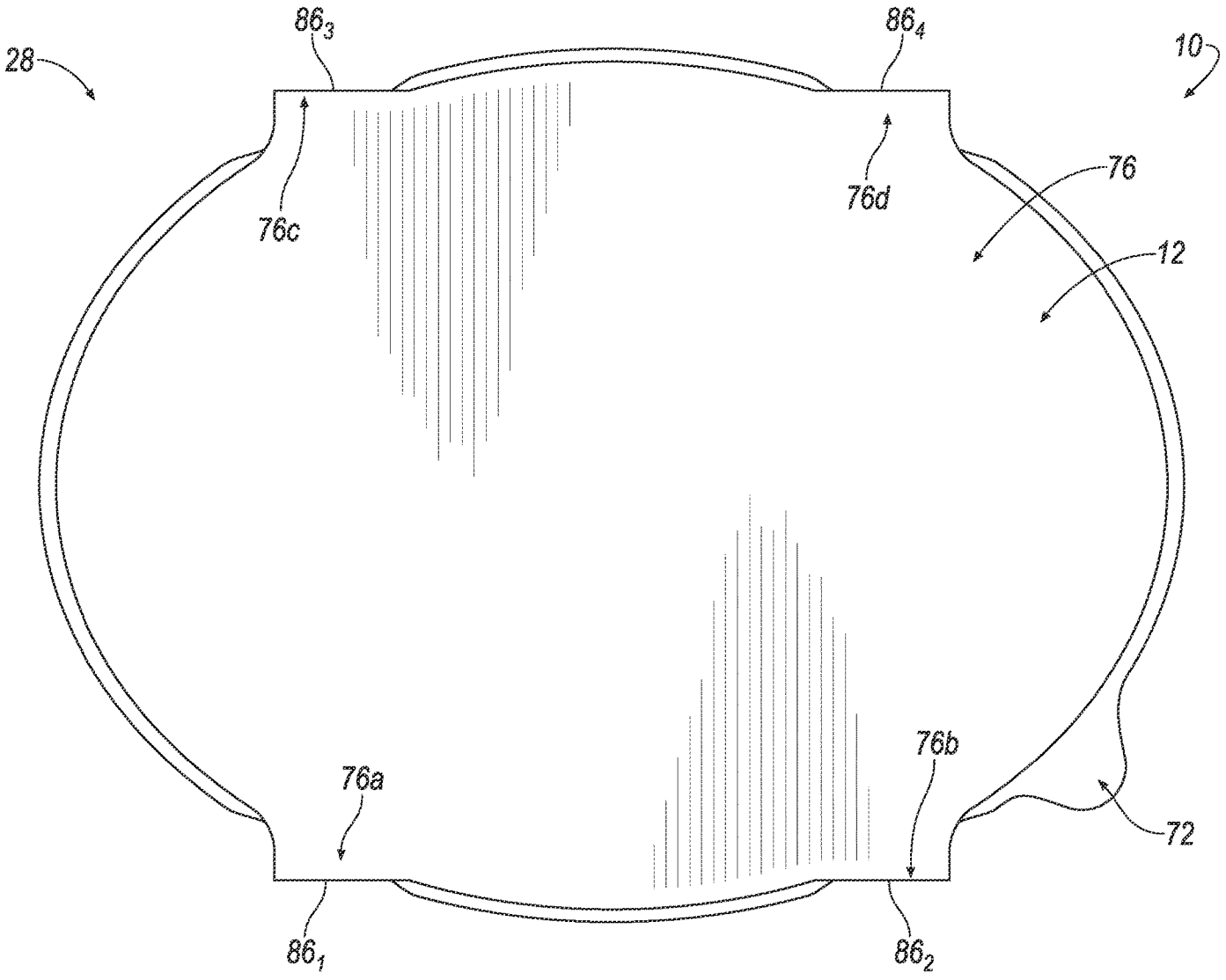
FIG. 25 is a top view of the subassembly of FIG. 24.
Figure 26:
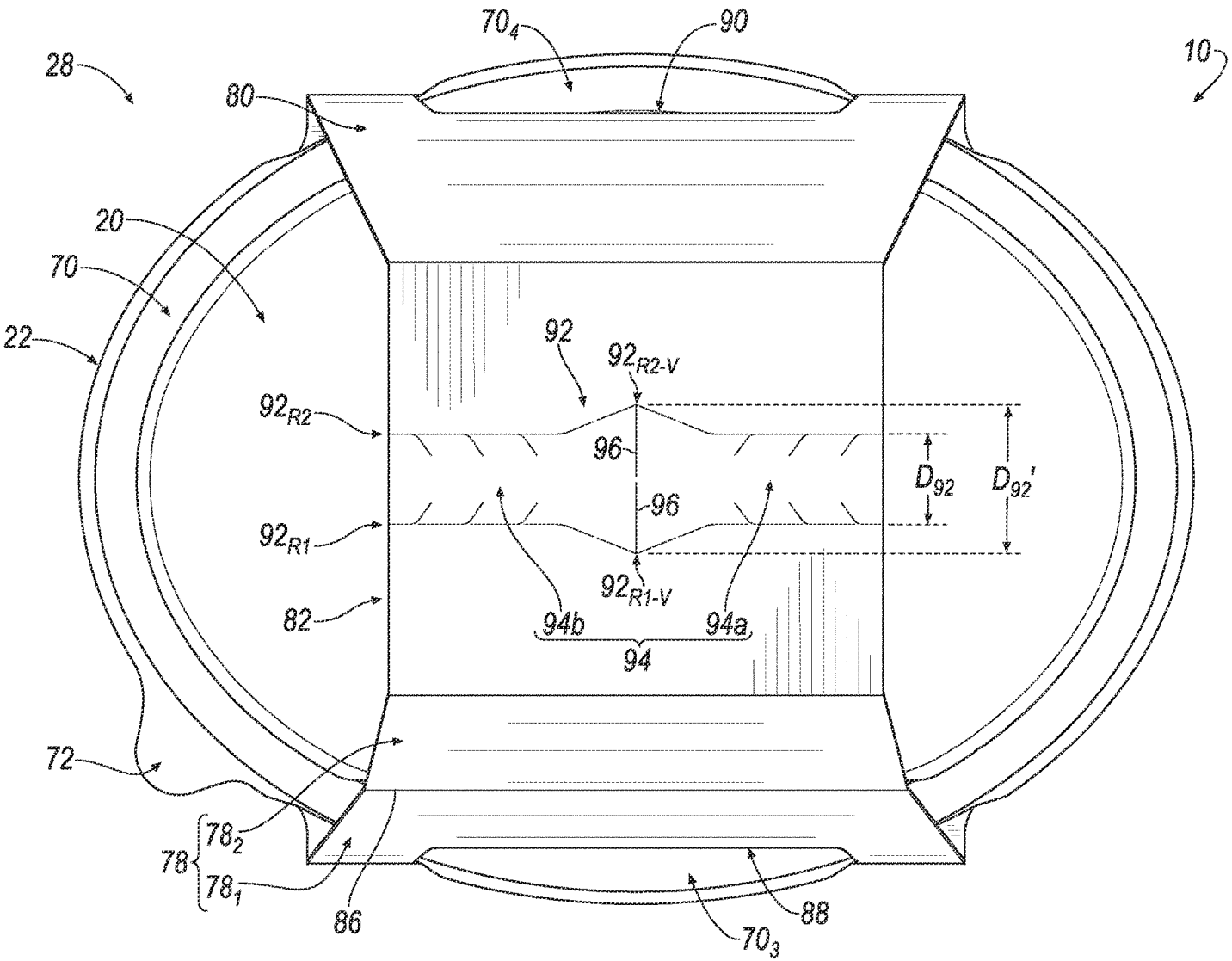
FIG. 26 is a bottom view of the subassembly of FIG. 24.
Figure 27:
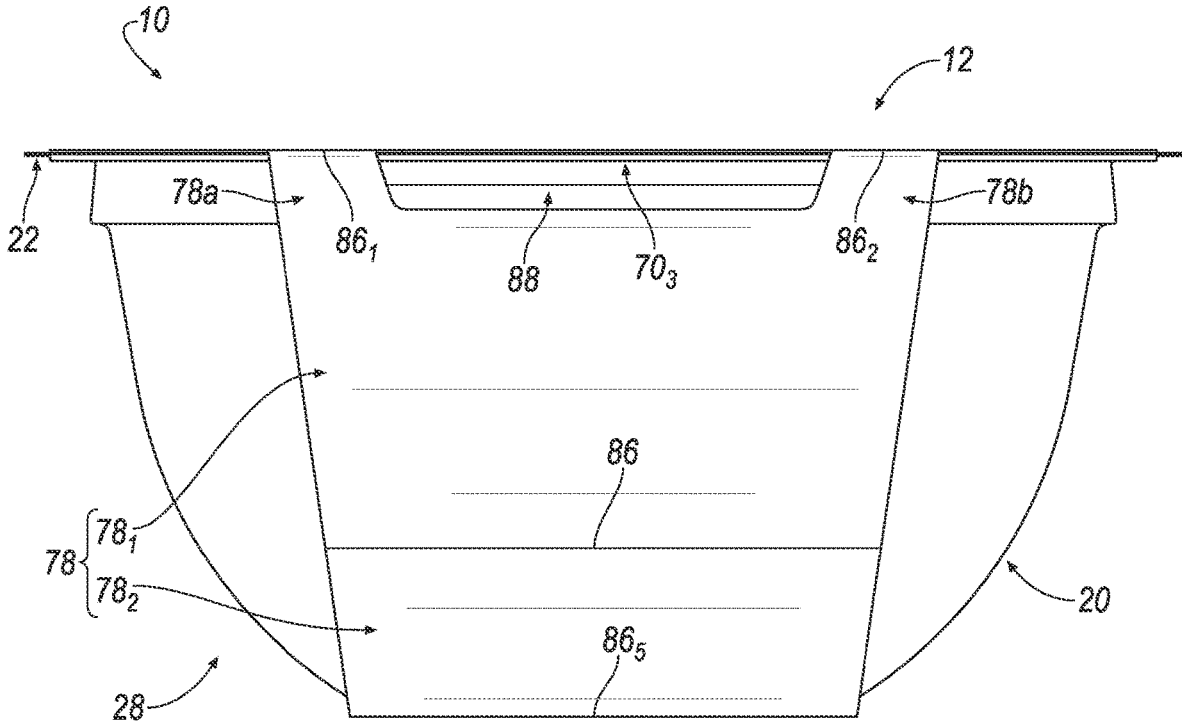
FIG. 27 is front view of the subassembly of FIG. 24.
Figure 28:
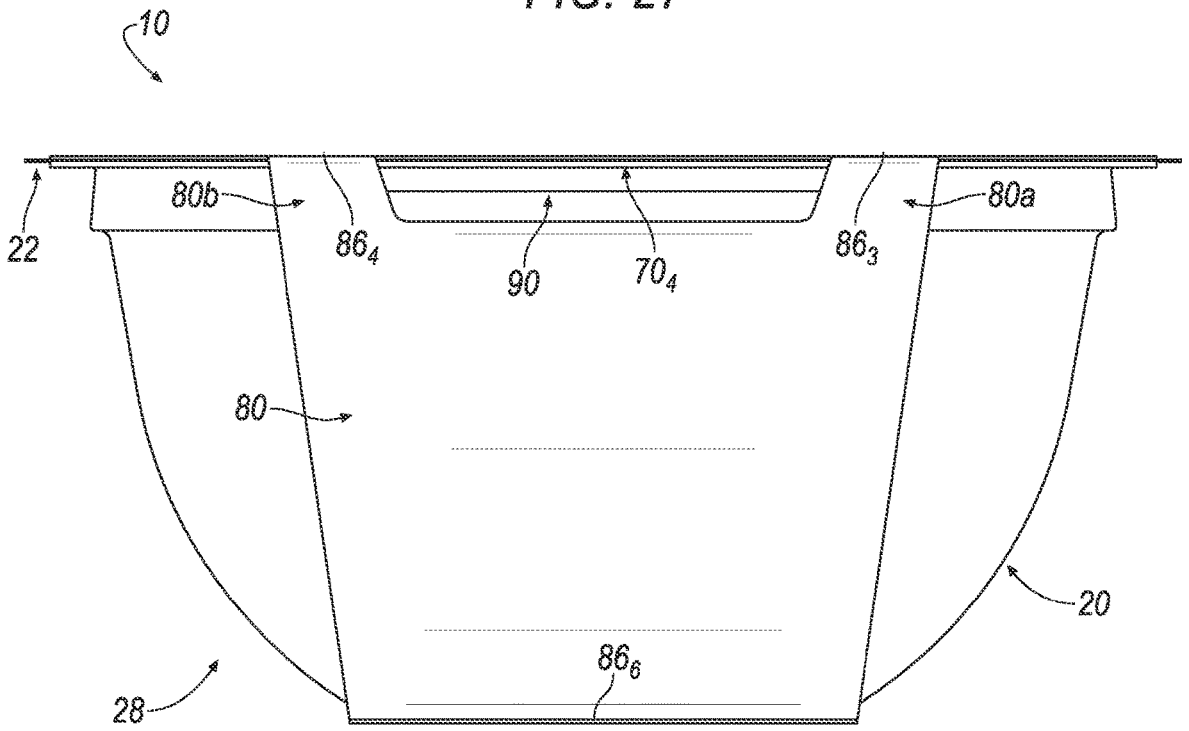
FIG. 28 is a rear view of the subassembly of FIG. 24.
Figure 29:
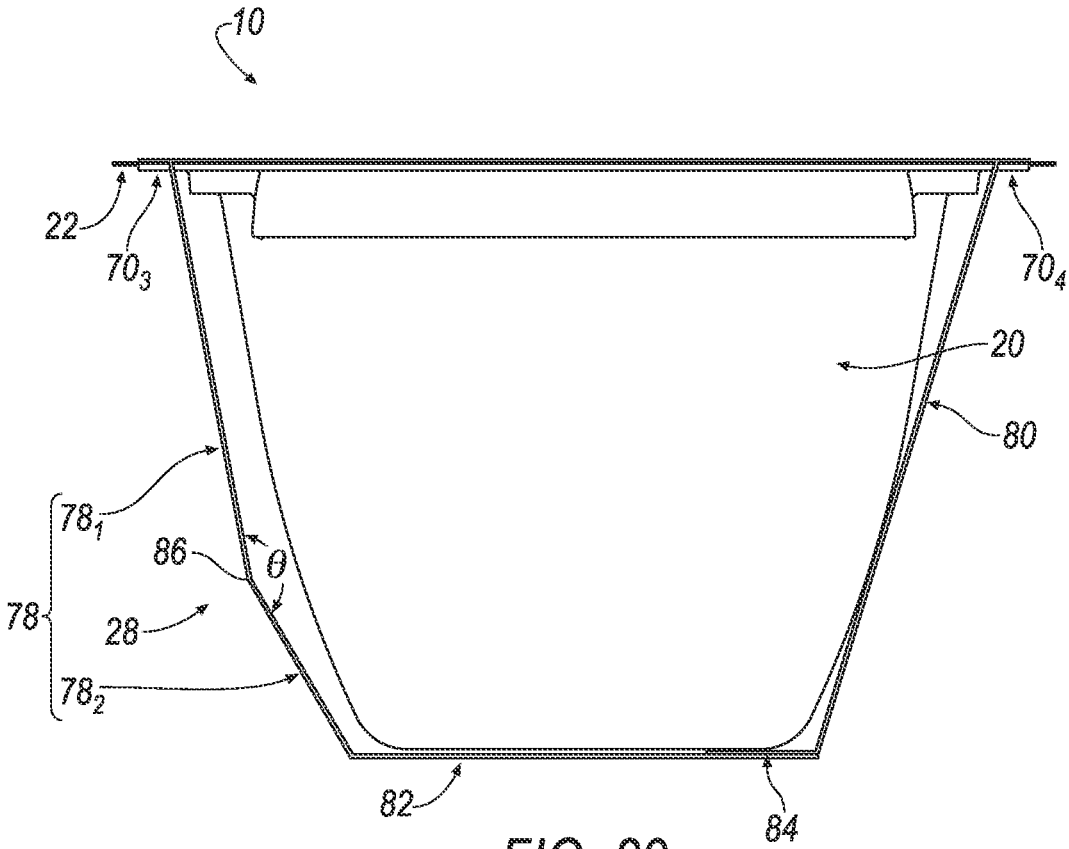
FIG. 29 is a right view of the subassembly of FIG. 24.
Figure 30:
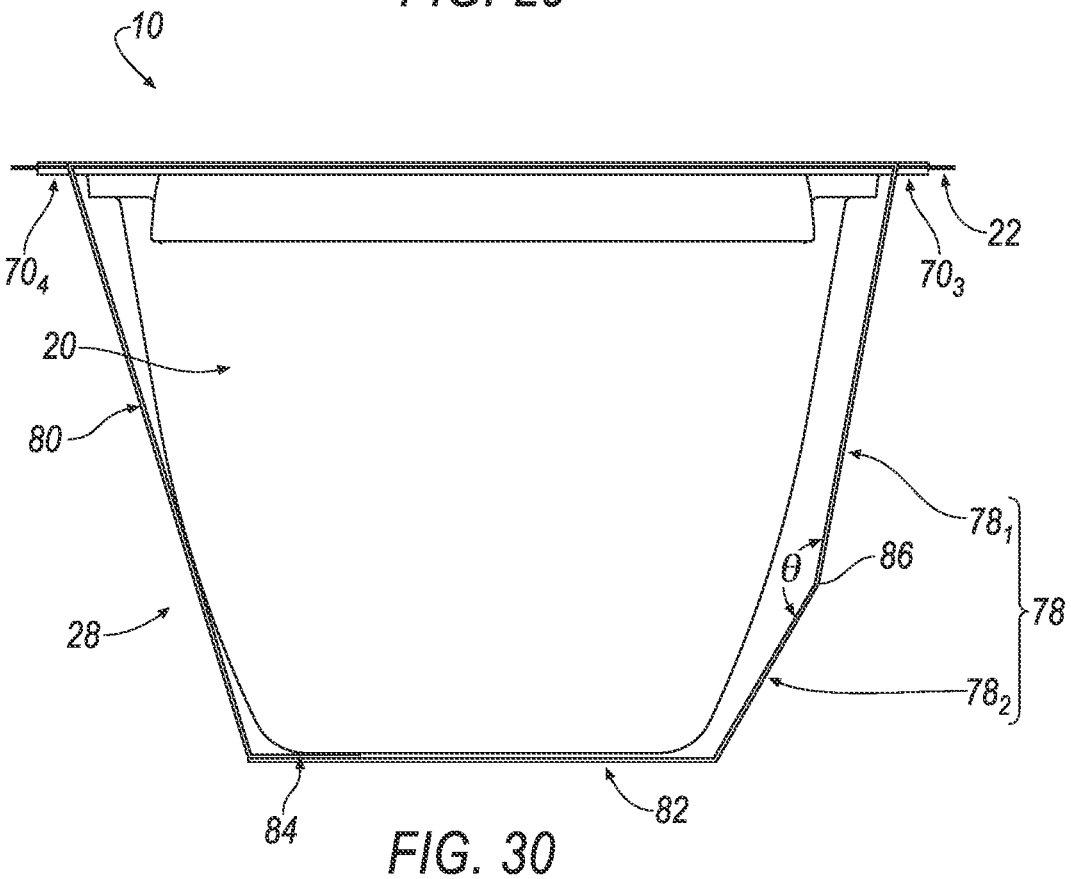
FIG. 30 is a left view of the subassembly of FIG. 24.

With reference to FIGS. 22-23, the top panel portion 76, is defined by a substantially oval shape when viewed from a top view perspective. The substantially oval shape is sized for being disposed over and covering the substantially oval shape defined by the side surface $\mathbf{70}_S$ of the lip portion 70 of the second container 20.

The top panel portion 76 may also include a first front flared portion 76*a* and a second front flared portion 76*b* extending away from an oval-shaped perimeter defining the top panel portion 76. Each of the first front flared portion 76*a* and the second front flared portion 76*b* has a linear segment defining a fold line for foldably-connecting the front panel portion 78 to the top panel portion 76 along respective fold lines $\mathbf{86}_1$, $\mathbf{86}_2$. Furthermore, the top panel portion 76 may also include a first rear flared portion 76*c* and a second rear flared portion 76*d* extending away from the oval-shaped perimeter defining the top panel portion 76. Each of the first rear flared portion 76*c* and the second rear flared portion 76*d* has a linear segment defining a fold line for foldably-connecting the rear panel portion 80 to the top panel portion 76 along respective fold lines $\mathbf{86}_3$, $\mathbf{86}_4$.

As seen in FIGS. 22-23, the front panel portion 78 is defined by a substantially trapezoidal shape having a first or left side $\mathbf{78}_A$, a second or right side $\mathbf{78}_B$, a third or top side $\mathbf{78}_C$, and a fourth or lower side $\mathbf{78}_D$. The third or top side $\mathbf{78}_C$ of the front panel portion 78 is defined by a first flared portion 78*a* and a second flared portion 78*b*. The first flared portion 78*a* of the front panel portion 78 is connected to the first front flared portion 76*a* of the top panel portion 76 by the fold line $\mathbf{86}_1$. The second flared portion 78*b* of the front panel portion 78 is connected to the second front flared portion 76*b* of the top panel portion 76 by the fold line $\mathbf{86}_2$.

The front panel portion 78 is defined by a height dimension $H_{78}$. The height dimension $H_{78}$ extends between the fourth or lower side $\mathbf{78}_D$ of the front panel portion 78 and the third or top side $\mathbf{78}_C$ of the front panel portion 78 defined by each of the first flare portion 78*a* and the second flared portion 78*b* of the front panel portion 78. The height dimension $H_{78}$ is approximately equal to but slightly greater than a height $H_{26}$ (see, e.g., FIGS. 20-21) of the second subassembly 26 extending between the outer surface $\mathbf{56}_O$ of the bottom wall 56 of the bowl portion 54 of the second container 20 and the upper surface $\mathbf{22}_U$ of the second seal 22 connected to the lip potion 70 of the second container 20.

Yet even further, the front panel portion 78 may be defined by a living hinge fold line 86. The living hinge fold line 86 extends across a width dimension of the front panel portion 78 from the first or left side $\mathbf{78}_A$ to the second or right side $\mathbf{78}_B$. Functionally, the living hinge fold line 86 acts as a living hinge that separates the front panel portion 78 into a first front panel portion $\mathbf{78}_1$ and a second front panel portion $\mathbf{78}_2$. As will be described in the following disclosure at FIGS. 31A-31D, when the optional packaging jacket 12 is arranged about the second subassembly 26, the front panel portion 78 may be arranged in one of two states being: (1) a relaxed state such that first front panel portion $\mathbf{78}_1$ is arranged at an obtuse angle θ relative the second front panel portion $\mathbf{78}_2$; and (2) a biased state such that the obtuse angle θ increases to approximately 180° whereby the first front panel portion $\mathbf{78}_1$ is coplanar with the second front panel portion $\mathbf{78}_2$.

Furthermore, the first or front opening 88 that is defined, in part, by the front panel portion 78 is defined by a length dimension and a height dimension that is sized for receiving and permitting passage of a portion of the third lip segment $\mathbf{70}_3$ of the lip portion 70 of the second container 20. The length dimension of the first or front opening 88 extends between the first flared portion 78*a* and the second flared portion 78*b* of the front panel portion 78. The height dimension of the first or front opening 88 extends between the third or top side $\mathbf{78}_C$ of the front panel portion 78 and an end of the top panel portion 76 that is opposite the third or top side $\mathbf{78}_C$ of the front panel portion 78.

As seen in FIGS. 22-23, the rear panel portion 80 is defined by a substantially trapezoidal shape having a first or left side $\mathbf{80}_A$, a second or right side $\mathbf{80}_B$, a third or top side $\mathbf{80}_C$, and a fourth or lower side $\mathbf{80}_D$. The third or top side $\mathbf{80}_C$ of the rear panel portion 80 is defined by a first flared portion 80*a* and a second flared portion 80*b*. The first flared portion 80*a* of the rear panel portion 80 is connected to the first rear flared portion 76*c* of the top panel portion 76 by the fold line $\mathbf{86}_3$. The second flared portion 80*b* of the rear panel portion 80 is connected to the second rear flared portion 76*d* of the top panel portion 76 by the fold line $\mathbf{86}_4$.

The rear panel portion 80 is defined by a height dimension $H_{80}$. The height dimension $H_{80}$ extends between the fourth or lower side $\mathbf{80}_D$ of the rear portion 80 and the third or top side $\mathbf{80}_C$ of the rear panel portion 80 defined by each of the first flare portion 80*a* and the second flared portion 80*b* of the rear panel portion 80. The height dimension $H_{80}$ is approximately equal to but slightly greater than the height $H_{26}$ (see, e.g., FIGS. 20-21) of the second subassembly 26 extending between the outer surface $\mathbf{56}_O$ of the bottom wall 56 of the bowl portion 54 of the second container 20 and the upper surface $\mathbf{22}_U$ of the second seal 22 connected to the lip potion 70 of the second container 20.

As seen in FIGS. 22-23, and, in one embodiment, the rear panel portion 80 does not include a living hinge defined by a fold line. Furthermore, in some configurations, the height dimension $H_{80}$ of the rear panel portion 80 may be about the same but slightly less than the height dimension $H_{78}$ of the front panel portion 78. In an example, the height dimension $H_{80}$ of the rear panel portion 80 may be equal to approximately about two-and-three-quarter inches and the height dimension $H_{78}$ of the front panel portion 78 may be approximately equal to two-and-thirteen-sixteenths inches (whereby the a height dimension $H_{78\text{-}1}$ of the first front panel portion $\mathbf{78}_1$ is approximately about two inches and a height dimension $H_{78\text{-}2}$ of the second front panel portion $\mathbf{78}_2$ is approximately about one-and-fifteen-sixteenths inches). As will be described in the following disclosure, the respective sizing of the height dimensions $H_{78}$, $H_{80}$ and the living hinge 86 formed by the front panel portion 78 permits the optional packaging jacket 12 to be retained about the second subassembly 26 while also permitted a user to dispose a finger or object between the bottom panel portion 82 and the outer surface $\mathbf{56}_O$ of the bottom wall 56 of the bowl portion 54 of the second container 20 for separating the packaging jacket 12 from the second subassembly 26 as seen in FIGS. 31A-31L.

Furthermore, the second or rear opening 90 that is defined, in part, by the rear panel portion 80 is defined by a length dimension and a height dimension that is sized for receiving and permitting passage of a portion of the fourth lip segment $70_4$ of the lip portion 70 of the second container 20. The length dimension of the second or rear opening 90 extends between the first flared portion 80*a* and the second flared portion 80*b* of the rear panel portion 80. The height dimension of the second or rear opening 90 extends between the third or top side $80_C$ of the rear panel portion 80 and an end of the top panel portion 76 that is opposite the third or top side $80_C$ of the rear panel portion 80.

As seen in FIGS. 22-23, the bottom panel portion 82 is defined by a substantially square shape having first or left side $82_A$, a second or right side $82_B$, a third or top side $82_C$, and a fourth or lower side $82_D$. The third or top side $82_C$ of the bottom panel portion 82 is connected to the fourth or lower side $78_D$ of the front panel portion 78 by the fold line $86_5$.

The bottom panel portion 82 may be further defined by a pre-weakened portion 92 extending across, for example, a central region of the bottom panel portion 82 from the first or left side $82_A$ of the bottom panel portion 82 to the second or right side $82_B$ of the bottom panel portion 82. The pre-weakened portion 92 may be defined by, for example, a plurality of cuts or scores extending partially or entirely through the thickness of the blank of material 74.

The pre-weakened portion 92 may be further defined by a first row of cuts or scores $92_{R1}$ extending partially or entirely through the thickness $T_{74}$ of the blank of material 74 and a second row of cuts or scores $92_{R2}$ extending partially or entirely through the thickness $T_{74}$ of the blank of material 74. Both of the first row of cuts or scores $92_{R1}$ and the second row of cuts or scores $92_{R2}$ extending partially or entirely through the thickness of the blank of material 74 extend across the bottom panel portion 82 from the first or left side $82_A$ of the bottom panel portion 82 to the second or right side $82_B$ of the bottom panel portion 82.

The first row of cuts or scores $92_{R1}$ are spaced apart from second row of cuts or scores $92_{R2}$ by a distance $D_{92}$ for causing the bottom panel portion 82 to define a tear strip 94. Accordingly, the distance $D_{92}$ between the first row of cuts or scores $92_{R1}$ and the second row of cuts or scores $92_{R2}$ may define a width of the tear strip 94.

In an example, both of first row of cuts or scores $92_{R1}$ and the second row of cuts or scores $92_{R2}$ extend substantially linearly from the first or left side $82_A$ of the bottom panel portion 82 to the second or right side $82_B$ of the bottom panel portion 82 such that the spaced-apart distance $D_{92}$ remains constant with the exception of, for example, a central region of each of the first row of cuts or scores $92_{R1}$ and the second row of cuts or scores $92_{R2}$ where spaced-apart distance increases to a maximum distance $D_{92}'$. For example, each of the first row of cuts or scores $92_{R1}$ and the second row of cuts or scores $92_{R2}$ may be defined by a V-shaped segment $92_{R1\text{-}V}$, $92_{R2\text{-}V}$ whereby a peak or point of each V-shaped segment $92_{R1\text{-}V}$, $92_{R2\text{-}V}$ diverges or points in opposite directions. In an example, the peak or point of the V-shaped segment $92_{R1\text{-}V}$ of the first row of cuts or scores $92_{R1}$ points toward an upper edge $82_C$ of the bottom panel portion 82, and the peak or point of the V-shaped segment $92_{R2\text{-}V}$ of the second row of cuts or scores $92_{R2}$ points toward a lower edge $82_D$ of the bottom panel portion 82.

The pre-weakened portion 92 may yet be further defined by one or more cuts or scores 96 arranged perpendicularly with respect to the first row of cuts or scores $92_{R1}$ and the second row of cuts or scores $92_{R2}$. In an example, the one or more cuts or scores 96 may bifurcate the tear strip 94 into a first tear strip portion 94*a* and a second tear strip portion 94*b*. The first tear strip portion 94*a* may extend from the first or left side $82_A$ of the bottom panel portion 82 and terminate at the one or more cuts or scores 96 whereas the second tear strip portion 94*b* may extend from the second or right side $82_B$ of the bottom panel portion 82 and terminate at the one or more cuts or scores 96.

In an example, the one or more perpendicularly-arranged cuts or scores 96 may be arranged in, for example, the central region of each of the first row of cuts or scores $92_{R1}$ and the second row of cuts or scores $92_{R2}$. In yet another example, the one or more cut or scores 96 may be aligned with the peak or point of each V-shaped segment $92_{R1\text{-}V}$, $92_{R2\text{-}V}$. Collectively, the one or more perpendicularly-arranged cuts or scores 96 may extend across the maximum distance $D_{92}'$ between both of first row of cuts or scores $92_{R1}$ and the second row of cuts or scores $92_{R2}$.

Furthermore, the bottom panel portion 82 is defined by a height dimension $H_{82}$. The height dimension $H_{82}$ extends between the fourth or lower side $82_D$ of the bottom panel portion 82 and the third or top side $82_C$ of the bottom panel portion 82. The height dimension $H_{82}$ is approximately equal to but slightly greater than a width $W_{56}$ (see, e.g., FIGS. 12, 20) of the bottom wall 56 of the outer container 20 extending across the second axis $A_{20W}$-$A_{20W}$ that extends across the width $W_{20}$ of the second container 20.

As seen in FIGS. 22-23, the bottom lip panel portion 84 is defined by a substantially rectangular shape having first or left side $84_A$, a second or right side $84_B$, a third or top side $84_C$, and a fourth or lower side $84_D$. The third or top side $84_C$ of the bottom lip panel portion 84 is connected to the fourth or lower side $80_D$ of the rear panel portion 80 by the fold line $86_6$. The front surface $74_F$ of the blank of material 74 defined by the bottom lip panel portion 84 may include, for example, an adhesive A (see, e.g., FIG. 22) that is disposed adjacent an adhesive-receiving region A' (see, e.g., FIG. 23) of the rear surface $74_R$ of the blank of material 74 extending from the fourth or lower side $82_D$ of the bottom panel portion 82 for securing the blank of material 74 about the outer container 20 in the form of the packaging jacket 12 whereby the portion of the third lip segment $70_3$ of the lip portion 70 of the second container 20 is registered within the first or front opening 88 of the blank of material 74 and the portion of the fourth lip segment $70_3$ of the lip portion 70 of the second container 20 is registered within the second or rear opening 90 of the blank of material 74.

Figure 31A:
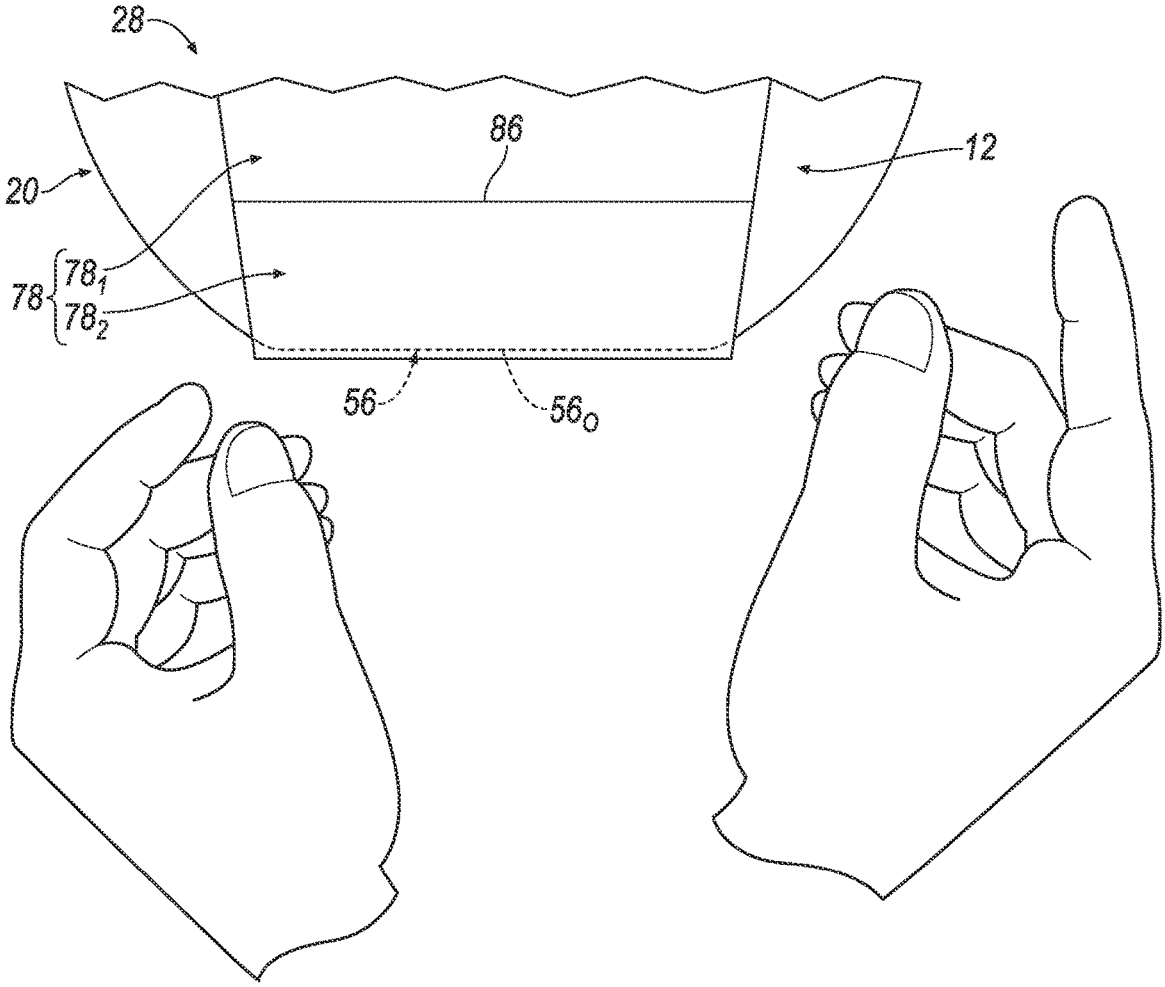
FIGS. 31A-31L are views of an exemplary methodology for breaking and removing the optional packaging jacket of FIGS. 24-30 from the packaging assembly.
Figure 31B:
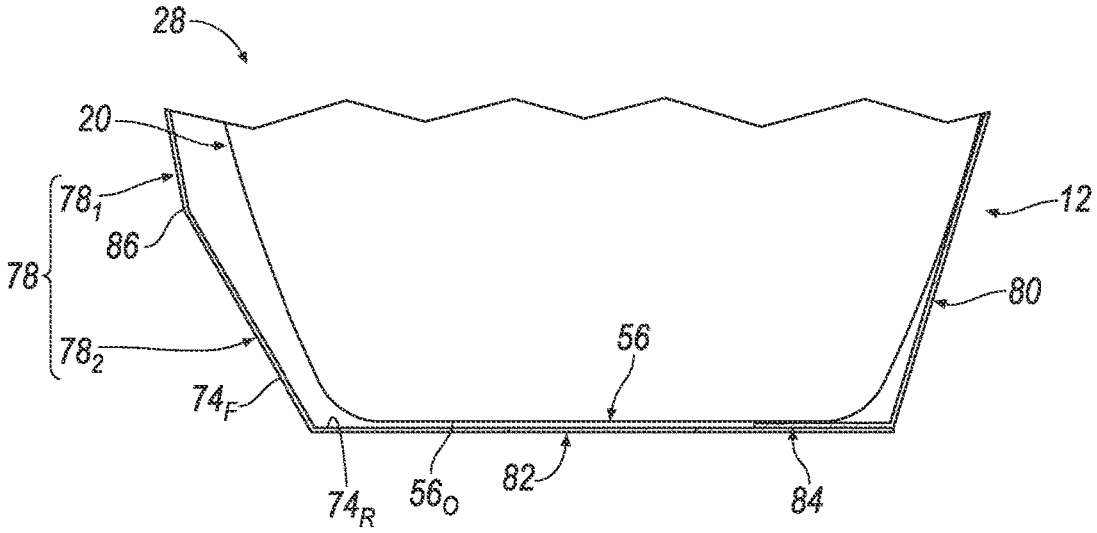
Figure 31C:
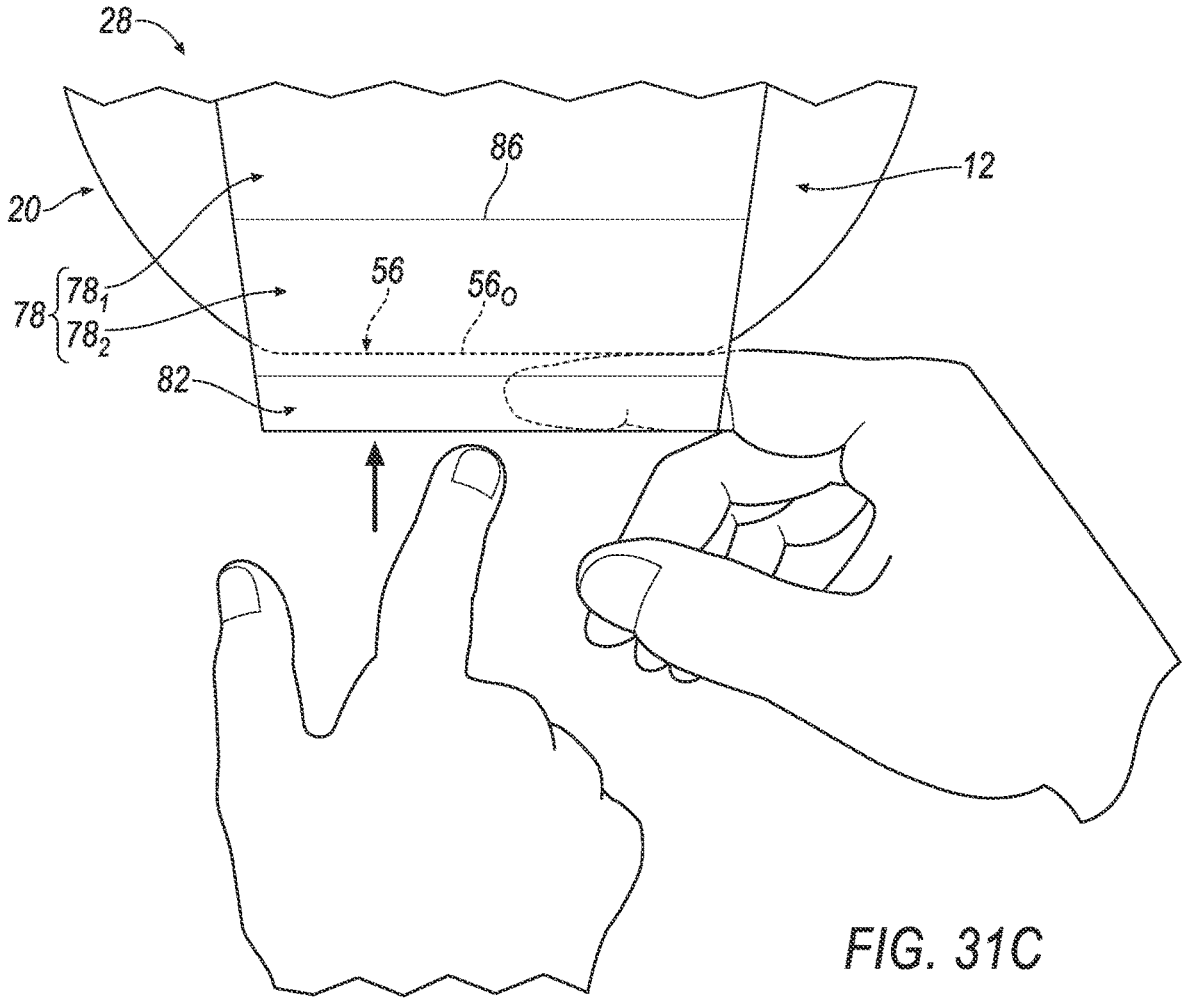
Figure 31D:
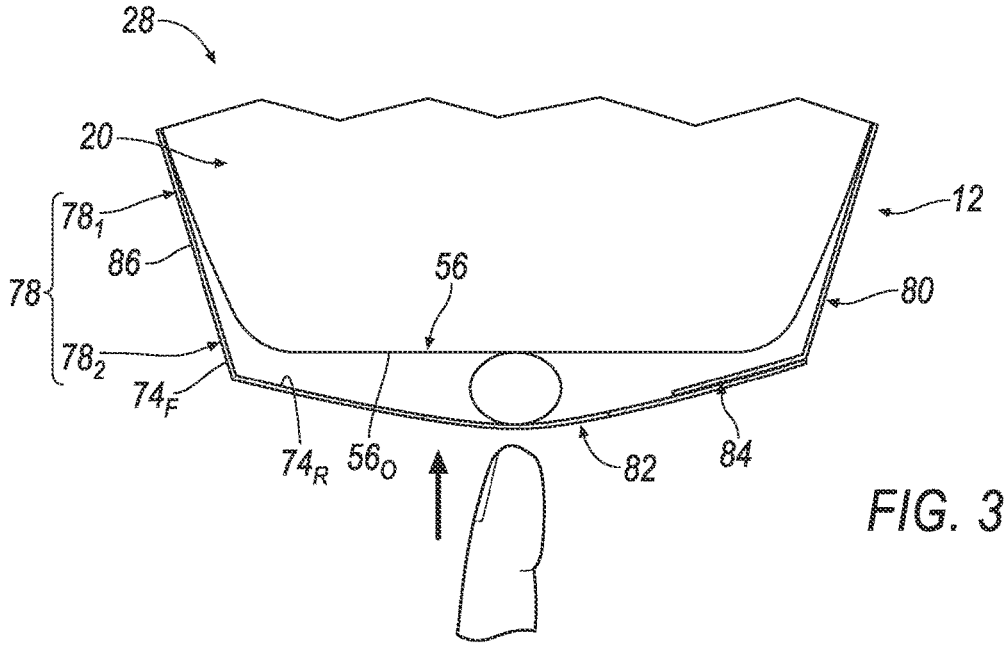
Figure 31E:
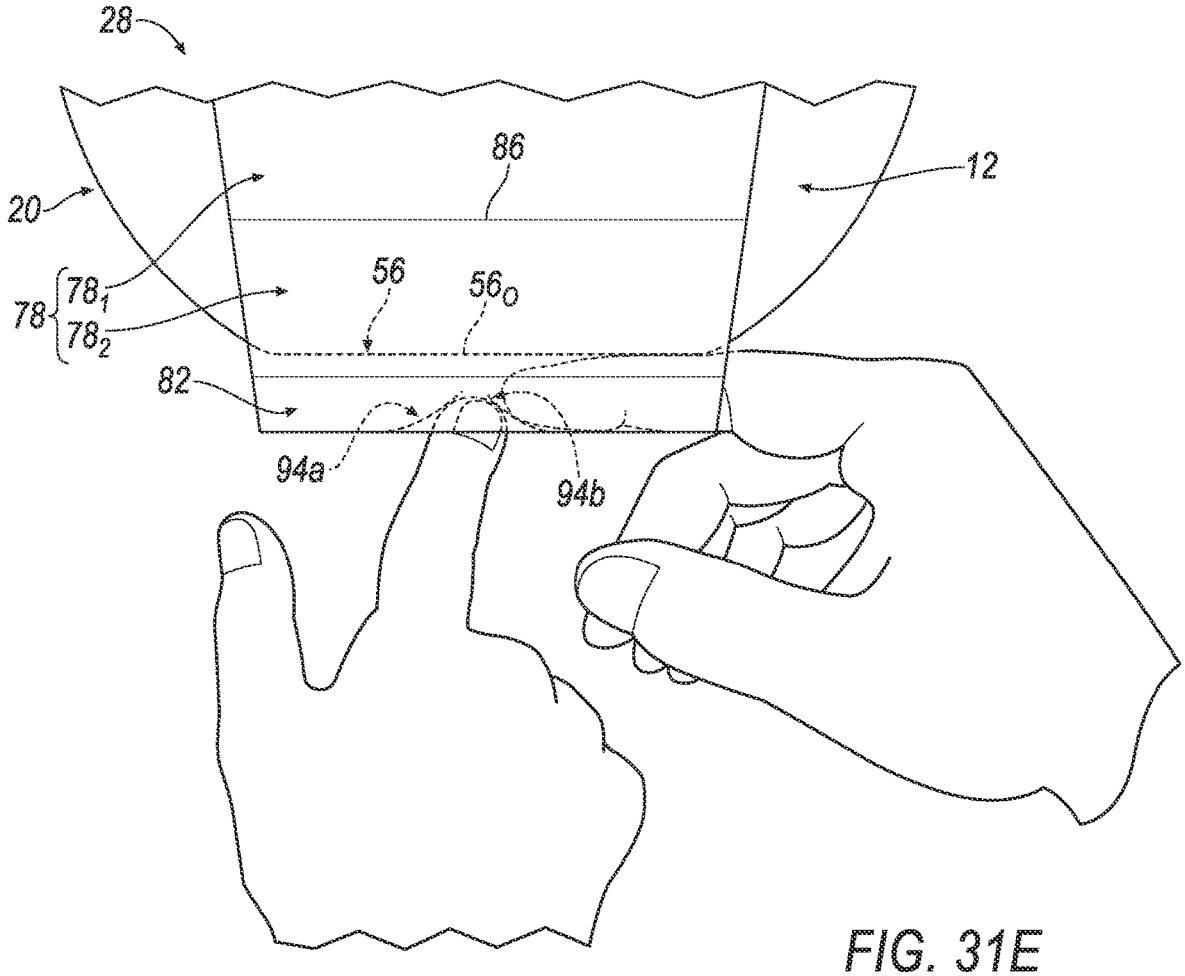
Figure 31F:
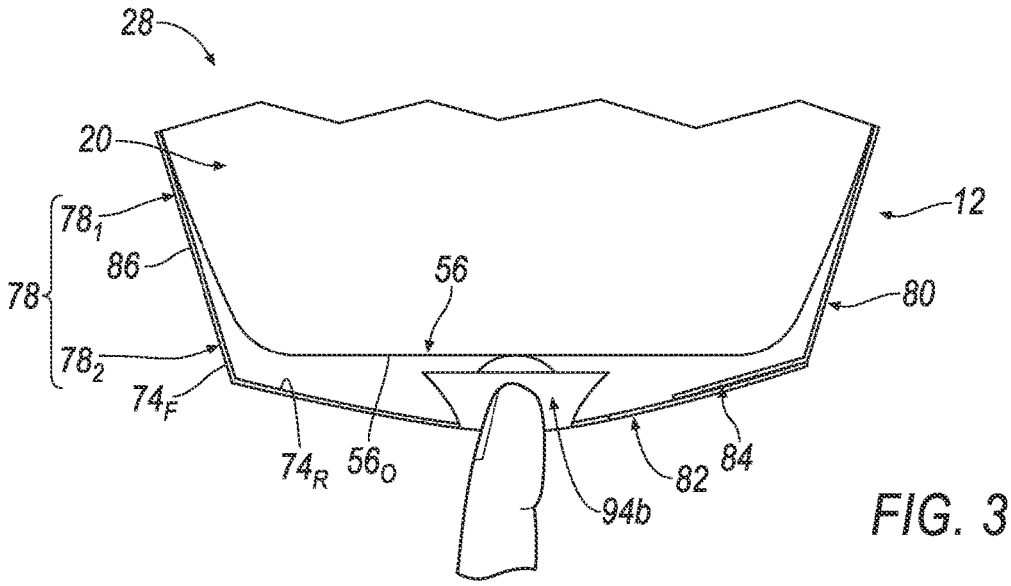
Figure 31G:
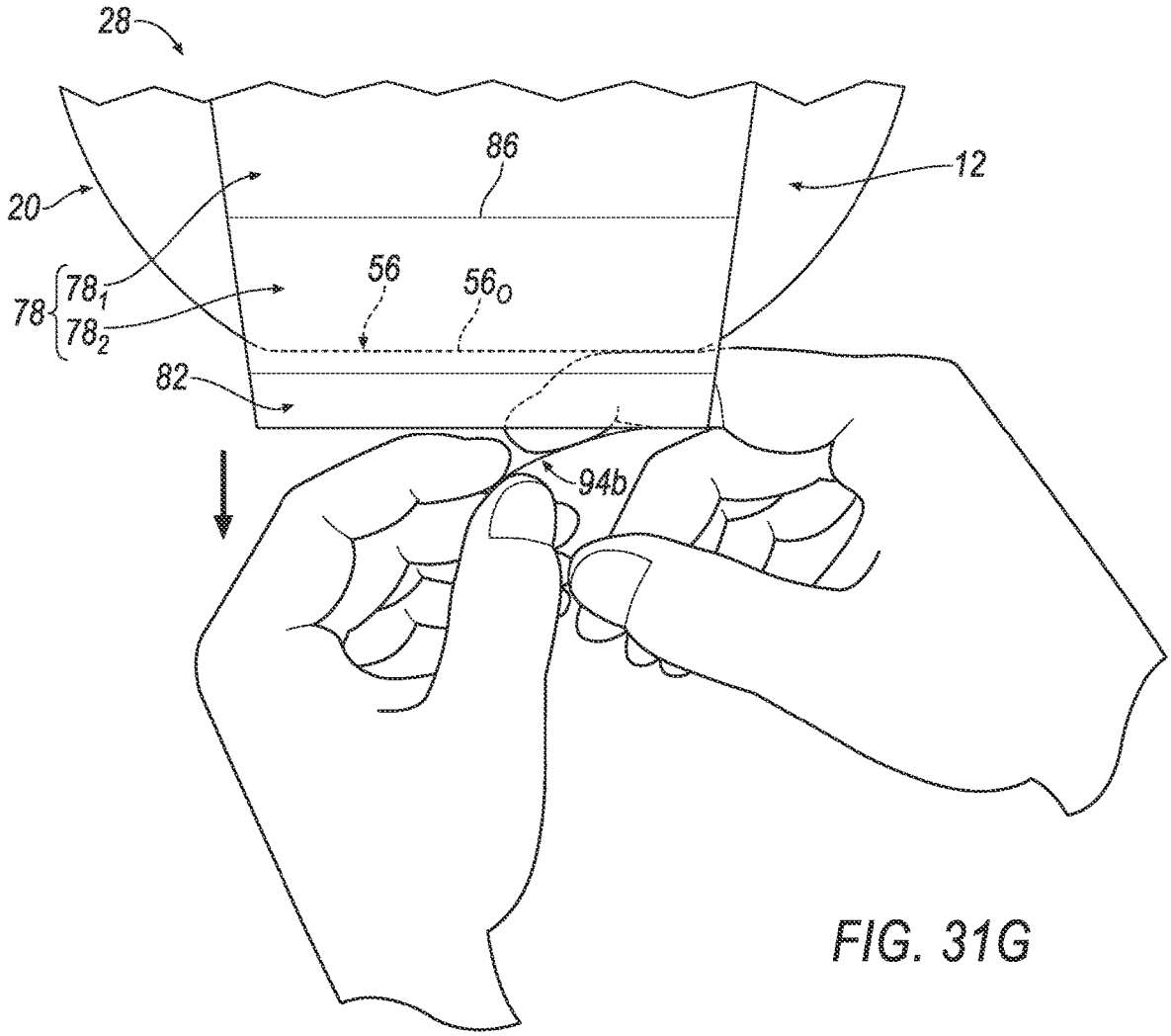
Figure 31H:
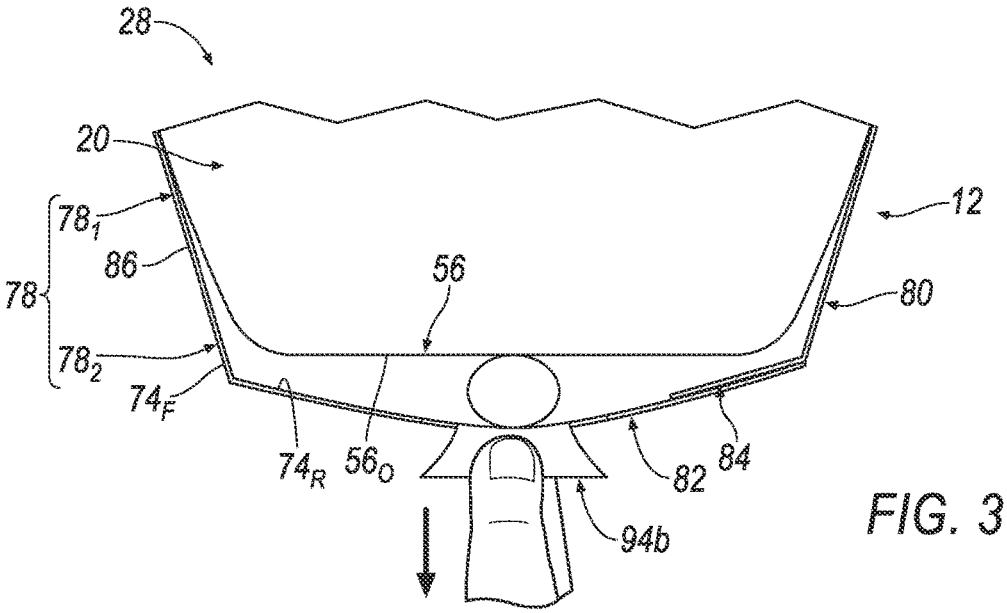
Figure 31I:
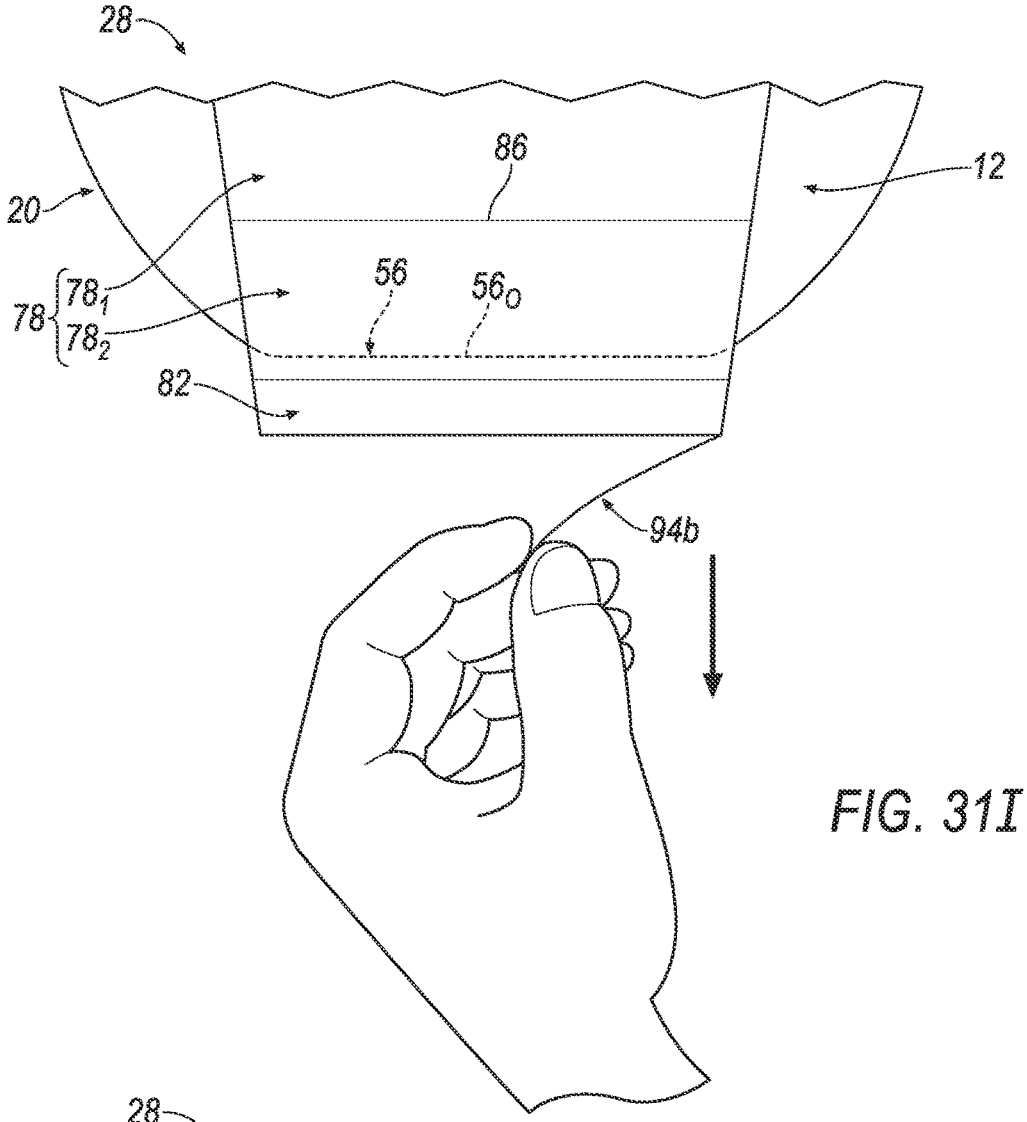
Figure 31J:
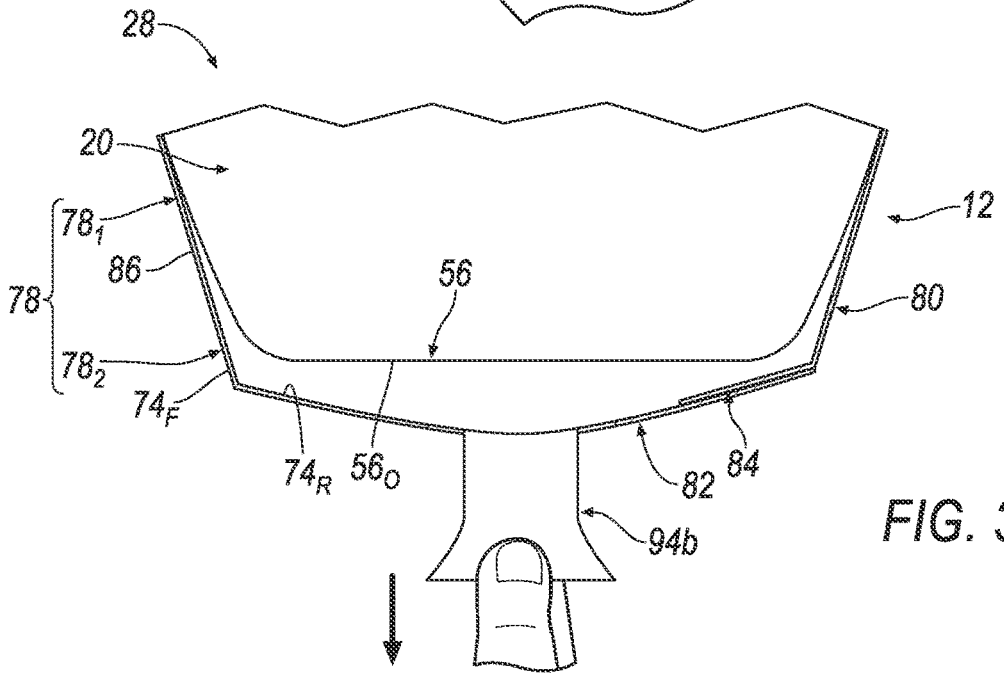
Figure 31K:
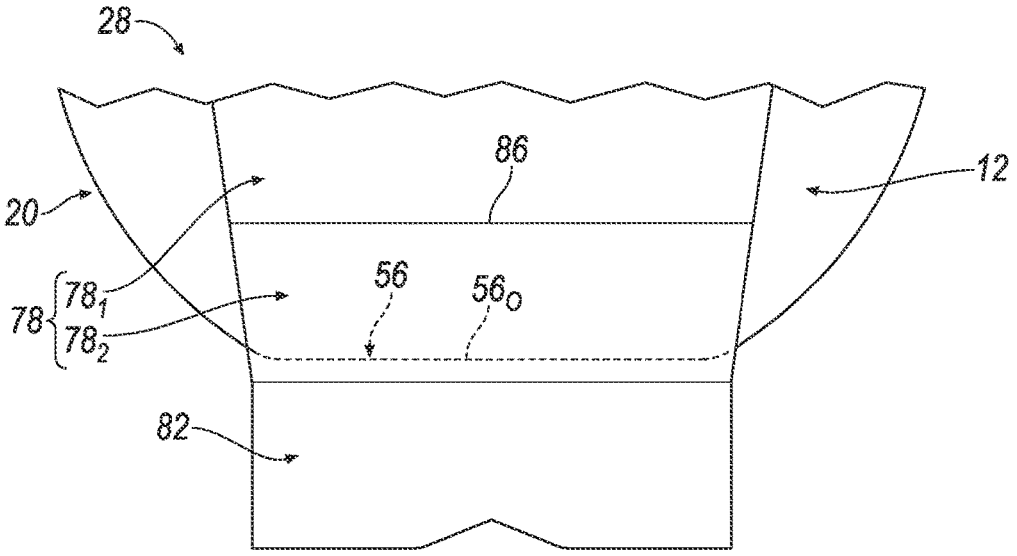
Figure 31L:
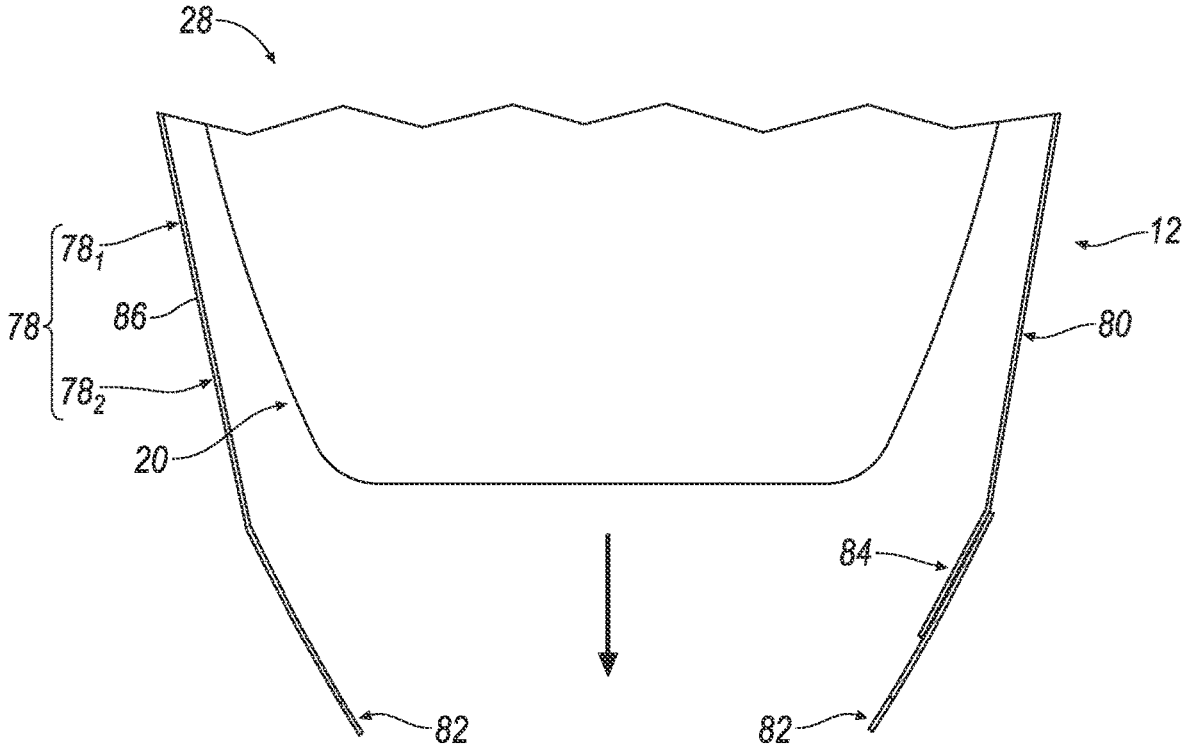
Figure 31M:
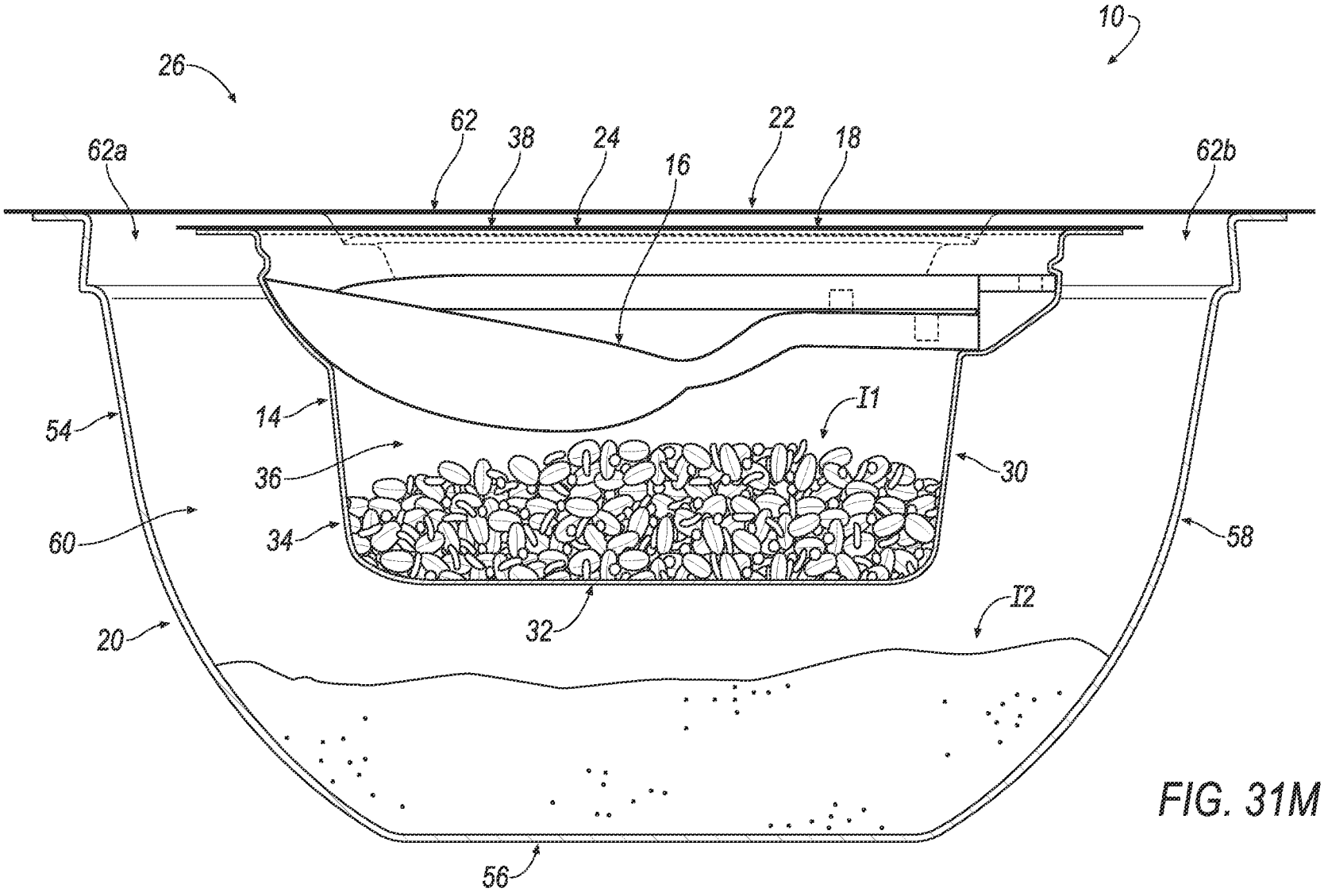
FIGS. 31M-31N are views of an exemplary methodology for removing the second seal from the second container of the subassembly of FIG. 19.
Figure 31N:
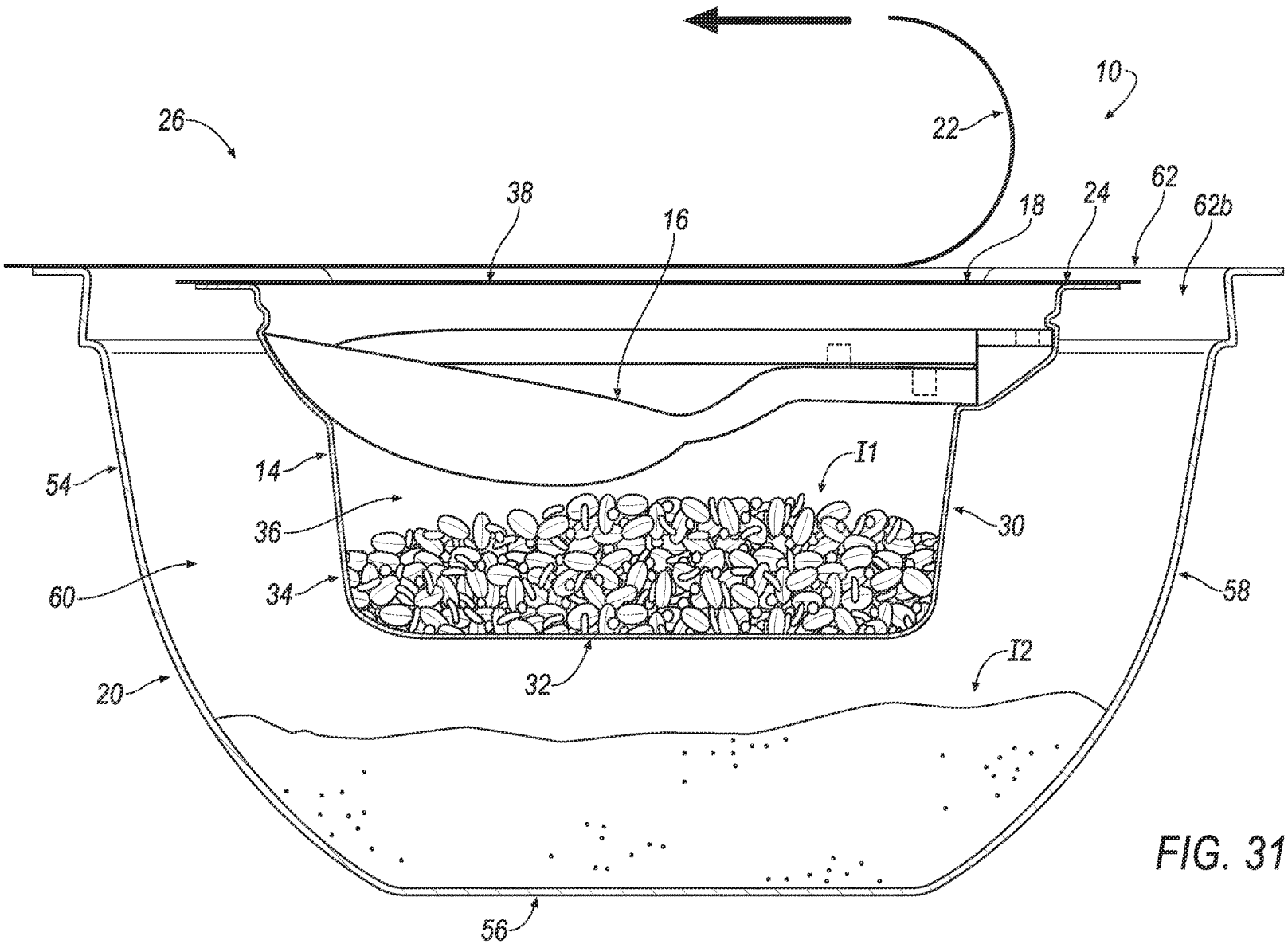
Figure 31O:
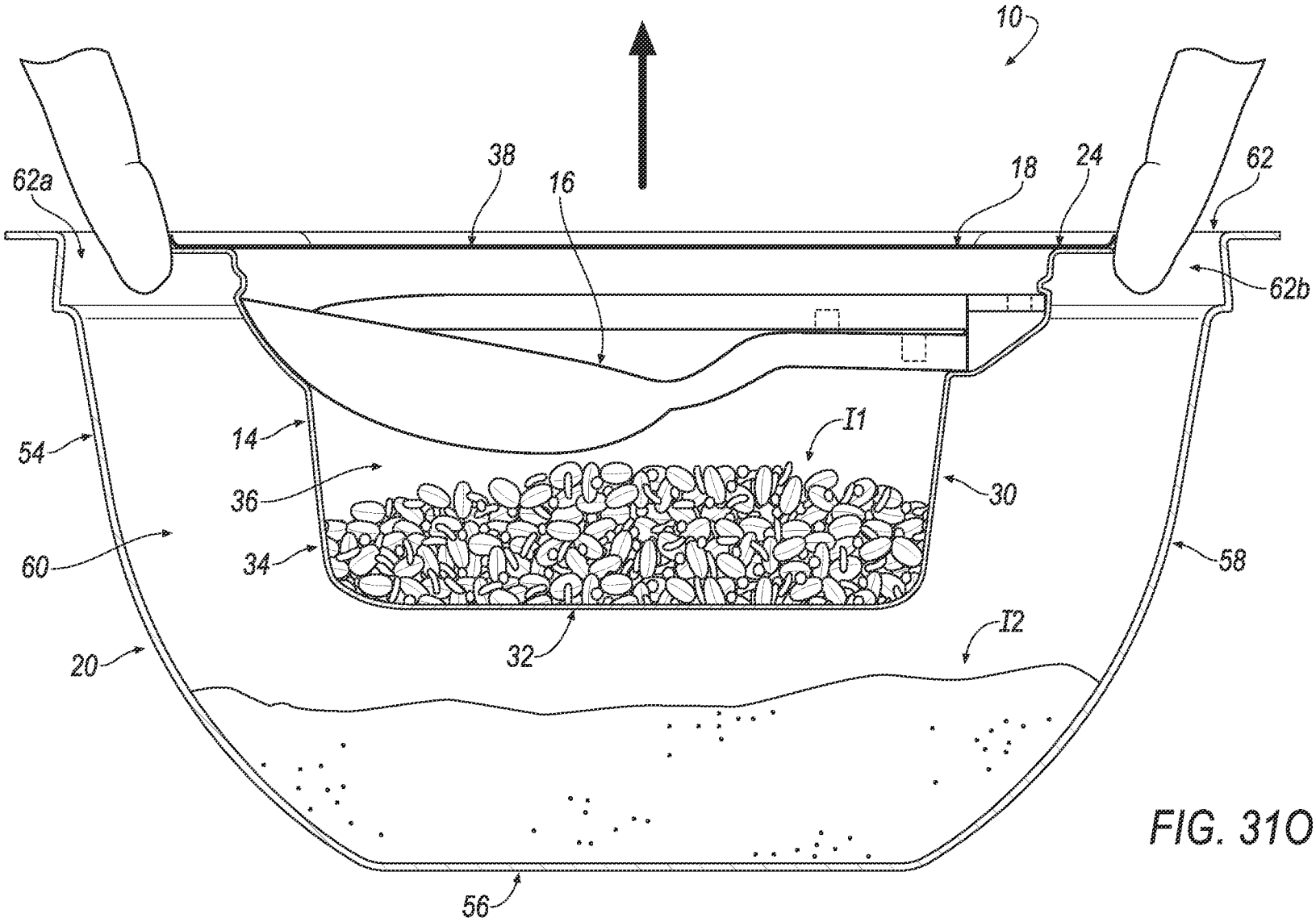
FIGS. 31O-31P is a view of an exemplary methodology for removing the subassembly of FIG. 10 including the first container from the cavity of the second container according to the subassembly of FIG. 16.
Figure 31P:
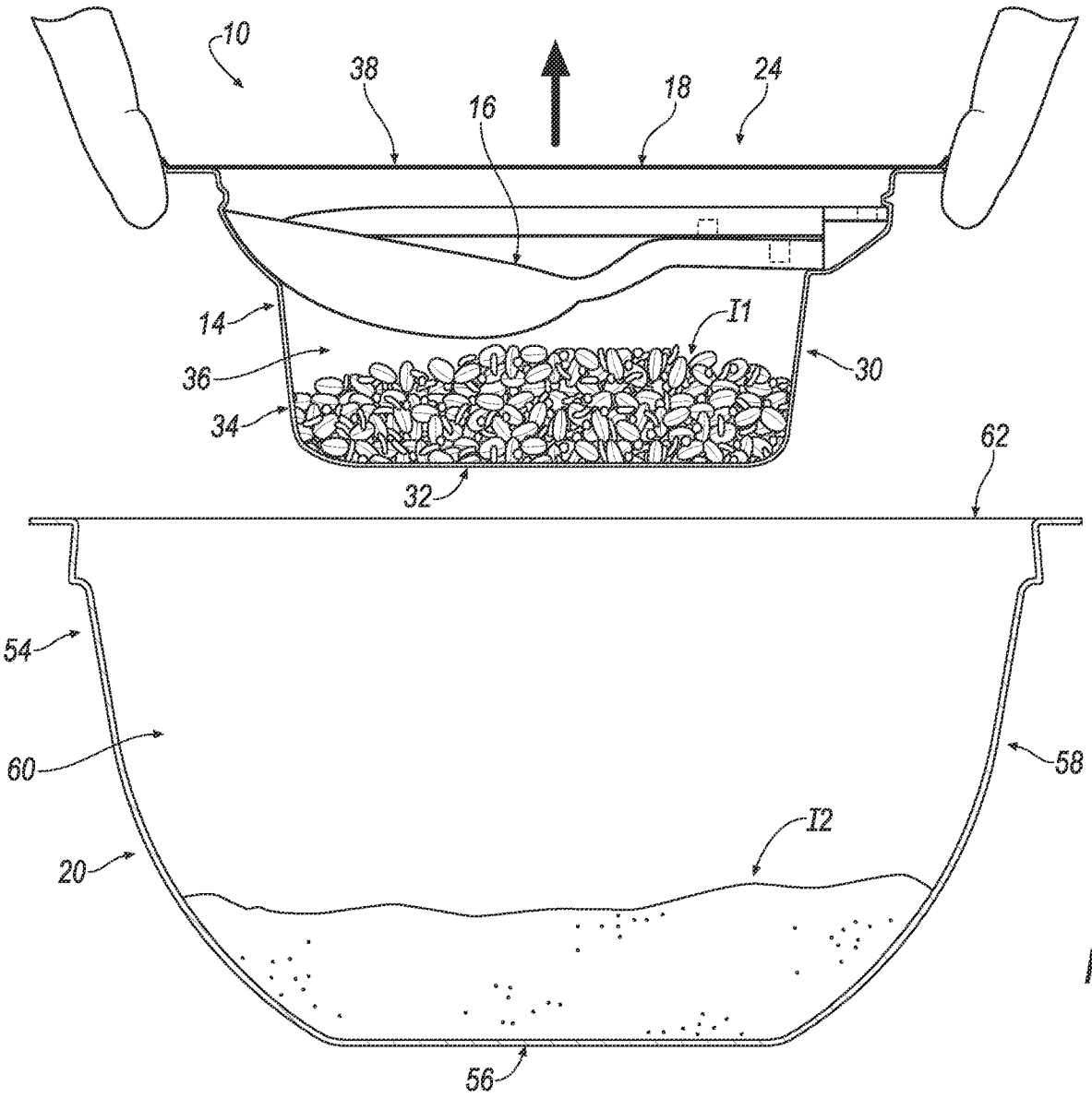
Figure 31Q:
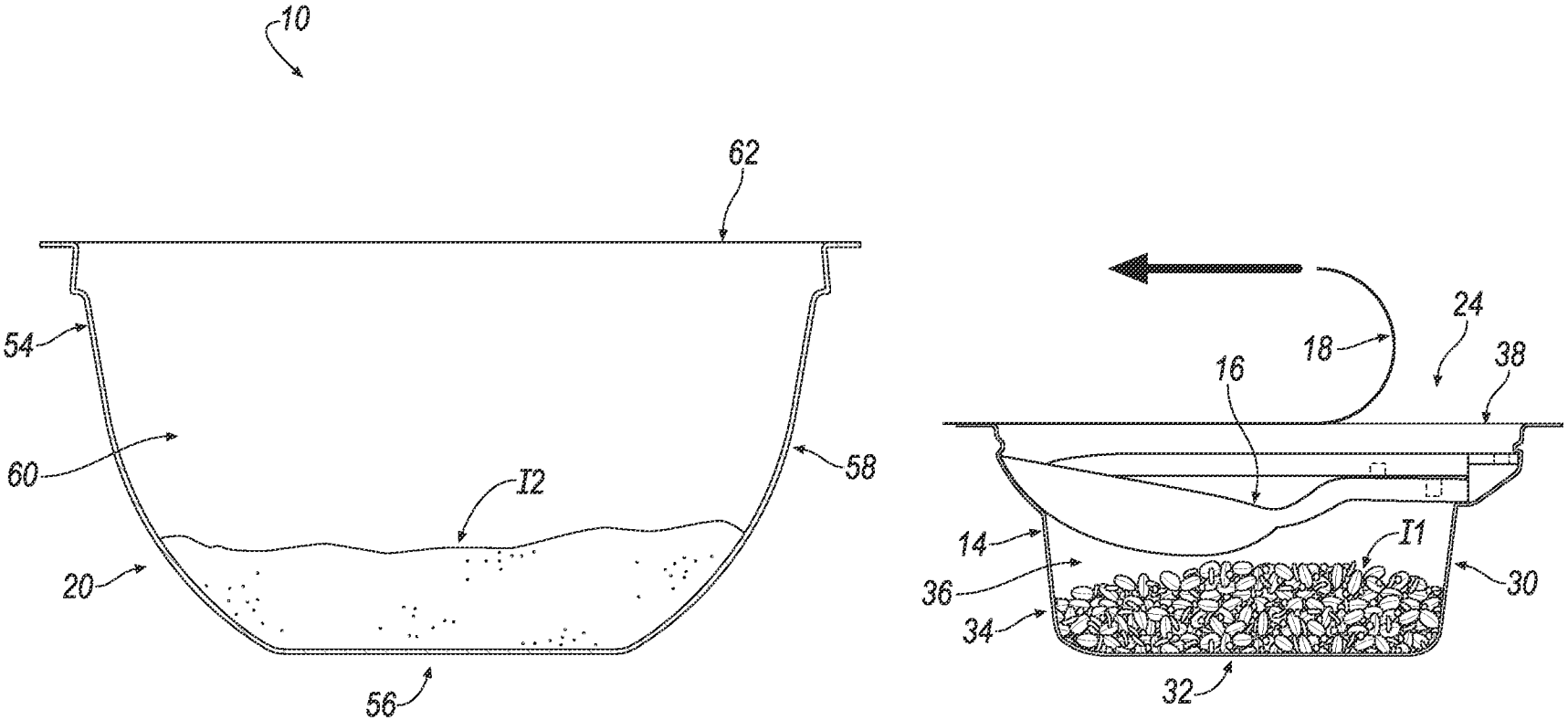
FIG. 31Q is a view of an exemplary methodology for removing the first seal from the first container of the subassembly of FIG. 10.
Figure 31R:
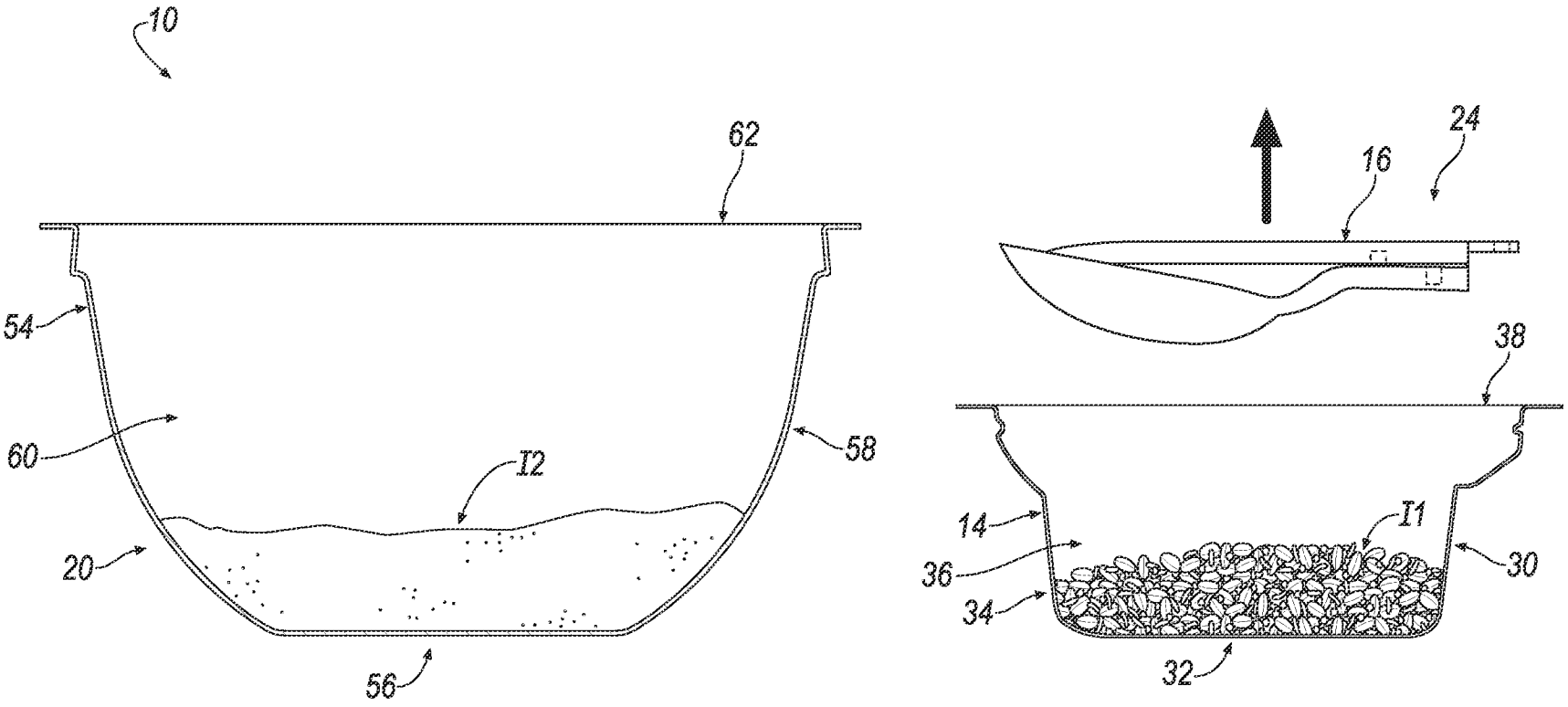
FIG. 31R is a view of an exemplary methodology for removably-separating the utensil from the first container of the subassembly of FIG. 6.
Figure 31S:
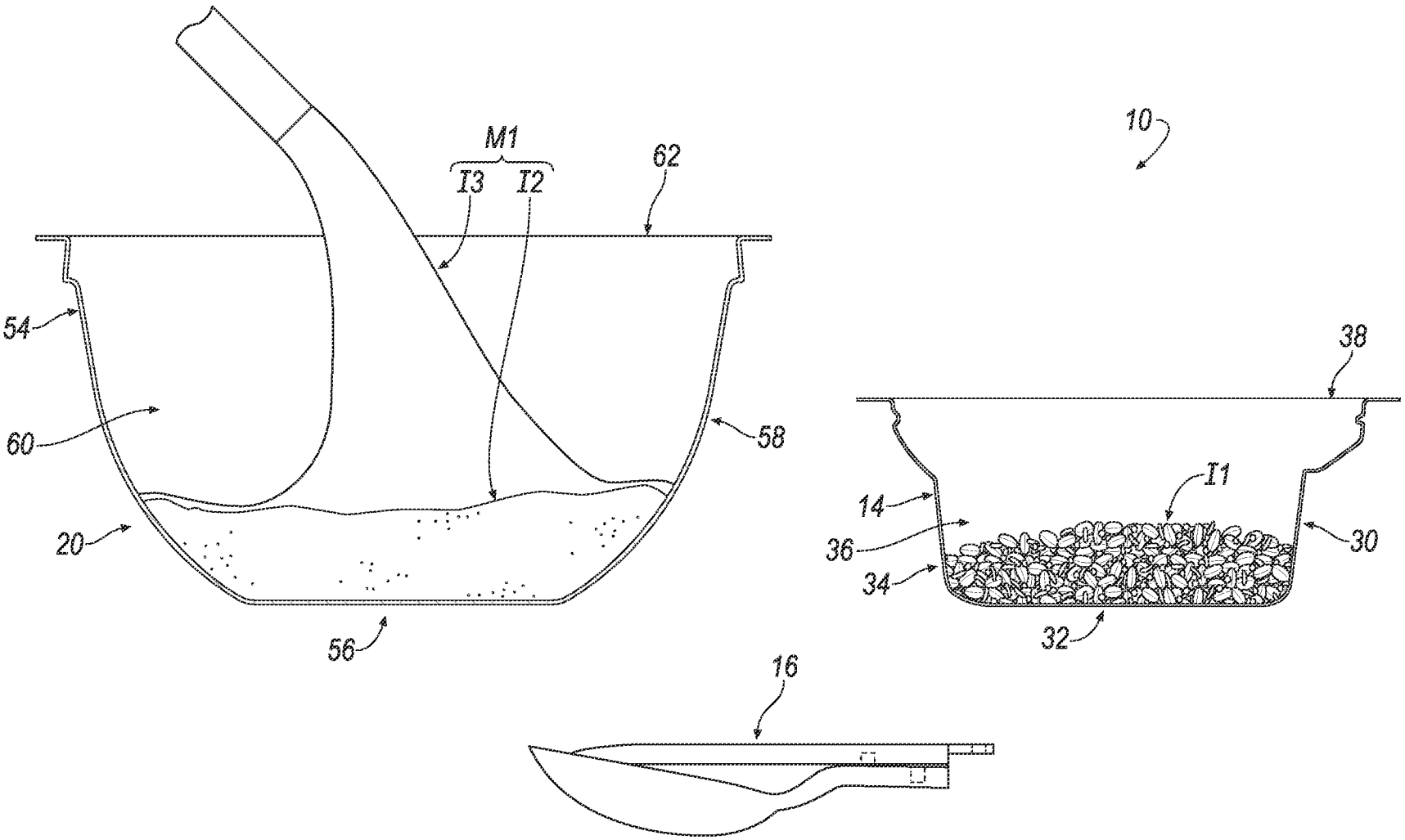
FIG. 31S is a view of an exemplary methodology for preparing a first meal mixture of a meal by adding an additional ingredient to the second ingredient contained within the cavity of the second container.
Figure 31T:
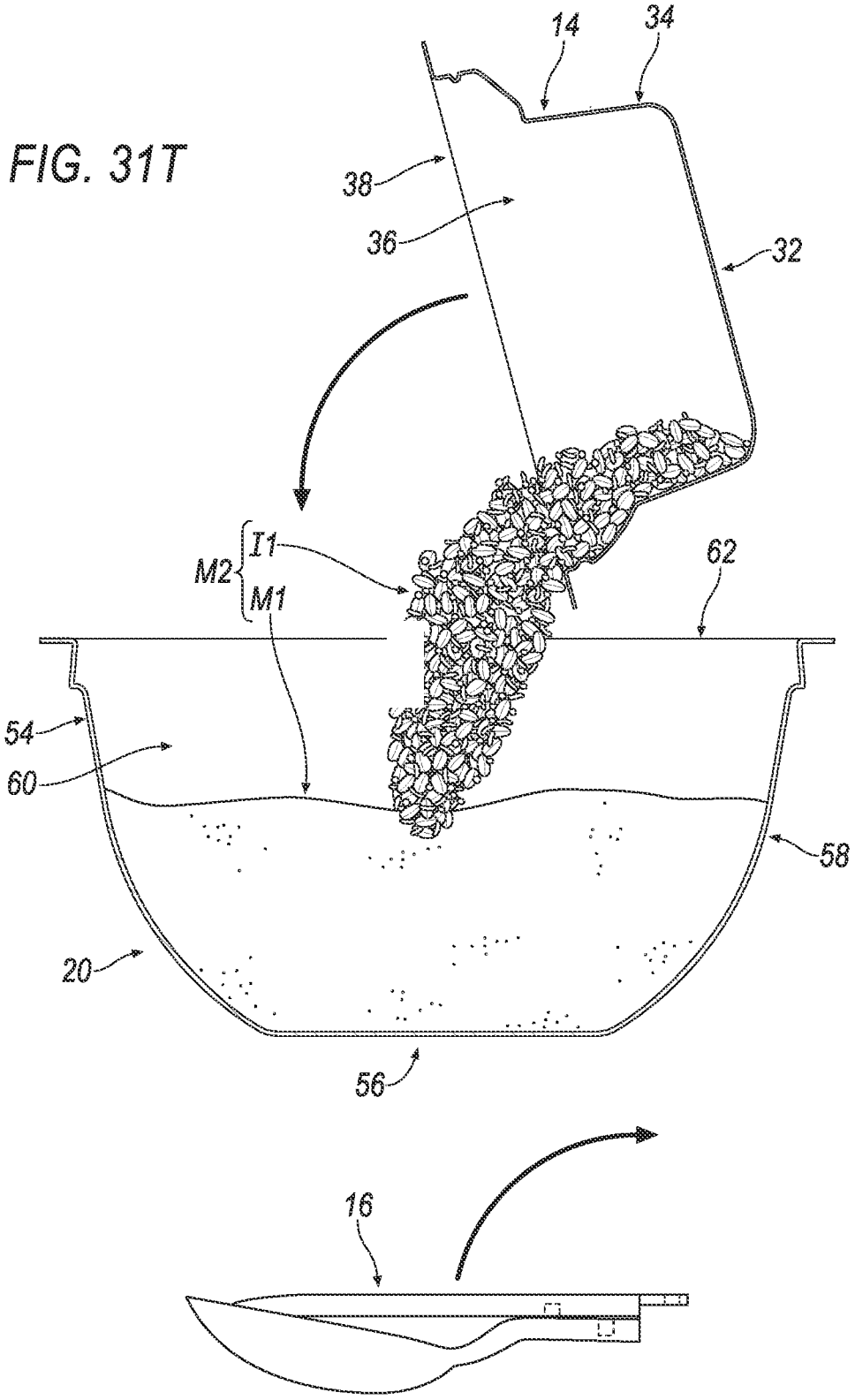
FIG. 31T is a further view of the exemplary methodology for preparing the meal by adding the first ingredient to the first meal mixture of FIG. 31S for defining a second meal mixture.
Figure 31U:
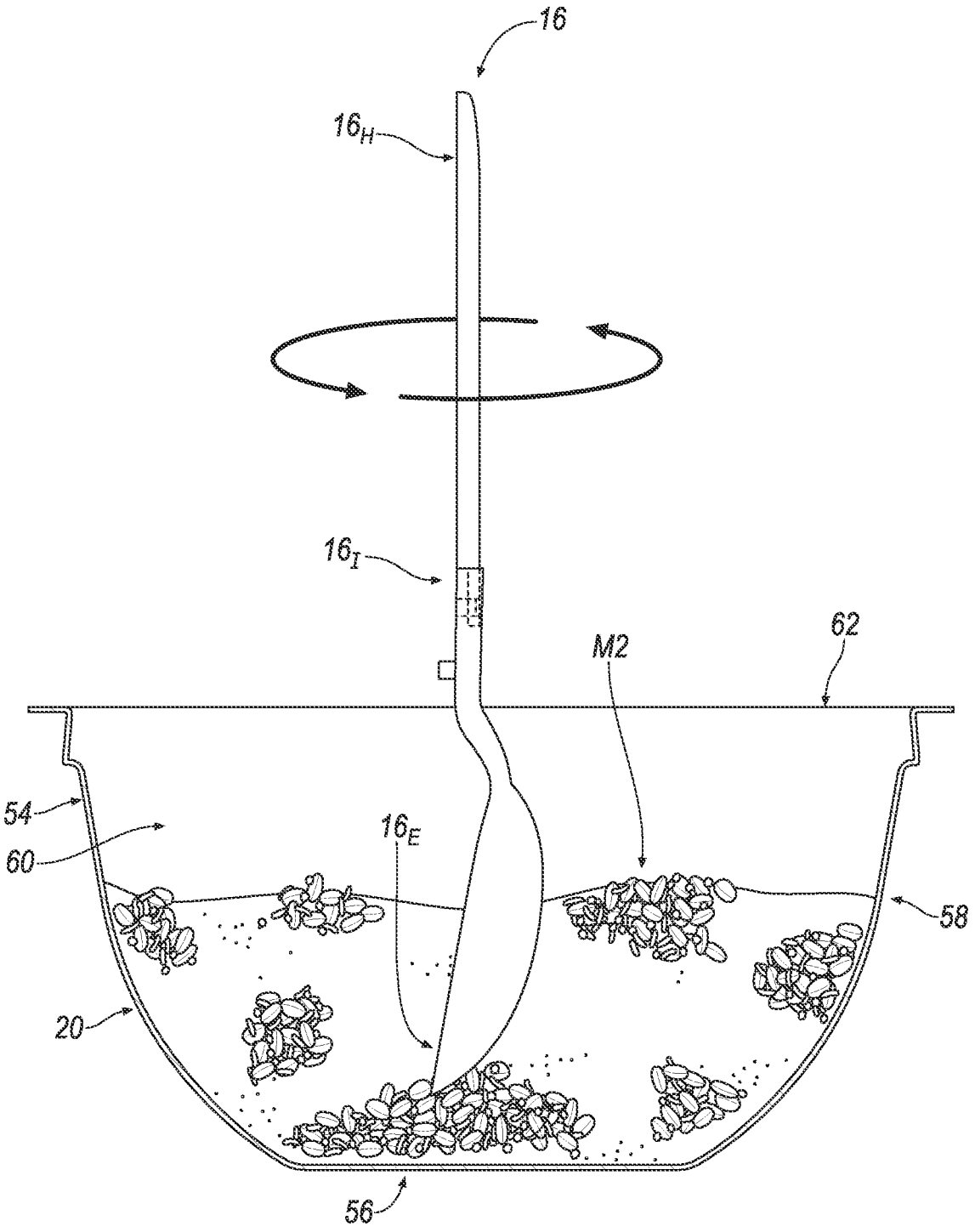
FIG. 31U is a further view of the exemplary methodology for preparing the meal by converting the utensil from the stowed orientation to a deployed orientation and then utilizing the utensil for stirring the second meal mixture of FIG. 31T for forming the meal.
Figure 31V:
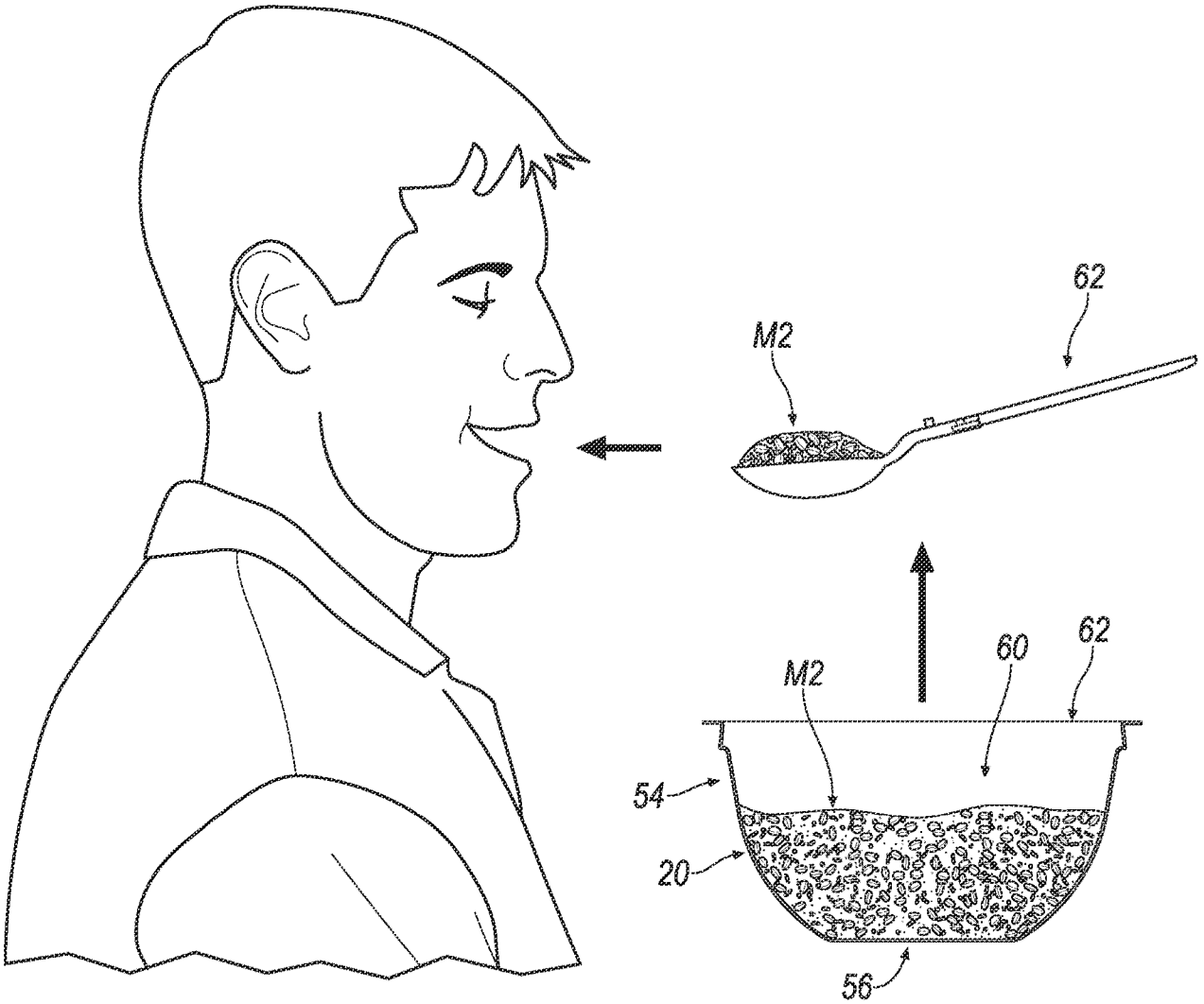
FIG. 31V is a view of an exemplary methodology for utilizing the utensil for consuming the meal of FIG. 31U.

Referring to FIGS. 31A-31V, a method for utilizing the packaging assembly 10 or meal preparation kit is described. If the packaging jacket 12 is not included in the design of the packaging assembly 10 or meal preparation kit, the methodology may be initiated according to the view seen at FIG. 31M. However, if the packaging jacket 12 is included in the design of the packaging assembly 10 or meal preparation kit, the methodology may begin according to the view seen at FIG. 31A.

Firstly, with reference to FIGS. 31A-31D, a user may separate the optional packaging jacket 12 from the second subassembly 26. In an example, as seen in FIGS. 31A-31D, a user may firstly position the bottom panel portion 82 at a distance away from the outer surface $56_O$ of the bottom wall 56 of the bowl portion 54 of the second container 20 by inserting a finger or object between the bottom panel portion 82 away from the outer surface $56_O$ of the bottom wall 56 of the bowl portion 54 of the second container 20. Thereafter, as seen in FIGS. 31E-31F, the user may centrally bifurcate the tear strip 94 defined by the pre-weakened portion 92 by driving another finger or object through the central region of the pre-weakened portion 92 of the bottom panel portion 82.

The central region of the pre-weakened portion 92 of the bottom panel portion 82 may be defined by, for example, the maximum distance $D_{92}'$ extending between the V-shaped segments $\mathbf{92}_{R1\text{-}V}$, $\mathbf{92}_{R2\text{-}V}$ respectively defined by the first row of cuts or scores $\mathbf{92}_{R1}$ and the second row of cuts or scores $\mathbf{92}_{R2}$ where spaced-apart distance increases to a maximum distance $D_{92}'$. In an example, the maximum distance $D_{92}'$ extending between the V-shaped segments $\mathbf{92}_{R1\text{-}V}$, $\mathbf{92}_{R2\text{-}V}$ may be sized for permitting a finger of a user to pass through the tear strip 94 whereas the distance $D_{92}$ between the first row of cuts or scores $\mathbf{92}_{R1}$ and the second row of cuts or scores $\mathbf{92}_{R2}$ for the remainder of the tear strip 94 is not sufficiently wide enough for permitting a finger or digit of a user to pass through the tear strip 94.

Once the pre-weakened portion 92 of the bottom panel portion 82 has been centrally bifurcated, the tear strip 94 is defined by the first tear strip portion 94*a* and the second tear strip portion 94*b*. Bifurcation of the tear strip 94 into the first tear strip portion 94*a* and the second tear strip portion 94*b* may be further defined, assisted or guided by the one or more perpendicularly-arranged cuts or scores 96.

With reference to FIGS. 31G-31L, with the central region of the bottom panel portion 82 acting as an origin for further disrupting, breaking or tearing along the pre-weakened portion 92, the first tear strip portion 94*a* and the second tear strip portion 94*b* may be separated from the bottom panel portion 82. In an example, the first tear strip portion 94*a* may be separated from the bottom panel portion 82 by pulling the first tear strip portion 94*a* in a direction from the central region of the bottom panel portion toward the first or left side $\mathbf{82}_A$ of the bottom panel portion 82. In another example, the second tear strip portion 94*b* may be separated from the bottom panel portion 82 by pulling the second tear strip portion 94*b* in a direction from the central region of the bottom panel portion toward the second or right side $\mathbf{82}_B$ of the bottom panel portion 82. Once the pre-weakened portion 92 has been disrupted, broken or torn along the first tear strip portion 94*a* and the second tear strip portion 94*b*, the packaging jacket 12 may be separated from the second subassembly 26.

Referring to FIG. 31M, with both of the first seal 18 and the second seal 22 secured respectively to the first container 14 and the second container 20, the first ingredient I1 contained within the first container 14 is segregated from the second ingredient I2 contained within the second container 20 while being contained in one package defined by the second subassembly 26 of the packaging assembly 10. Referring to FIG. 31N, the second seal 22 may be removed from the second container 20. Once the second seal 22 has been removed from the second container 20, the first subassembly 24 and the second ingredient I2 that is contained within the cavity 60 of the bowl portion 54 of the second container 20 is exposed to surrounding environment. Because the first seal 18 remains secured to the first container 14, the first ingredient I1 is still segregated from the second ingredient I2.

Referring to FIGS. 31O-31P, the user may then insert his/her fingers into the first C-shaped or crescent-shaped opening 62*a* and the second C-shaped or crescent-shaped opening 62*b* derived from the oval-shaped opening 62 of the bowl portion 54 of the second container 20 as a result of the lower surface $\mathbf{50}_L$ of the lip portion 50 defined by each of the third lip segment $\mathbf{50}_3$ and the fourth lip segment $\mathbf{50}_4$ of the first container 14 of the first subassembly 24 being respectively disposed adjacent and supported by embossed portion 68 of each of the third side wall portion $\mathbf{58}_3$ and the fourth side wall portion $\mathbf{58}_4$ of the bowl portion 54 of the second container 20. Thereafter, the user may then lift the first container 14 of the first subassembly 24 out of the cavity 60 of the bowl portion 54 of the second container 20.

Referring to FIG. 31Q, the first seal 18 may be removed from the first container 14. Once the first seal 18 has been removed from the first container 14, the utensil 16 and the first ingredient I1 that is contained within the cavity 36 of the bowl portion 30 of the first container 14 is exposed to surrounding environment. Referring to FIG. 31R, the user may then removably-detach the utensil 16 from being snap-fit retained to the bowl portion 30 of the first container 14 by way of the embossed portion 42 and debossed portion 44 of each of the first side wall portion $\mathbf{34}_1$ of the side wall 34 and the second side wall portion $\mathbf{34}_2$ of the side wall 34 of the bowl portion 30 of the first container 14.

As seen in FIG. 31S, the user may then optionally add a third ingredient I3 to the second ingredient I2 in order to create a first foodstuff mixture M1. In an example the user may pour the third ingredient I3 over the second ingredient I2 that is already contained within the cavity 60 of the second container 20. As seen in FIG. 31S, the third ingredient I3 may be poured into the cavity 60 by way of the opening 62 formed by the second container 20.

In an example, the third ingredient I3 may be a liquid (e.g., water, milk or the like) and the second ingredient I2 may be a powder or dehydrated foodstuff; the powder or dehydrated foodstuff may include but is not limited to, for example, a powder yogurt, a powder porridge, oatmeal or the like. With the utensil 16 separated from the first container 14, the user may utilize the utensil 16 for mixing or stirring the first foodstuff mixture M1. Alternatively, the act of pouring the third ingredient I3 into the cavity 60 of the second container 20 may mix the first foodstuff mixture M1 without utilization of the utensil 16.

As seen in FIG. 31T, the user may then optionally add the first ingredient I1 to the first foodstuff mixture M1 for forming a second foodstuff mixture M2. Alternatively, in another example, the user may add the first ingredient I1 to the second ingredient I2 without previously adding the third ingredient I3 in order to create an alternative first foodstuff mixture. In an example the user may pour the first ingredient I1 over the first foodstuff mixture M1 that is already contained within the cavity 60 of the second container 20. As seen in FIG. 31T, the first ingredient I1 may be poured from the cavity 36 of the first container 14 into the cavity 60 by way of the opening 62 formed by the second container 20.

In an example, the first ingredient I1 may be a dry or dehydrated foodstuff (e.g., granola, dried fruit, dried vegetables, nuts, chia seeds, hemps seeds or the like). Referring to FIG. 31U, with the utensil 16 separated from the first container 14, the user may utilize the utensil 16 for mixing or stirring the second foodstuff mixture M2. Alternatively, the act of pouring the first ingredient I1 into the cavity 60 of the second container 20 may mix the second foodstuff mixture M2 without utilization of the utensil 16.

As seen in FIGS. 31T-31U, prior to utilizing the utensil 16, the user may reconfigure the utensil 16 from the stowed configuration to a deployed configuration by unfolding the about the intermediate hinge portion $\mathbf{16}_I$ of the utensil 16. Accordingly, as seen in FIG. 31U, the user may utilize the utensil 16 for stirring the second foodstuff mixture M2 within the cavity 60 of the second container 20. In another example as seen in FIG. 31V, the user may utilize the utensil 16 for eating or consuming the second foodstuff mixture M2 from the cavity 60 of the second container 20.

By providing packaging assembly 10 that segregates a first ingredient I1 contained within the first container 14 from a second ingredient I2 contained within the second container 20, the taste and texture of first ingredients I1 may be retained while, for example, a first foodstuff mixture M1 including the second ingredient I2 and a third ingredient I3 (such as water or milk that is not contained within the packaging assembly 10) is being prepared. In an example, if the liquid defining the third ingredient is hot, or, if the preparation time (e.g., the act of stirring) of the first foodstuff mixture M1 is long, the first ingredient I1 may, for example, maintain a crunchy texture and not become soggy as a result of being separated from the second ingredient I2.

Furthermore, in some instances, the user may not like or desire the inclusion of the first ingredient I1 within the first foodstuff mixture M1; therefore, the user may prepare the first foodstuff mixture M1 and discard the first ingredient I1. Alternatively, the user may prepare the first foodstuff mixture M1 and save the first ingredient I1 for consumption at a later time as a snack; furthermore, because the first ingredient I1 is sealed within the first container 14 by the first seal 18, the freshness of the first ingredient I1 may be maintained when the first ingredient I1 is consumed at a later time as a snack.

A number of implementations have been described. Nevertheless, it will be understood that various modifications may be made without departing from the spirit and scope of the disclosure. Accordingly, other implementations are within the scope of the following claims.

What is claimed is:

1. An assembly comprising:

a container including a bowl portion defined by a bottom wall and a side wall extending from the bottom wall, wherein the side wall and the bottom wall are each defined by an inner surface that forms a cavity of the bowl portion; and a utensil disposed within the cavity and removably-secured to the inner surface of the side wall that defines the bowl portion of the container, wherein the inner surface of the side wall defines: a first utensil-retaining portion; and a second utensil-retaining portion arranged opposite the first utensil-retaining portion, wherein the utensil is defined by a first end and a second end, wherein the first end of the utensil is removably-secured to the first utensil-retaining portion, wherein the second end of the utensil is removably-secured to the second utensil-retaining portion, wherein the utensil is suspended over the inner surface of the bottom wall of the bowl portion at a distance, wherein the inner surface of the side wall defining each of the first utensil-retaining portion and the second utensil-retaining portion is defined by at least one snap-fit connection including an embossed portion and a debossed portion, wherein the side wall of the bowl portion is formed from a flexible material configured to permit the side wall of the bowl portion to flex outwardly and then inwardly when the debossed portion interferes with movement of an end of the utensil thereby creating a snap sound when the end of the utensil moves past or clears the debossed portion.

2. The assembly of claim 1 further including: foodstuff disposed within the cavity; and a seal secured over the cavity for sealing the utensil and the foodstuff within the cavity of the bowl portion from surrounding environment.

3. The assembly of claim 2 further including: a lip portion extending away from an upper end of the side wall, wherein the seal is secured to an upper surface of the lip portion and extends across an opening formed by the upper end of the side wall for sealing the cavity of the bowl portion from surrounding environment.

4. The assembly of claim 1, wherein the side wall is defined by a lower end and an upper end, wherein the lower end of the side wall extends from the bottom wall, wherein the upper end of the side wall forms an opening providing access to the cavity, wherein the container includes: a lip portion extending away from the upper end of the side wall.

5. The assembly of claim 4 further including: a seal secured to an upper surface of the lip portion and extending across the opening for sealing the cavity of the bowl portion from surrounding environment.

6. The assembly of claim 1, wherein the first utensil-retaining portion is sized for receiving a food-contacting portion defining the first end of the utensil, wherein the second utensil-retaining portion is sized for receiving an intermediate folding hinge of the utensil.

7. The assembly of claim 1, wherein the at least one snap-fit connection includes a first snap fit connection and a second snap-fit connection, wherein the first snap-fit connection includes a first embossed portion and a first debossed portion formed by a first portion of the side wall of the bowl portion, wherein the second snap-fit connection includes a second embossed portion and a second debossed portion formed by a second portion of the side wall of the bowl portion, wherein the first portion of the side wall of the bowl portion is arranged opposite the second portion of the side wall of the bowl portion.

8. The assembly of claim 7, wherein the first embossed portion forms a first ledge surface of the first portion of the side wall of the bowl portion that is sized for supporting a first end portion of the utensil, wherein the first debossed portion forms a first snap-fit retainer of the portion of the side wall of the bowl portion that is sized for snap-fit retaining the first end portion of the utensil, wherein the second embossed portion forms a second ledge surface of the second portion of the side wall of the bowl portion that is sized for supporting a second end portion of the utensil, wherein the second debossed portion forms a second snap-fit retainer of the portion of the side wall of the bowl portion that is sized for snap-fit retaining the second end portion of the utensil.

9. The assembly of claim 8, wherein the first end of the utensil is a food-contacting portion, wherein the second end of the utensil forms an intermediate folding hinge of the utensil.

10. The assembly of claim 8, wherein the first end of the utensil is a food-contacting portion, wherein the second end of the utensil forms a handle of the utensil, wherein the utensil does not include a folding hinge.

11. An assembly comprising:

a first container forming a first bowl portion defined by a bottom wall and a side wall extending from the bottom wall, wherein the side wall and the bottom wall are each defined by an inner surface that forms a cavity of the first bowl portion;

a utensil disposed within the cavity and removably-secured to the inner surface of the side wall that defines the first bowl portion of the first container; and a second container forming a second bowl portion defined by a bottom wall and a side wall extending from the bottom wall, wherein the side wall and the bottom wall of the second bowl portion are each defined by an inner surface that forms a cavity of the second bowl portion, wherein the first container is disposed within the cavity of the second bowl portion and partially closes out an opening formed by formed by an upper end of the side wall of the second bowl portion to define:

a first opening formed by the upper end of the side wall of the second bowl portion and an outer surface of the first container; and a second opening formed by the upper end of the side wall of the second bowl portion and an outer surface of the first container, wherein the inner surface of the side wall of the first container defines: a first utensil-retaining portion; and a second utensil-retaining portion arranged opposite the first utensil-retaining portion, wherein the utensil is defined by a first end and a second end, wherein the first end of the utensil is removably-secured to the first utensil-retaining portion, wherein the second end of the utensil is removably-secured to the second utensil-retaining portion, wherein the utensil is suspended over the inner surface of the bottom wall of the bowl portion at a distance, wherein the inner surface of the side wall defining each of the first utensil-retaining portion and the second utensil-retaining portion is defined by at least one snap-fit connection including an embossed portion and a debossed portion, wherein the side wall of the bowl portion of the first container is formed from a flexible material configured to permit the side wall of the bowl portion of the first container to flex outwardly and then inwardly when the debossed portion interferes with movement of an end of the utensil thereby creating a snap sound when the end of the utensil moves past or clears the debossed portion.

12. The assembly of claim 11, wherein the inner surface of the side wall of the second bowl portion defines opposing ledge surfaces that support opposing lip surface portions extending from the side wall of the first bowl portion of the first container.

13. The assembly of claim 11 further including: a first foodstuff disposed within the cavity of the first bowl portion of the first container; a first seal secured over the cavity of the first bowl portion for sealing the utensil and the first foodstuff within the cavity of the first bowl portion from the cavity of the second bowl portion for defining a first sealed container assembly; a second foodstuff disposed within the cavity of the second bowl portion of the second container; a second seal secured over the cavity of the second bowl portion for sealing the second foodstuff and the first sealed container assembly for defining a second sealed container assembly that is sealed from surrounding environment.

14. The assembly of claim 13 further including: a packaging jacket surrounding the second sealed container assembly for forming a packaged sealed container assembly, wherein the packaging jacket defines: a first opening sized for receiving a first lip portion of the second container; and a second opening sized for receiving a second lip portion of the second container.

15. The assembly of claim 14, wherein the packaging jacket further includes: a pre-weakened portion formed by a first row scores and a second row of scores spaced apart at a distance to define a tear strip, wherein each of the first row of scores and the second row of scores are defined by a V-shaped segment pointing in opposite directions for defining a portion of the distance to expand to a maximum distance.

16. The assembly of claim 15, wherein the pre-weakened portion is further defined by one or more scores arranged perpendicularly with respect to the first row of scores and the second row of scores and being aligned with each V-shaped segment for bifurcating the tear strip into a first tear strip portion and a second tear strip portion.

17. The assembly of claim 11, wherein the first utensil-retaining portion is sized for receiving a food-contacting portion defining the first end of the utensil, wherein the second utensil-retaining portion is sized for receiving an intermediate folding hinge of the utensil.

18. The assembly of claim 11, wherein the at least one snap-fit connection includes a first snap fit connection and a second snap-fit connection, wherein the first snap-fit connection includes a first embossed portion and a first debossed portion formed by a first portion of the side wall of the bowl portion of the first container, wherein the second snap-fit connection includes a second embossed portion and a second debossed portion formed by a second portion of the side wall of the bowl portion of the first container, wherein the first portion of the side wall of the bowl portion of the first container is arranged opposite the second portion of the side wall of the bowl portion of the first container.

19. The assembly of claim 18, wherein the first embossed portion forms a first ledge surface of the first portion of the side wall of the bowl portion of the first container that is sized for supporting a first end portion of the utensil, wherein the first debossed portion forms a first snap-fit retainer of the portion of the side wall of the bowl portion of the first container that is sized for snap-fit retaining the first end portion of the utensil, wherein the second embossed portion forms a second ledge surface of the second portion of the side wall of the bowl portion of the first container that is sized for supporting a second end portion of the utensil, wherein the second debossed portion forms a second snap-fit retainer of the portion of the side wall of the bowl portion of the first container that is sized for snap-fit retaining the second end portion of the utensil.

20. The assembly of claim 19, wherein the first end of the utensil is a food-contacting portion, wherein the second end of the utensil forms an intermediate folding hinge of the utensil.

21. The assembly of claim 19, wherein the first end of the utensil is a food-contacting portion, wherein the second end of the utensil forms a handle of the utensil, wherein the utensil does not include a folding hinge.

* * * * *